US010538424B1

(12) United States Patent
DeRaedt et al.

(10) Patent No.: US 10,538,424 B1
(45) Date of Patent: Jan. 21, 2020

(54) CONNECTOR ASSEMBLY FOR USE IN A SYSTEM FOR DISPENSING ALCOHOLIC BEVERAGES

(71) Applicant: BAR EVOLUTION LLC, Henderson, NV (US)

(72) Inventors: Peter Wolfgang DeRaedt, Henderson, NV (US); Bernd Witzany, Munich (DE); Andreas Sebastian Henneke, Munich (DE)

(73) Assignee: BAR EVOLUTION LLC, Henderson, NV (US)

( * ) Notice: Subject to any disclaimer, the term of this patent is extended or adjusted under 35 U.S.C. 154(b) by 0 days.

(21) Appl. No.: 16/015,913

(22) Filed: Jun. 22, 2018

Related U.S. Application Data

(60) Provisional application No. 62/523,361, filed on Jun. 22, 2017.

(51) Int. Cl.
*B67D 1/08* (2006.01)
*B67D 1/12* (2006.01)

(52) U.S. Cl.
CPC ..... *B67D 1/0889* (2013.01); *B67D 1/1277* (2013.01)

(58) Field of Classification Search
CPC ..... B67D 1/1277; B67D 3/0064
USPC .. 222/129, 132, 135, 145.1, 153.02, 153.04, 222/153.11, 153.14, 173, 545
See application file for complete search history.

(56) References Cited

U.S. PATENT DOCUMENTS

| | | | | |
|---|---|---|---|---|
| 2,864,534 | A * | 12/1958 | Wrenn, Jr. | F17C 7/00 222/5 |
| 4,496,081 | A * | 1/1985 | Farrey | B05B 1/30 222/135 |
| 5,344,051 | A * | 9/1994 | Brown | B29B 7/7447 222/135 |
| 7,918,368 | B2 * | 4/2011 | Crisp | B67D 1/0021 222/129 |
| 2014/0109526 | A1 * | 4/2014 | Taylor | B67D 3/0064 53/467 |

* cited by examiner

*Primary Examiner* — Vishal Pancholi
(74) *Attorney, Agent, or Firm* — Howard & Howard Attorneys PLLC

(57) ABSTRACT

A connector assembly controllably couples a plurality of containers in a box. Each container has a fitment having a channel. The connector assembly includes a valve assembly and an actuator. The valve assembly is movable between an unengaged position and an engaged position. The valve assembly includes a plurality of fitment receptacles. Each fitment receptacle is associated with a respective fitment. A liquid flow channel of the valve assembly couples the fitment receptacles to the outlet. The actuator is movable between an unlocked position and a locked position. The valve assembly is configured to move from the unengaged position to the engaged movement in response to movement of the actuator from the unlocked to locked positions. The fitments are inserted into the respective fitment receptacles in response to movement of the valve assembly from the unengaged position to the engaged position.

18 Claims, 53 Drawing Sheets

CONNECTOR ASSEMBLY FOR USE IN A SYSTEM FOR DISPENSING ALCOHOLIC BEVERAGES

CROSS-REFERENCE TO RELATED APPLICATIONS

The present application claims benefit of U.S. Provisional Patent Application Ser. No. 62/523,361, filed Jun. 22, 2017, the entire disclosure of which is hereby incorporated by reference.

FIELD OF THE INVENTION

The present disclosure relates generally to beverage dispensing solutions, and more specifically, to systems for dispensing alcoholic beverages.

BACKGROUND OF THE INVENTION

Regulations vary from country to country on how distilled spirits can be distributed, not only the volume but also packaging, labeling, filling, etc. In the United States, the Department of Treasury Alcohol & Tobacco Tax & Trade Bureau (TTB) regulates the bottle sizes for distilled spirits. Further, the Internal Revenue Code of 1986 authorizes regulations on the kind and size of containers for distilled spirits. According to the TTB, the purpose of the regulations establishing uniform standards of fill for alcoholic beverages is "to prevent a proliferation of bottle sizes and shapes which would inevitably result in consumer confusion and deception with regard to the quantity and net contents of the alcohol beverage package." In addition, the "uniformity in bottle sizes required by these standards also facilitates the proper calculation of Federal excise tax." A key issue related to these concepts is the potential loss of water and the resulting increase in alcohol concentration or "proof" which may be affected by the packaging.

The maximum volume of packaging of spirits may be limited in some jurisdictions. For example, in the United States, the maximum volume of packaging that spirits can be shipped or distributed in is currently 1.75 liters. This limitation has a significant impact for places where spirits are distributed or consumed in large quantities such as clubs, large events, bars, conferences, etc.

The current way to address this regulatory restriction is to create pump rooms filled with racks in which bottles are turned upside down and collectors channel the liquid through tubes to pumps and ultimately, to the dispensing device(s). This multiplies the capacity of a specific distilled spirit by the number of bottles used. However, this method requires significant real estate to support the bars in the property. It further has an impact on labor, space, weight, time and also the disposal process that generates a lot of waste. As a result, this solution creates significant inefficiencies.

The present disclosure is aimed at solving one or more of the problems identified above.

SUMMARY OF THE INVENTION

In one aspect of the present invention, a connector assembly for controllably coupling a plurality of containers containing a liquid. Each container has a fitment. Each fitment has a channel and is configured to releasably connect a respective container to the connector assembly. The containers are housed in a box with the fitments being arranged in predetermined relative locations. The connector assembly includes a valve assembly and an actuator. The valve assembly is movable between an unengaged position and an engaged position. The valve assembly includes a plurality of fitment receptacles. Each fitment receptacle is associated with a respective fitment. The plurality of fitment receptacles are arranged in a pattern coinciding with the predetermined relative locations of the fitments. The valve assembly has a liquid flow channel and an outlet. The liquid flow channel couples the fitment receptacles to the outlet. The actuator is coupled to the valve assembly. The actuator is movable between an unlocked position and a locked position. The valve assembly is configured to move from the unengaged position to the engaged movement in response to movement of the actuator from the unlocked to locked positions. The fitments are inserted into the respective fitment receptacles in response to movement of the valve assembly from the unengaged position to the engaged position.

In another aspect of the present invention, a connector assembly for controllably coupling a plurality of containers containing a liquid is provided. Each container has a fitment. Each fitment has a channel and is configured to releasably connect a respective container to the connector assembly. The containers are housed in a box with the fitments being arranged in predetermined relative locations. The connector assembly includes a valve assembly and an actuator. The valve assembly is movable between an unengaged position and an engaged position and includes a plurality of fitment receptacles. Each fitment receptacle is associated with a respective fitment. The plurality of fitment receptacles are arranged in a pattern coinciding with the predetermined relative locations of the fitments. The valve assembly has a liquid flow channel and an outlet. The liquid flow channel couples the fitment receptacles to the outlet. The valve assembly includes a plurality of valve pushers and an interior passage. Each valve pusher is located at a bottom of a respective fitment receptacle. Each fitment includes a fitment valve. The valve pusher is configured to be received within a respective fitment as the fitments are inserted into the fitment receptacles thereby opening the respect fitment valve and allowing liquid to flow from the containers. The interior passage connects each fitment receptacle and the outlet. The actuator is coupled to the valve assembly and is movable between an unlocked position and a locked position. The valve assembly is configured to move from the unengaged position to the engaged movement in response to movement of the actuator from the unlocked to locked positions. The fitments are inserted into the respective fitment receptacles in response to movement of the valve assembly from the unengaged position to the engaged position. The valve assembly has a front and a back. The actuator includes a first hinge assembly located near the front of the valve assembly, a second hinge assembly located near the back of the valve assembly, and a lever coupled to the first hinge assembly. The second hinge assembly is fixedly coupled to the first hinge assembly such that the second hinge assembly moves in concert with the first hinge assembly. The lever is moveable between an unsecured position to a secured position. The actuator is moved from the unlocked position to the locked position in response to actuation of the lever from the unsecured to the secured position.

In still another aspect of the present invention, a connector assembly for controllably coupling a plurality of containers containing a liquid is provided. Each container has a fitment. Each fitment has a channel and is configured to releasably connect a respective container to the connector assembly. The containers are housed in a box with the fitments being arranged in predetermined relative locations. The connector assembly includes a guiderail, a valve assembly and an actuator. The guiderail has an inner track forming an inner track and is configured to be positioned relative to the containers such that the inner track engages the channel of each fitment. The valve assembly is coupled to the guiderail and is movable between an unengaged position relative to the guiderail and an engaged position relative to the guiderail. The valve assembly includes a plurality of fitment receptacles. Each fitment receptacle is associated with a respective fitment. The plurality of fitment receptacles are arranged in a pattern coinciding with the predetermined relative locations of the fitments. The valve assembly has a liquid flow channel and an outlet. The liquid flow channel couples the fitment receptacles to the outlet. The valve assembly includes a valve pusher located at a bottom of each fitment receptacle. Each fitment includes a fitment valve. The valve pusher is configured to be received within a respective fitment as the fitments are inserted into the fitment receptacles thereby opening the respect fitment valve and allowing liquid to flow from the containers. The actuator is coupled between the guiderail and the valve assembly and is movable between an unlocked position and a locked position. The valve assembly is configured to move from the unengaged position to the engaged movement in response to movement of the actuator from the unlocked to locked positions. The fitments are inserted into the respective fitment receptacles in response to movement of the valve assembly from the unengaged position to the engaged position. The actuator includes a first hinge assembly fixedly coupled to one of the guiderail and the valve assembly and rotatably coupled to an other one of the guiderail. The valve assembly and a lever are coupled to the first hinge assembly. The lever is moveable between an unsecured position to a secured position. The valve assembly is moved from the unengaged position to the engaged position in response to actuation of the lever from the unsecured to the secured position. The valve assembly has a front and a back. The first hinge assembly is located along the front of the valve assembly. The actuator includes a second hinge assembly fixedly coupled to the one of the guiderail and the valve assembly and rotatably coupled to the other one of the guiderail and the valve assembly. The second hinge assembly is fixedly coupled to the first hinge assembly such that the second hinge assembly moves in concert with the first hinge assembly.

In still another aspect of the present invention, a connector assembly for controllably coupling a plurality of containers containing a liquid is provided. Each container has a fitment. Each fitment has a channel and is configured to releasably connect a respective container to the connector assembly. The containers may be housed in a box with the fitments arranged in predetermined relative locations. The box is mechanically aligned within a compartment. The connector assembly includes a valve assembly with a plurality of fitment receptacles. The valve assembly is fixed within the compartment. Each fitment receptacle is associated with a respective fitment. The plurality of fitment receptacles are arranged in a pattern coinciding with the predetermined relative locations of the fitments of the box. The valve assembly has a liquid flow channel and an outlet. The liquid flow channel couples the fitment receptacles to the outlet. The valve assembly includes a plurality of valve pushers and an interior passage. Each valve pusher is located at a bottom of a respective fitment receptacle. Each fitment includes a fitment valve. The valve pusher is configured to be received within a respective fitment as the fitments are inserted into the fitment receptacles thereby opening the respect fitment valve and allowing liquid to flow from the containers. The interior passage connects each fitment receptacle and the outlet. In use, the fitments, when pushed into the compartment, are inserted into the respective fitment receptacles in response to the movement of the box thereby moving from an unengaged position to the engaged position.

BRIEF DESCRIPTION OF THE DRAWINGS

Advantages of the present disclosure will be readily appreciated, as the same becomes better understood by reference to the following detailed description, when considered in connection with the accompanying drawings. Non-limiting and non-exhaustive embodiments of the present disclosure are described with reference to the following figures, wherein like numerals refer to like parts throughout the various views unless otherwise specified.

DETAILED DESCRIPTION OF INVENTION

Figure 1:
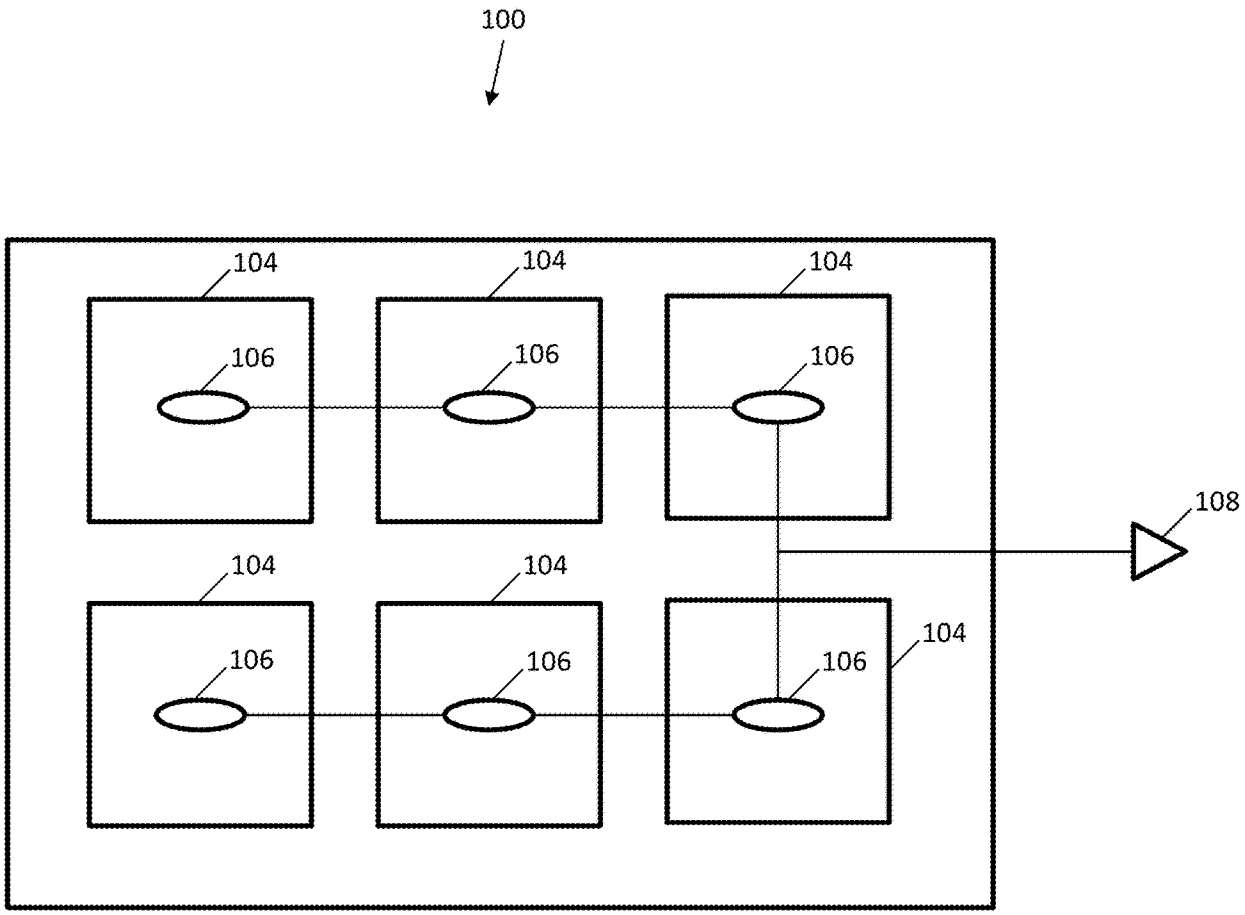
FIG. 1 is a block diagram of a beverage dispensing system that may be used to dispense alcoholic beverages.

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment of example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The present disclosure particularly describes exemplary beverage dispensing systems and packages (e.g., boxes) that may be used to dispense alcoholic beverages. As used herein, the term "alcoholic beverages" refers to any beverage or liquid with alcoholic content that is meant for human consumption.

The boxes include one or more dividers that form two or more compartments within each box. Each compartment is designed to hold an inner container (e.g., a bag) which holds an alcoholic beverage. Each bag includes an outlet for dispensing the alcoholic beverage and a fitment that is attached to the outlet. Each outlet is separated from each other outlet so that the contents of each bag do not mix or flow together until a connector assembly is attached. An alignment plate aligns the fitments of the bags in preparation for attaching to the connector assembly.

A connector assembly is configured to attach to the alignment plate and to the fitments of each bag. The connector assembly includes a connector aligned with each fitment. The connector assembly also includes a holding plate, an actuator plate, a locking member, and a plurality of spring members. The connectors are connected together and are configured to jointly direct liquids from the bags to a common main outlet.

As is described more fully herein, the components of the connector assembly (e.g., the holding plate, the actuator plate, the locking member, and the spring members) cooperate together to enable a user to quickly and accurately attach the connector assembly to the alignment plate and fitments when the user prepares the beverage dispensing system for use. The components of the connector assembly also cooperate together to enable the user to quickly and efficiently disengage the connector assembly from the alignment plate and fitments, for example, when the user wishes to replace empty bags or boxes with filled replacement bags or boxes.

The embodiments described herein comply with the Department of Treasury Alcohol & Tobacco Tax & Trade Bureau (TTB) regulations in that the alcoholic beverages contained in the bags are shipped in a "divorced" state (i.e., the outlets of the bags are not connected together) so that each bag is a self-contained bag that may hold the maximum amount of an alcoholic beverage. The embodiments also enable significant efficiencies to be realized for distributors and end users of the alcoholic beverages. For example, larger quantities of alcoholic beverages may be shipped to a destination and may be efficiently and conveniently prepared for use as compared to prior art systems where individual bottles of alcoholic beverages are shipped. In one example, according to an embodiment described herein, a box may include four bags that each holds up to a maximum allowable volume, e.g., 1.75 liters of an alcoholic beverage. Accordingly, a single box may include 7 liters of an alcoholic beverage that is able to be quickly attached to a connector assembly for dispensing at an end user location. Other boxes may be used with other suitable numbers of bags to enable distributors to have a wide variety of options in the amount of alcoholic beverages to include within a box. For example, boxes with 6 or 8 bags (or any suitable number) may be used to provide 10.5 liters or 14 liters of alcoholic beverages (or any suitable amount) as desired.

FIG. 1 is a block diagram of an exemplary beverage dispensing system 100 that may be used to dispense liquids, such as alcoholic beverages. In one embodiment, beverage dispensing system 100 is a bartender station (or is included therein) at a bar. Alternatively, beverage dispensing system 100 may be used with, or incorporated within, any suitable location such as a kitchen, a bar, a reception area, or may be a portable station that may be used to serve alcoholic beverages in any suitable location.

In one embodiment, beverage dispensing system 100 includes a cabinet or housing 102 and a plurality of beverage dispensing packages 104 positioned within housing 102. Beverage dispensing system 100 may be placed in a bar, a kitchen, or in any other suitable location to enable a user to dispense alcoholic beverages from system 100. For example, a bartender may use beverage dispensing system 100 to dispense alcoholic beverages from each of the beverage dispensing packages 104 during operation.

In one embodiment, each beverage dispensing package 104 is a box or other suitable container that includes a plurality of beverage dispensing bags, for example. Each bag is designed to hold 1.75 liters of alcoholic beverage in order to comply with applicable regulations. Each beverage dispensing package 104 includes an associated connector assembly 106 coupled thereto for dispensing the contents of the bags. For clarity of description, beverage dispensing packages 104 may be referred to herein as boxes 104, although it should be recognized that beverage dispensing packages 104 may be any suitable container other than a box. Similarly, for clarity of description, boxes 104 are described as including a plurality of beverage dispensing bags (or "bags"). However, it should be recognized that any suitable internal containers may be used instead of bags.

In one embodiment, an outlet of each connector assembly 106 may be connected together to form a common outlet line connected to a nozzle 108 or other suitable component for dispensing the contents of the bags. Alternatively, the outlet of each connector assembly 106 may be connected to a separate nozzle 108 so that the contents of the bags within a box 104 may be dispensed separately from the contents of the bags within each other box 104.

Figure 2:
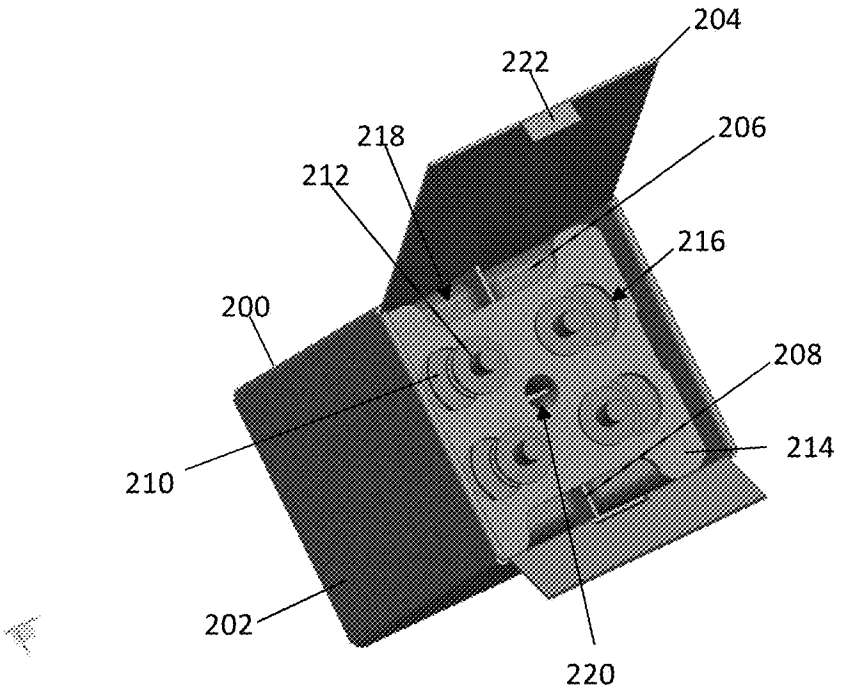
FIG. 2 is a perspective view of an exemplary beverage dispensing package that may be used with the beverage dispensing system shown in FIG. 1.

FIG. 2 is a perspective view of an exemplary beverage dispensing package 200, such as a box 200, that may be used with beverage dispensing system 100 (shown in FIG. 1). While package 200 is described herein as a box, it should be recognized that any suitable package or container may be used.

In an exemplary embodiment, box 200 is a cardboard box that includes sides 202 and a top cover 204. Top cover 204 is movable to expose or to cover a plurality of compartments (not shown in FIG. 2) that include a plurality of inner containers, such as beverage dispensing bags 206. The compartments are formed by one or more dividers 208 positioned within box 200.

In an exemplary embodiment, two dividers 208 are positioned within box 200 to form four substantially equally sized and shaped compartments. More specifically, in the exemplary embodiment, each compartment has a square-shaped cross-section that houses a respective bag 206 that also has a substantially square-shaped cross-section. Alternatively, any suitable number and shape of compartments and bags 206 may be used with box 200. In addition to creating compartments within box 200, dividers 208 provide stability and support to box 200.

Each bag 206 includes an outlet (not shown in FIG. 2) that enables liquid (e.g., an alcoholic beverage) to be dispensed from bag 206. A container fitment 210 or another suitable connector is securely fit onto each outlet to enable the outlet of each bag 206 to be releasably coupled to a connector assembly. Accordingly, in the exemplary embodiment, each outlet is initially separated from each other outlet until the connector assembly is attached to the outlets. In this manner, the outlets of each bag 206 may be transported in a "divorced" manner (i.e., not in fluid communication with each other) to satisfy applicable governmental regulations and may then be connected together by a connector assembly at the final destination to provide one common fluid dispensing line that dispenses the contents of each bag through the common dispensing line.

In one embodiment, each fitment 210 includes a removable cap 212 that prevents the contents of each bag 206 from spilling or leaking out during transport. Caps 212 also may be included for health reasons, for example, to prevent contamination of fitments 210. In a more specific embodiment, each cap 212 may be glued or otherwise attached to top cover 204 of box 200 during shipping so that when a user opens top cover 204, each cap 212 will be automatically removed to expose the fitments of each bag 206. Alternatively, caps 212 may be connected together by a string or another suitable connection to enable a user to quickly remove all caps 212 at the same time or in quick succession. In one embodiment, caps 212 may be used to visibly determine whether bags 206 or fitments 210 have been tampered with or opened. For example, caps 212 may have a detachable ring or another suitable portion that may detach from caps 212 when caps 212 are first removed. Accordingly, a user may determine that caps 212 have been removed or fitments 210 have otherwise been tampered with by determining whether the ring (or other portion) of caps 212 is no longer attached. Alternatively, a seal (not shown) that is removable, penetrable, or may be broken, to facilitate or allow alcohol to flow, may be used. Other suitable indicators may be used to determine whether caps 212 have been removed or tampered with in other embodiments.

In one embodiment, an alignment plate 214 is coupled to a top portion of box 200 and is secured to box 200 by two or more latches (not shown) on opposing sides of alignment plate 214. Alignment plate 214 includes a plurality of fitment openings 216 to enable the outlets of each bag 206 to extend through alignment plate 214. Alignment plate 214 also includes two or more grip openings 218 to enable a user to grasp a portion of alignment plate 214 when attaching a connector assembly to alignment plate 214 and bags 206. Alignment plate 214 also includes a locking member opening 220 for receiving a locking member to removably attach alignment plate 214 to the connector assembly.

[In one embodiment, alignment plate 214 is transparent to enable a user to view bags 206 underneath alignment plate 214. In a further embodiment, bags 206 are transparent to enable a user to view the contents of bag 206 and/or a fill level of bags 206.

In one embodiment, top cover 204 is foldable or otherwise movable to either cover, or expose the top portion of box 200. For example, top cover 204 may be folded down into a closed position for shipping or transport. Additionally or alternatively, top cover 204 may be removable by a user to expose the top portion of box 200. For example, top cover 204 may be removably attached to box 200 by a perforated or pre-scored hinge that a user may tear off to remove top cover 204. In the closed position, top cover 204 hides alignment plate 214 and fitments 210 from view and protects alignment plate 214 and fitments 210 during transport. Top cover 204 may be latched in the secured position by a tab or latch 222. Top cover 204 may also be removed or folded up into an open position when a user wants to access fitments 210 or alignment plate 214, for example, in preparation for dispensing the contents of bags 206.

Figure 3:
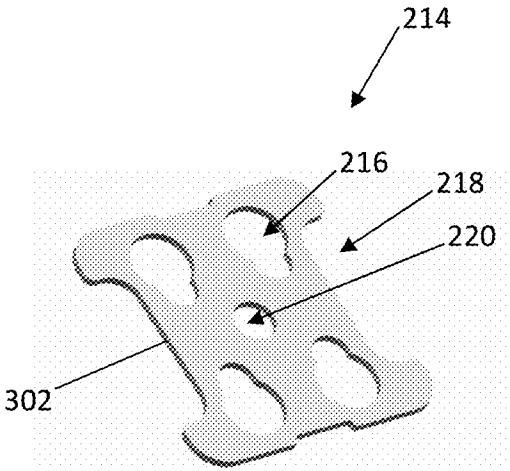
FIG. 3 is a perspective view of an exemplary alignment plate that may be used with the beverage dispensing package shown in FIG. 2.

FIG. 3 is a perspective view of alignment plate 214 that may be used with beverage dispensing package 200 (shown in FIG. 2).

In an exemplary embodiment, alignment plate 214 includes a plurality of fitment openings 216 and a locking member opening 220. In one embodiment, fitment openings 216 are key-hole shaped to enable fitments 210 of each bag 206 to be easily inserted (through the larger portion of each opening 216) and to enable fitments 210 to be secured in a final attachment position (the smaller portion of each opening 216) to facilitate coupling fitments 210 to the connector assembly. Alternatively, fitment openings 216 may have any suitable shape.

Locking member opening 220 is shaped to receive a portion of a locking member of the connector assembly. In one embodiment, locking member opening 220 is circular. Alternatively, locking member opening 220 may be any suitable shape.

Alignment plate 214 also includes two grip openings 218 defined therein to enable a user to grasp a grip portion 302 of alignment plate 214. While two grip openings 218 are shown in FIG. 3, it should be recognized that any suitable number of grip openings 218 may be formed in alignment plate 214.

Figure 4:
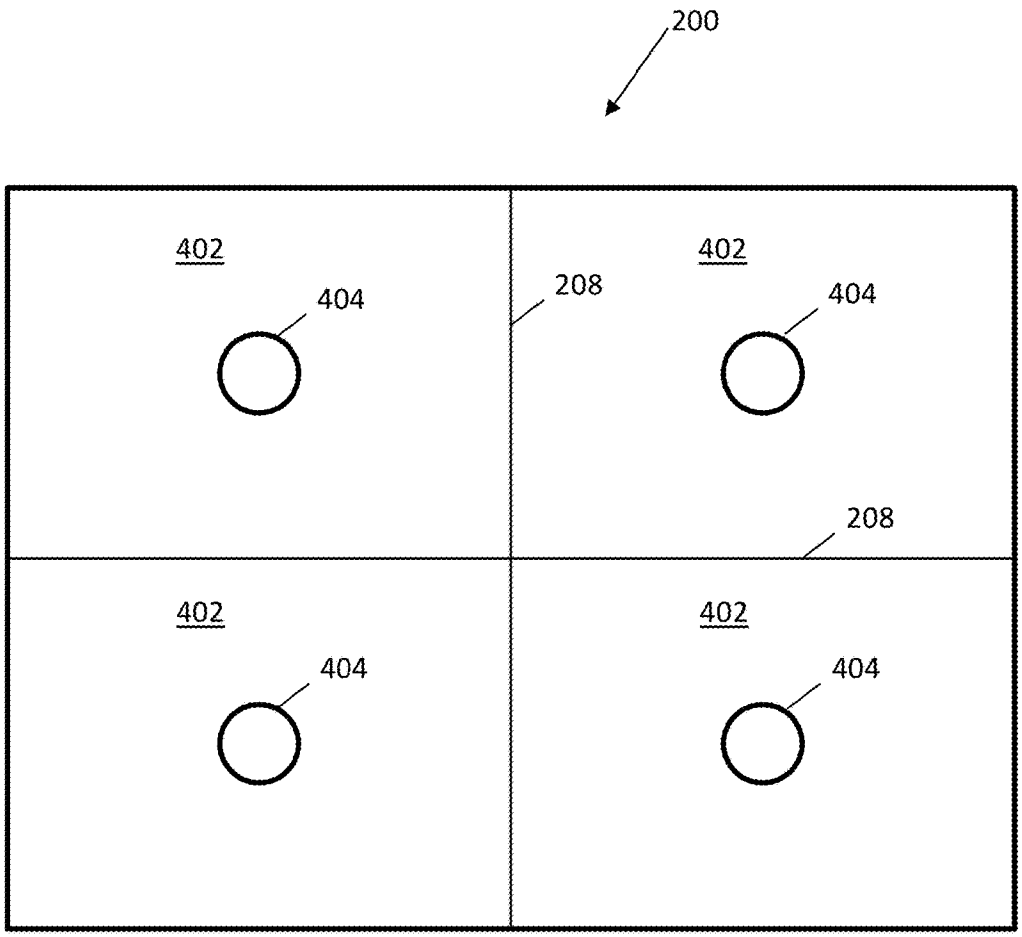
FIG. 4 is a block diagram showing a top view of the beverage dispensing package of FIG. 2 with an alignment plate and fitment caps removed.

FIG. 4 is a block diagram showing a top view of beverage dispensing package 200 (e.g., box 200) with alignment plate 214 and caps 212 removed. As illustrated in FIG. 4, box 200 may include a plurality of dividers 208 that form a plurality of compartments 402 within box 200. While two dividers 208 are shown as forming four compartments 402, it should be recognized that any suitable number of dividers 208 and compartments 402 may be included within each box 200.

In an exemplary embodiment, a separate bag 206 is positioned within each compartment 402. Each bag 206 includes a respective outlet 404 for dispensing the contents of bag 206 (e.g., alcoholic beverages). Each outlet 404 is separated from each other so that the outlets 404 (and therefore, the contents of each bag 206) are not in fluid communication with each other. This is sometimes referred to as being in a "divorced" state.

As illustrated in FIG. 4, box 200, compartments 402, and bags 206 may have a substantially square or rectangular cross-section to enable bags 206 and boxes 200 to be stacked on top of each other during transport or during operation (i.e., during the dispensing of the alcoholic beverages). Alternatively, boxes 200, compartments 402, and bags 206 may have any suitable shape or cross-section as desired. Further examples of box 200, compartments 402, and bag 206 shapes are illustrated in FIGS. 5 and 6A-6D.

Figure 5:
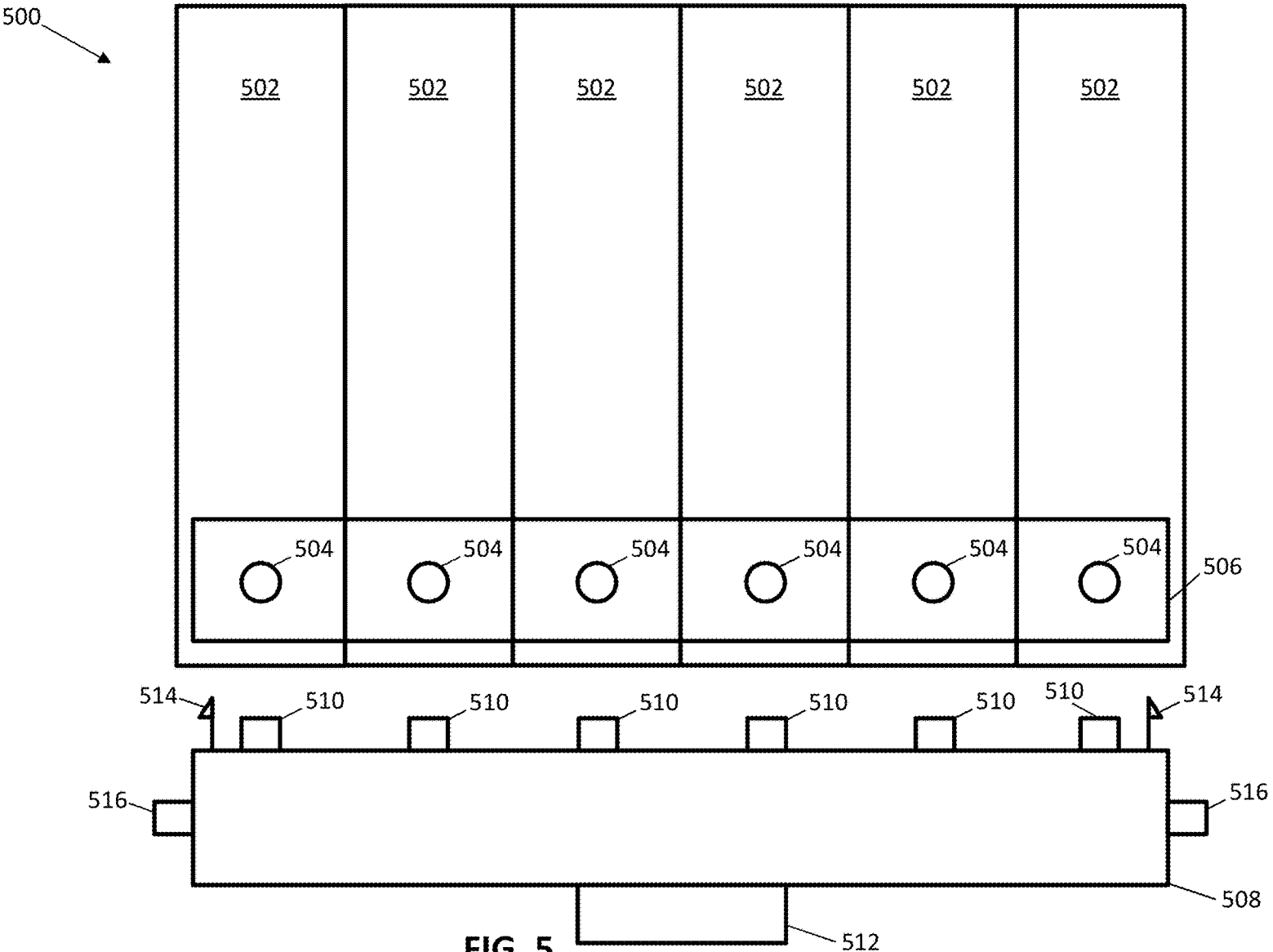
FIG. 5 illustrates an alternative embodiment of a beverage dispensing package having elongated rectangular compartments that may be used with the beverage dispensing system shown in FIG. 1.

FIG. 5 illustrates an alternative embodiment of a box 500 having elongated rectangular compartments 502 that may be used with beverage dispensing system 100 (shown in FIG. 1). While six rectangular compartments 502 are illustrated in FIG. 5, any suitable number and shape of compartments 502 may be used with box 500.

In the embodiment shown in FIG. 5, a bag (not shown) having a rectangular cross-section is placed within each compartment, and an outlet 504 of each bag is positioned near a bottom portion of each compartment 502. Alternatively, outlets 504 may be positioned in any suitable location with respect to the bags or compartments 502. A rectangular alignment plate 506 is coupled to the bags and outlets 504 in a similar manner as described above with reference to FIGS. 2 and 3.

A connector assembly 508 is removably attachable to alignment plate 506. Connector assembly 508 includes a plurality of connectors 510, with each connector 510 aligned with a respective outlet 504 when outlets 504 are positioned within alignment plate 506. The connectors 510 are in flow communication with a main outlet 512 of connector assembly 508. Accordingly, when connector assembly 508 is attached to alignment plate 506, the bags are coupled in flow communication with main outlet 512 through each bag outlet 504 and through the respective connectors 510. The contents of each bag are therefore enabled to jointly and simultaneously flow together through connector assembly 508 and be dispensed out of main outlet 512.

In one embodiment, connector assembly 508 is removably attached to alignment plate 506 by one or more latches 514 that engage a portion of alignment plate 506 and/or box 500. One or more buttons 516 are provided in connector assembly 508 that release latches 514 when buttons 516 are pressed by a user to enable connector assembly 508 to detach from alignment plate 506 and box 500.

Figure 6C:
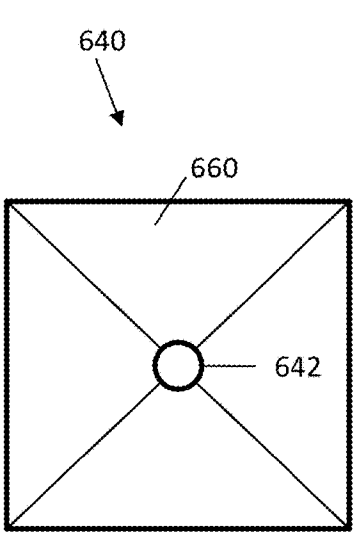
FIGS. 6A-6D illustrate alternative beverage dispensing packages and associated containers that may be used with the beverage dispensing system shown in FIG. 1.
Figure 6B:
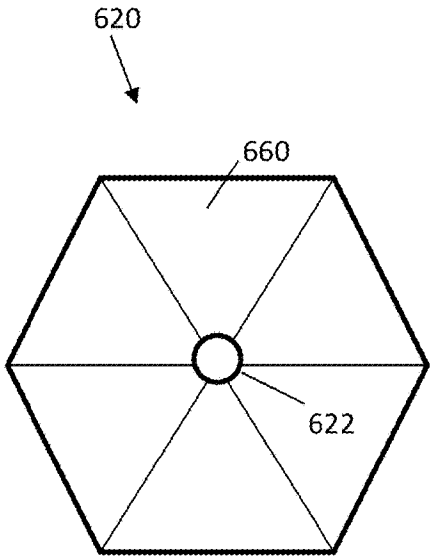
Figure 6A:
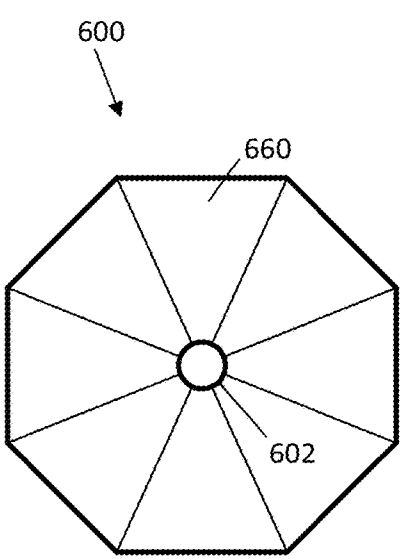
Figure 6D:
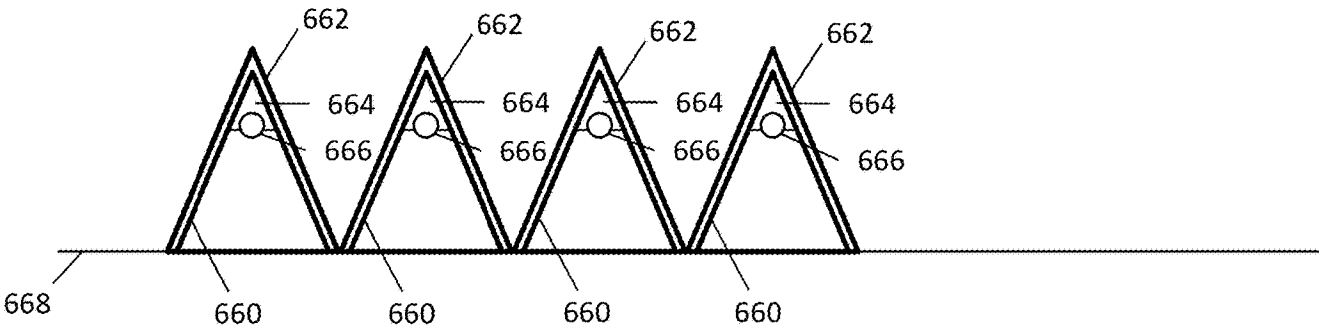

FIGS. 6A-6D illustrate alternative boxes and associated bags that may be used with beverage dispensing system 100 (shown in FIG. 1). FIG. 6A is a block diagram of a substantially octagonal box 600. FIG. 6B is a block diagram of a substantially hexagonal box 620. FIG. 6C is a block diagram of a substantially square box 640. FIG. 6D illustrates bags 660 having a substantially triangular cross-section that may be used with the boxes shown in FIGS. 6A-6C.

Referring to FIG. 6A, octagonal box 600 includes eight bags 660 having a triangular cross-section. A common outlet 602 is positioned in the center of box 600 and is connected to respective outlets (shown in FIG. 6D) of each bag 660.

Referring to FIG. 6B, hexagonal box 620 includes six bags 660 having a triangular cross-section. A common outlet 622 is positioned in the center of box 620 and is connected to respective outlets (shown in FIG. 6D) of each bag 660.

Referring to FIG. 6C, square box 640 includes four bags 660 having a triangular cross-section. Similar to the embodiments of 6A and 6B, a common outlet 642 is positioned in the center of box 640 and is connected to respective outlets (shown in FIG. 6D) of each bag 660.

Referring to FIG. 6D, a plurality of bags 660 having a triangular cross-section may be used with the boxes shown in FIGS. 6A-6C. Bags 660 may be housed or positioned within an intermediate container 662 that also has a triangular cross-section. Each bag 660 includes an alignment portion 664 that may be used to align a respective outlet 666 with the common outlet of the box shown in FIG. 6A, 6B, or 6C.

Each intermediate container 662 may be coupled to a common edge 668 that may form the exterior of the box. For example, in one embodiment, each intermediate container 662 is coupled to a common piece of cardboard that may be folded to form the box. Thus, if four intermediate containers 662 and associated bags 660 are provided, containers 662 may be folded along edge 668 to form the square box shown in FIG. 6C. It should be recognized that other suitable shapes may be used for intermediate containers 662 and bags 660 to form a box of any suitable shape and size. It should also be recognized that intermediate containers 662 may be connected together along different edges to form boxes of any desired shape and configuration.

In one embodiment, the bags of the boxes described in FIGS. 6A-6C may be covered by a removable portion of the respective box. For example, in one embodiment, the box may include one or more tear-away portions or sides that may be pulled away from the bags by a user to reveal the bags and/or outlets.

FIGS. 7-15 illustrate components of a first embodiment of an integrated beverage dispensing system, including a beverage dispensing package and an associated connector assembly.

FIGS. 16-23 illustrate components of a second embodiment of an integrated beverage dispensing system, including a beverage dispensing package and an associated connector assembly.

Figure 24:
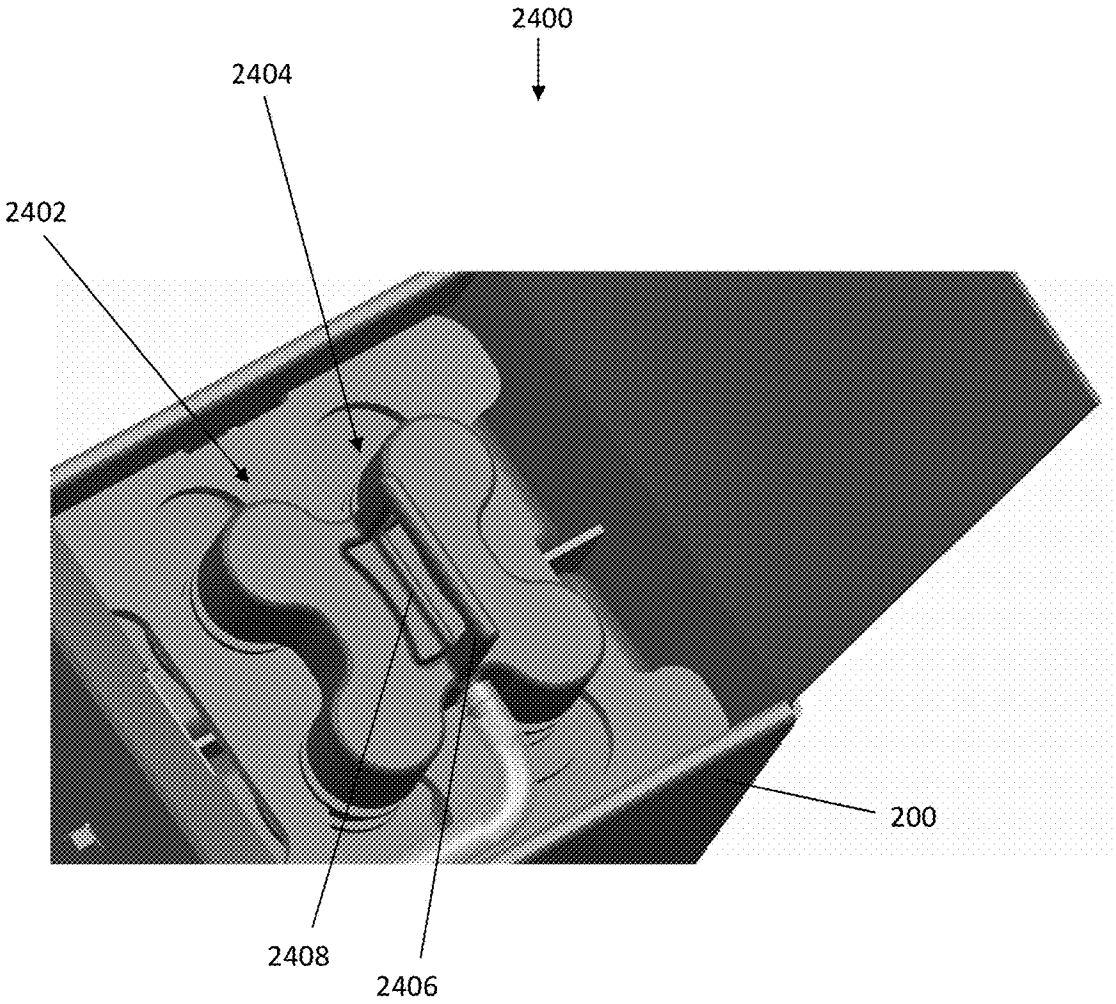
FIG. 24 is a perspective view of another beverage dispensing system.

FIG. 24 illustrates a third embodiment of an integrated beverage dispensing system, including a beverage dispensing package and an associated connector assembly.

Figure 7:
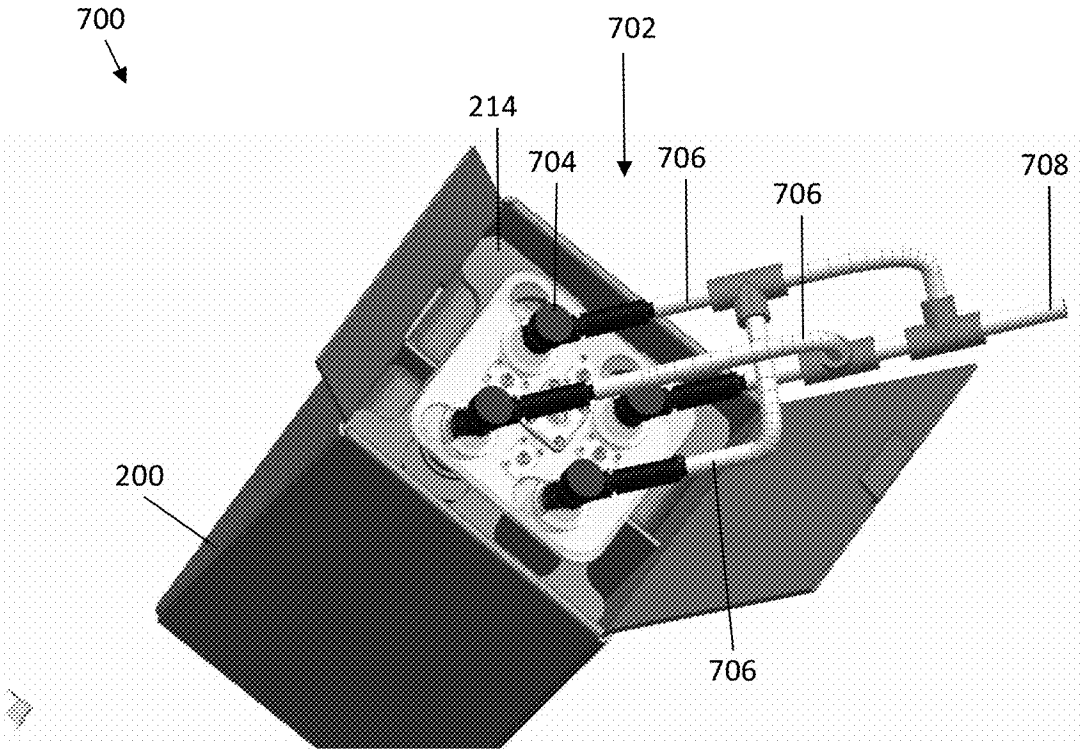
FIG. 7 is a perspective view of a beverage dispensing system.

Referring to FIG. 7, a perspective view of a first embodiment of a beverage dispensing system 700 is illustrated. Beverage dispensing system 700 includes beverage dispensing package 200 (e.g., a box 200) and a connector assembly 702 that is removably coupled to box 200.

In an exemplary embodiment, box 200 includes four bags positioned within four compartments created by two dividers. Alternatively, any suitable number of compartments, bags, and dividers may be used with box 200. In addition, box 200 includes an alignment plate 214 and fitments 210 described above with reference to FIGS. 2 and 3.

Connector assembly 702 includes a plurality of connectors 704 that correspond to fitments 210. Each connector 704 is aligned and sized to enable an insertion portion (not shown) of connector 704 to be inserted within a respective fitment 210 when cap 212 of fitment 210 is removed. Each connector 704 may be connected to an intermediate dispensing line 706, and each intermediate dispensing line 706 may be connected to a main dispensing line 708. Alternatively, connectors 704 may be connected directly to main dispensing line 708 using a single adapter that connects all connectors 704 to main dispensing line 708. When connectors 704 are connected to fitments 210 and to intermediate dispensing lines 706 and main dispensing line 708, a flow communication is established from bags 206 to main dispensing line 708 through bag outlets 404, fitments 210, connectors 704, and intermediate lines 706.

Figure 8:
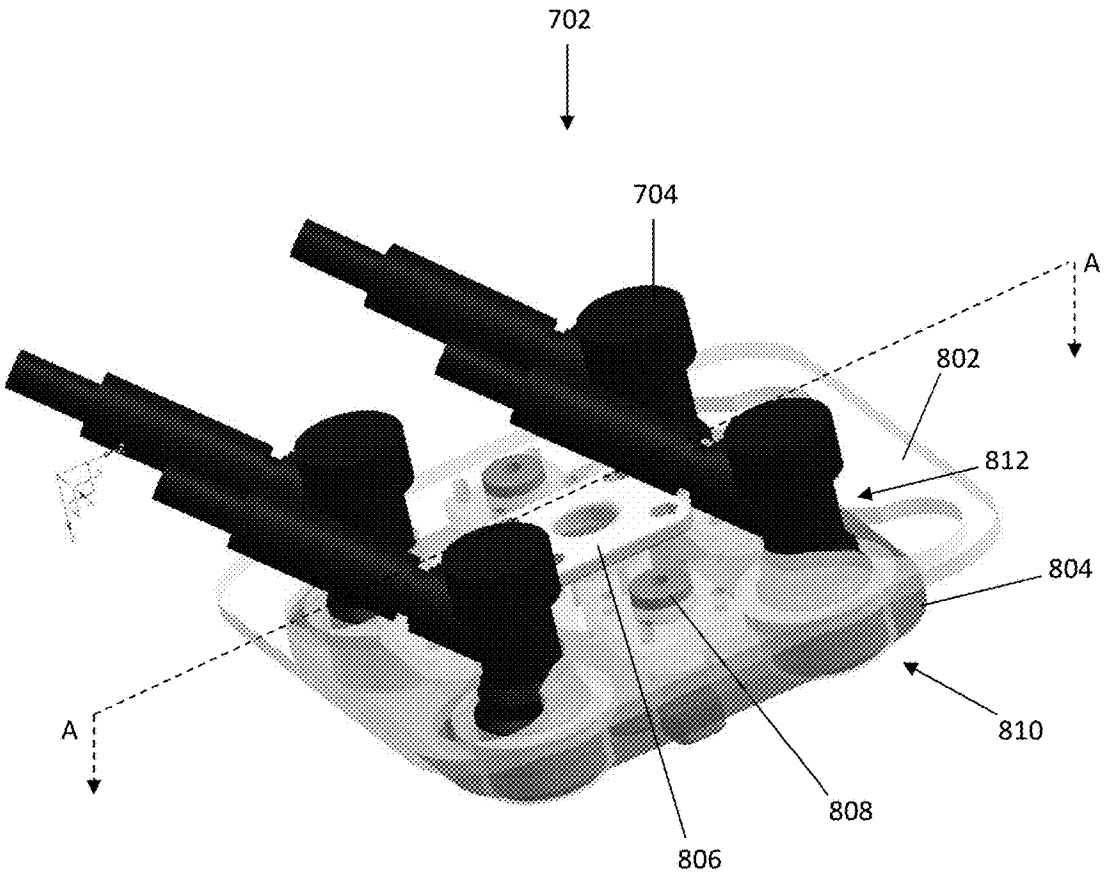
FIG. 8 is a perspective view of a connector assembly that may be used with the beverage dispensing system shown in FIG. 7.
Figure 9:
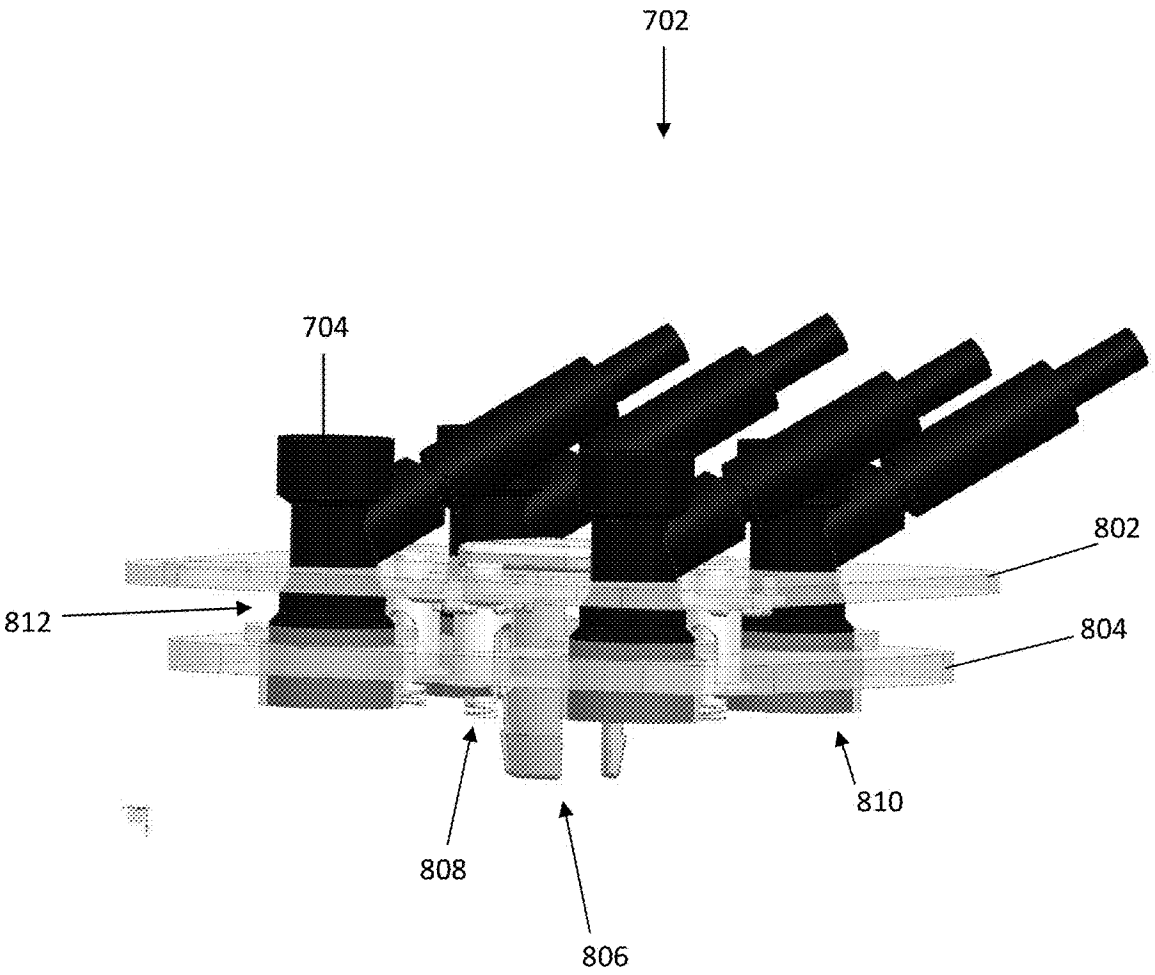
FIG. 9 illustrates a side view of the connector assembly shown in FIG. 8.

Referring to FIG. 8, a perspective view of connector assembly 702 is illustrated. FIG. 9 illustrates a side view of connector assembly 702. As illustrated in FIGS. 8 and 9, connector assembly 702 includes connectors 704, a holding plate 802, an actuator plate 804, a locking member 806, and a plurality of spring members 808. Holding plate 802, actuator plate 804, locking member 806, and spring members 808 are illustrated and described with reference to FIGS. 10-13.

In an exemplary embodiment, connectors 704 are coupled to holding plate 802 and a portion of each connector 704 extends through respective openings defined in holding plate 802 and actuator plate 804. Each connector 704, in this embodiment, is a ball lock "push-pull" connector that includes a movable portion that is able to be selectably connected to fitments 210 or disconnected from fitments 210. More specifically, when connector assembly 702 is ready to be connected to alignment plate 214 and fitments 210, a movable sleeve 810 of connector 704 is pulled toward a main body 812 of connector 704 to prepare connector 704 for attachment. Movable sleeve 810 is then pushed away from main body 812, for example, by a spring (not shown) or another suitable biasing member within connector 704, once connector 704 is attached to fitment 210 to lock connector 704 to fitment 210. When connector assembly 702 is disengaged from actuator plate 804 and outlets 404, movable sleeve 810 is again pulled toward main body 812 to release connector 704 from fitment 210.

Figure 10:
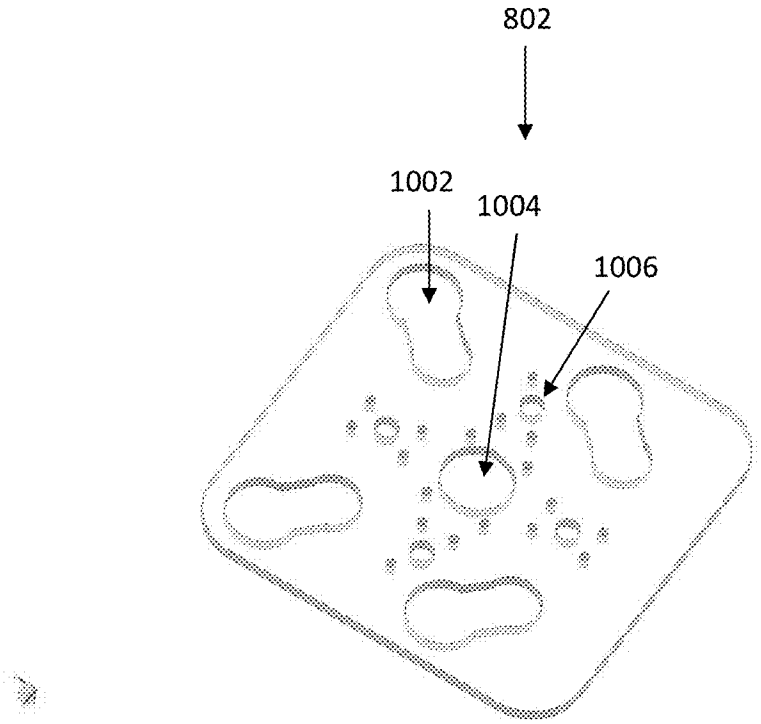
FIG. 10 is a top view of a holding plate that may be used with the beverage dispensing system shown in FIG. 7.

Referring to FIG. 10, a top view of holding plate 802 is illustrated. In an exemplary embodiment, each connector 704, locking member 806, and spring member 808 is coupled to holding plate 802.

In an exemplary embodiment, holding plate 802 includes a connector opening 1002 for each connector 704 to enable connector 704 to extend through the respective opening 1002 and thus, through holding plate 802. In an exemplary embodiment, each connector opening 1002 is shaped as a keyhole shape to facilitate attaching and aligning connectors 704 to holding plate 802. Holding plate 802 also includes a locking member opening 1004 through which locking member 806 extends.

In an exemplary embodiment, holding plate 802 also includes a plurality of spring member openings 1006 that enable a respective spring member 808 to extend through each opening 1006.

Holding plate 802 is designed to hold connectors 704 in place when attaching connector assembly 702 to alignment plate 214 (and thus box 200) and when removing connector assembly 702 from alignment plate 214 and box 200. In addition, holding plate 802 provides a secure and stable support that a user may grasp, push, and pull (as appropriate) when connecting and disconnecting connector assembly 702.

Figure 11:
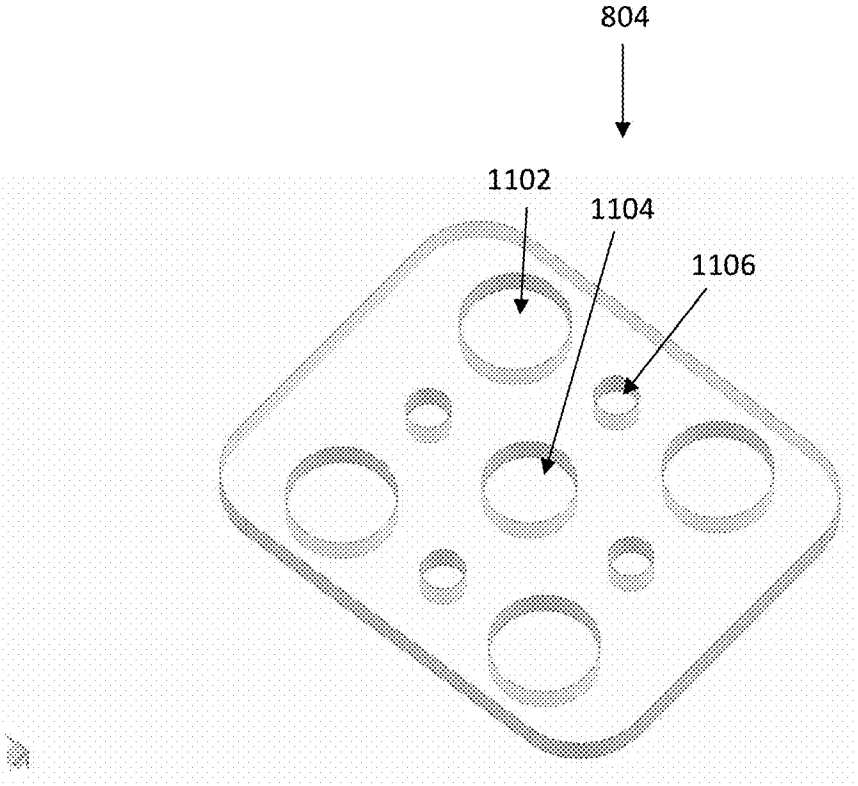
FIG. 11 is a top view of an actuator plate that may be used with the beverage dispensing system shown in FIG. 7.

Referring to FIG. 11, a top view of actuator plate 804 is illustrated. In an exemplary embodiment, each connector 704 and spring member 808 is coupled to holding plate 802. However, locking member 806 is not coupled to actuator plate 804.

In an exemplary embodiment, actuator plate 804 includes a plurality of connector openings 1102, a locking member opening 1104, and a plurality of spring member openings 1106. In a similar manner as described above with reference to holding plate 802, connectors 704 extend through a respective connector opening 1102, locking member 806 extends through locking member opening 1104, and spring members 808 extend through a respective spring member opening 1106.

Actuator plate 804 is designed to prepare connectors 704 for connecting to fitment 210 and for disconnecting from fitment 210. In an exemplary embodiment, movable sleeve 810 of each connector 704 is coupled to actuator plate 804 such that each sleeve 810 is automatically moved when actuator plate 804 is moved. For example, when actuator plate 804 is moved toward holding plate 802, movable sleeves 810 are also moved toward holding plate 802 to enable connectors 704 to be connected to fitment 210 or disconnected from fitment 210. When actuator plate 804 is moved away from holding plate 802, movable sleeves 810 are also moved away from holding plate 802 to enable movable sleeves 810 to latch onto fitments 210.

Figure 12:
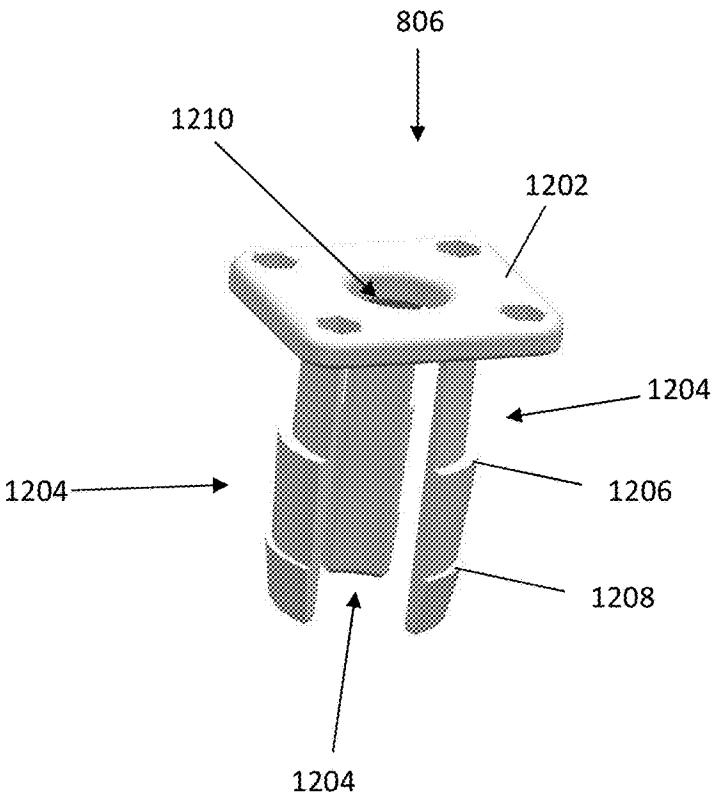
FIG. 12 is a side view of a locking member that may be used with the beverage dispensing system shown in FIG. 7.

Referring to FIG. 12, a side view of locking member 806 is illustrated. In an exemplary embodiment, locking member 806 includes a head portion 1202 and a plurality of legs 1204. Each leg 1204 includes a first engagement ridge 1206 and a second engagement ridge 1208.

Head portion 1202 includes a plurality of screw or bolt holes that enable locking member 806 to be screwed or bolted to holding plate 802. Alternatively, any other suitable means can be used to secure locking member 806 to holding plate 802. While head portion 1202 is securely attached to holding plate 802, legs 1204 extend through locking member opening 1004 of holding plate 802 and locking member opening 1104 of actuator plate 804 and are not attached to actuator plate 804.

In one embodiment, head portion 1202 includes a central opening 1210 extending through a center of head portion 1202. Alternatively, opening 1210 may be positioned in any suitable location of head portion 1202. Central opening 1210 enables a user to look through head portion 1202 (via opening 1210) to visibly identify locking member opening 220 of alignment plate 214. Accordingly, the user may align connector assembly 702 with alignment plate 214 when the user attaches connector assembly 702 to alignment plate 214. Central opening 1210 may also enable the user to visibly determine the level of liquid within one or more bags 206 when connector assembly 702 is attached to alignment plate 214 and box 200.

Locking member 806 enables connector assembly 702 to be securely attached, or locked, to alignment plate 214 of box 200. In addition, locking member 806 enables actuator plate 804 to be releasably secured in a position (also referred to as a "primed position") with respect to holding plate 802 that enables connector assembly 702 to be attached to alignment plate 214 as described more fully herein.

Figure 13:
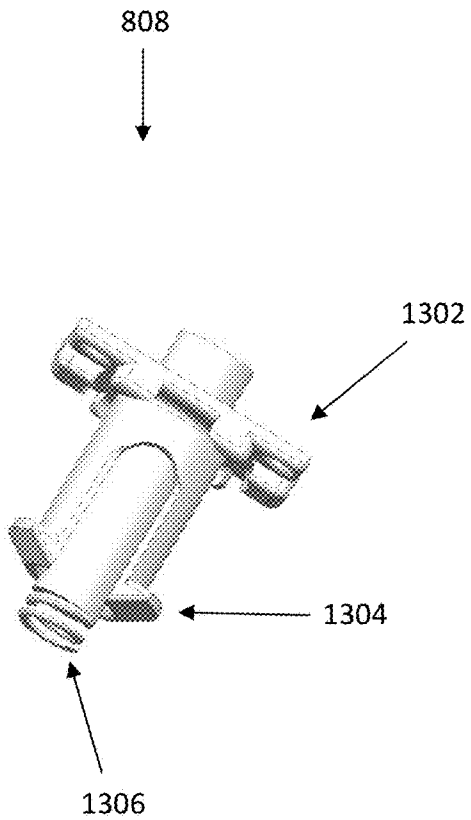
FIG. 13 is a top view of a spring member that may be used with the beverage dispensing system shown in FIG. 7.

Referring to FIG. 13, a top view of spring member 808 is illustrated. In an exemplary embodiment, each spring member 808 includes an upper flange 1302 and a lower flange 1304. Upper flange 1302 includes a plurality of screw or bolt holes that enable spring member 808 to be screwed or bolted to holding plate 802. Alternatively, any other suitable means can be used to secure upper flange 1302 to holding plate 802.

In an exemplary embodiment, spring members 808 are used to prevent actuator plate 804 from moving more than a predefined distance away from holding plate 802. For example, lower flange 1304 engages a bottom surface of actuator plate 804 (the surface facing away from holding plate 802) to prevent actuator plate 804 from moving past lower flange 1304.

Spring member 808 includes a spring 1306 or other biasing component that extends out from a bottom portion of spring member 808 away from holding plate 802 and actuator plate 804. As described more fully herein, spring 1306 contacts alignment plate 214 of box 200 when connector assembly 702 is attached to alignment plate 214 and fitments 210. Spring 1306 therefore biases connector assembly 702 away from alignment plate 214 when connector assembly 702 is attached to alignment plate 214 to facilitate disengaging connector assembly 702 from alignment plate 214 and box 200.

Figure 14:
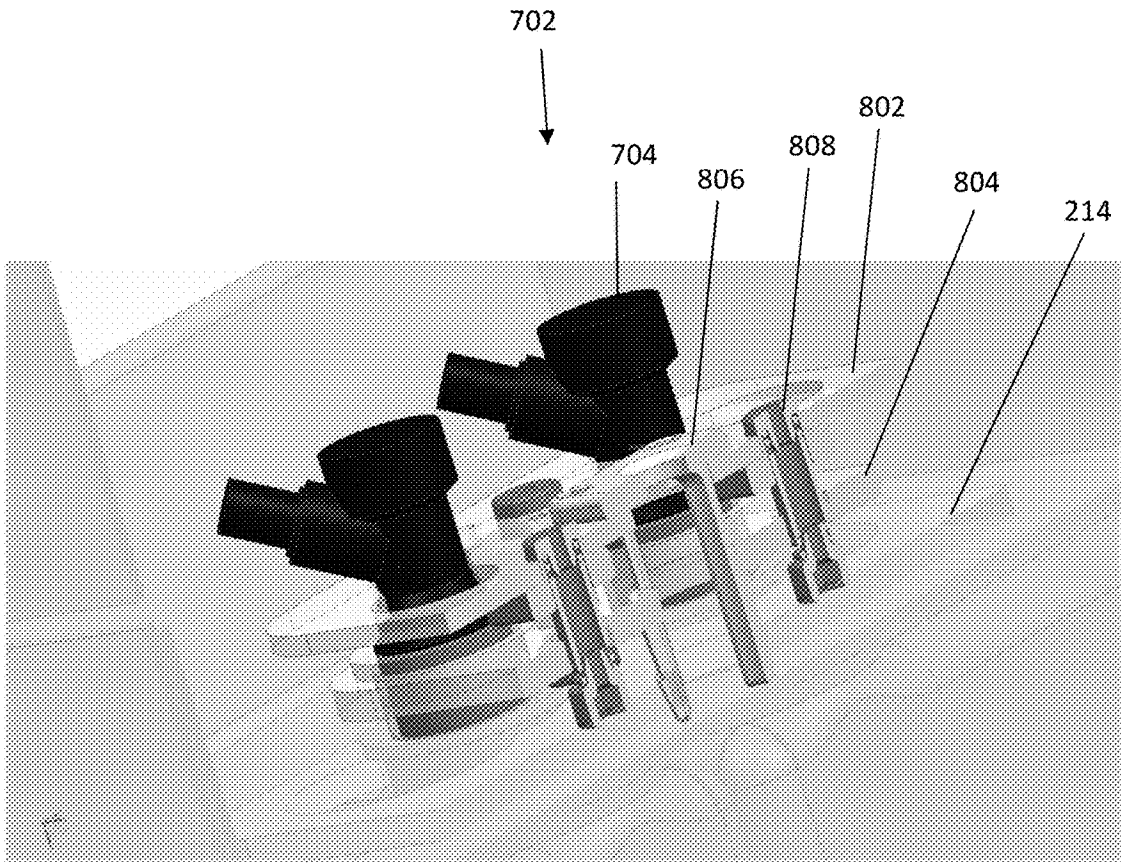
FIG. 14 is a perspective cut-away view of the connector assembly shown in FIG. 8 taken along line A-A.
Figure 15:
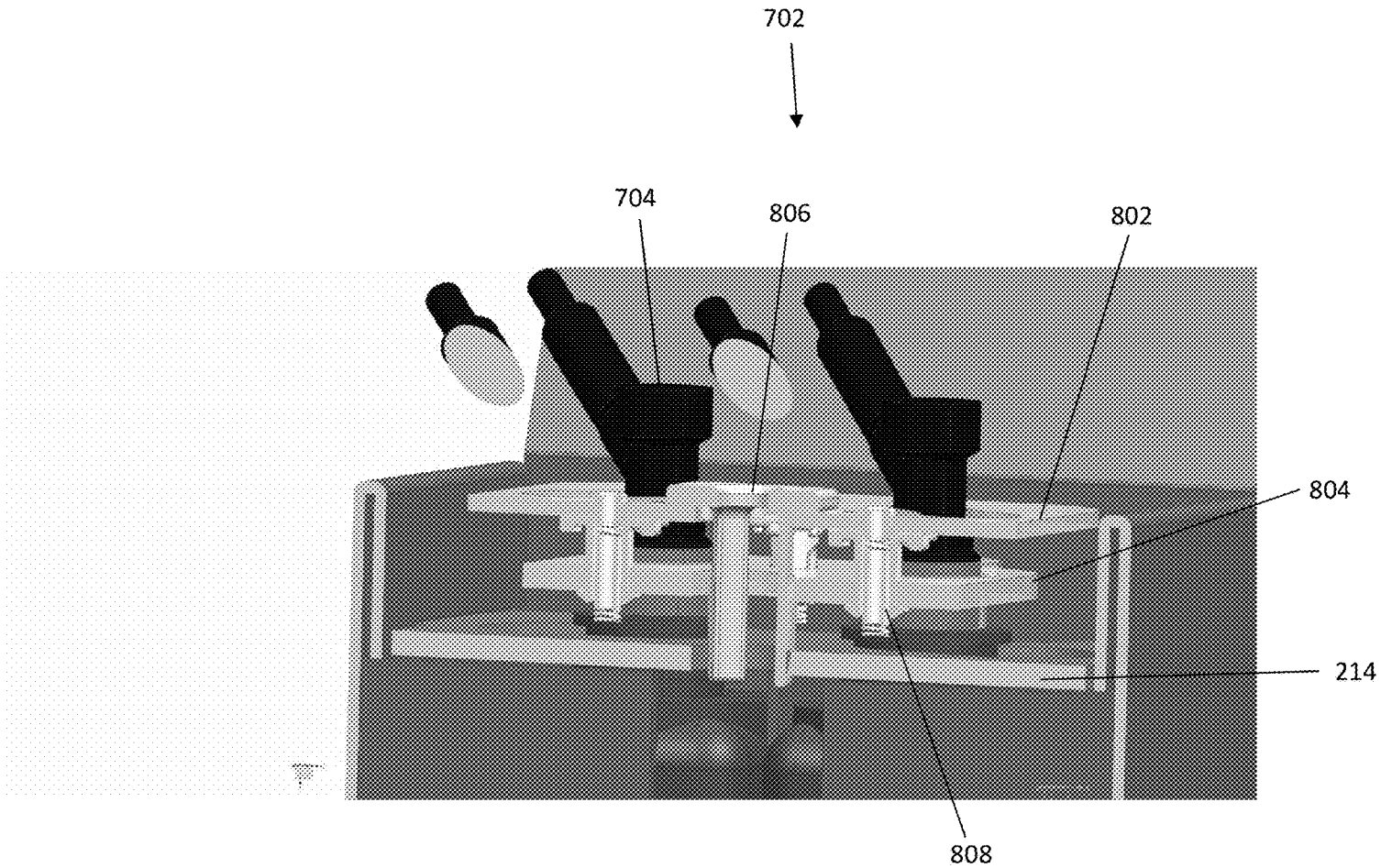
FIG. 15 is a side cut-away view of the connector assembly shown in FIG. 8 taken along line A-A.

Referring to FIG. 14, a perspective cut-away view of connector assembly 702 taken along line A-A is illustrated. FIG. 15 is a side cut-away view of connector assembly 702 taken along line A-A. FIGS. 14 and 15 may be used to illustrate the operation of connector assembly 702 when connecting to alignment plate 214 or when disconnecting from alignment plate 214.

As described above, box 200 is typically shipped or transported disconnected from connector assembly 702, and a cap 212 covers each fitment 210 of each bag 206. Once the box 200 and connector assembly 702 arrive at a destination for assembly, a user removes caps 212 from fitments 210.

The user then holds connector assembly 702 and pulls actuator plate 804 towards holding plate 802 to prepare connector assembly 702 for connection to box 200. As actuator plate 804 moves toward holding plate 802, legs 1204 of locking member 806 move further through locking member opening 1104 of actuator plate 804 until actuator plate 804 reaches first engagement ridge 1206. First engagement ridge 1206 of each leg 1204 snaps into position contacting the bottom surface of actuator plate 804. In addition, since movable sleeve 810 of each connector 704 is attached to actuator plate 804, each movable sleeve 810 is pushed toward holding plate 802, thus preparing each connector 704 for attachment to a respective fitment 210.

The user may then release actuator plate 804. First engagement ridge 1206 of each locking member leg 1204 securely holds actuator plate 804 (and connector assembly 702) in a primed position (i.e., a position ready for attachment to box 200).

Next, the user presses connector assembly 702 onto alignment plate 214 such that connectors 704 attach to fitments 210. The user may do so by wrapping his or her fingers around grip portion 302 of alignment plate 214, placing his or her palm on holding plate 802, and contracting the fingers toward the palm. As this happens, legs 1204 of locking member 806 move through locking member opening 220 of alignment plate 214.

In an exemplary embodiment, locking member opening 220 in alignment plate 214 has a smaller diameter than a diameter of locking member opening 1104 of actuator plate 804. Accordingly, when legs 1204 of locking member 806 begin to enter locking member opening 1104 of alignment plate 214, legs 1204 are pressed or bent inward by the relatively small diameter of locking member opening 220 of alignment plate 214 as compared to the diameter of the locking member opening 1104 of actuator plate 804. As legs 1204 are pushed inward from the insertion force of pressing connector assembly 702 onto alignment plate 214, first engagement ridge 1206 of each leg 1204 also is pressed inward and disengages from actuator plate 804. Thus, holding plate 802 is freed to move away from actuator plate 804 by the biasing force of spring members 808 and/or movable sleeves 810.

As holding plate 802 moves away from actuator plate 804, movable sleeves 810 also are moved away from holding plate 802 and, as a result, latch onto fitments 210. Second engagement ridge 1208 of locking member 806 latches to the underside of alignment plate 214 (i.e., the surface of alignment plate 214 facing away from connector assembly 702) to secure connector assembly 702 to alignment plate 214.

At this point, connector assembly 702 is securely attached to alignment plate 214 and fitments 210 by second engagement ridge 1208 of locking member 806 and by the biasing force of spring members 808. Furthermore, an uninterrupted fluid communication path is formed by the fact that bags 206, outlets 404, fitments 210, connectors 704, intermediate dispensing line 706 (if provided), and main dispensing line 708 are all positioned in flow communication with each other. The alcoholic beverage (or other contents) within each bag 206 may then be dispensed using a nozzle or other tool coupled to main dispensing line 708.

If the user wants to disconnect box 200 from connector assembly 702, the user grasps actuator plate 804 and holding plate 802, and squeezes the plates together to move actuator plate 804 toward holding plate 802. The diameter of locking member opening 1104 of actuator plate 804 is smaller than the portion of each leg 1204 between first engagement ridge 1206 and second engagement ridge 1208. Thus, when actuator plate 804 is moved toward holding plate 802, legs 1204 are forced inward again. As legs 1204 are forced inward, second engagement ridge 1208 disengages from alignment plate 214 such that alignment plate 214 is no longer held in place by locking member 806. The biasing force of spring members 808 against alignment plate 214 causes connector assembly 702 to be pushed away from alignment plate 214, and connectors 704 are automatically disengaged from fitments 210 and outlets 404.

When actuator plate 804 is moved sufficiently close to holding plate 802, first engagement ridge 1206 of each leg 1204 snaps into position contacting the bottom surface of actuator plate 804. The user may then release actuator plate 804. At this point, actuator plate 804 is now back in the primed position and connector assembly 702 is ready to be attached to another box 200, if desired.

Figure 16:
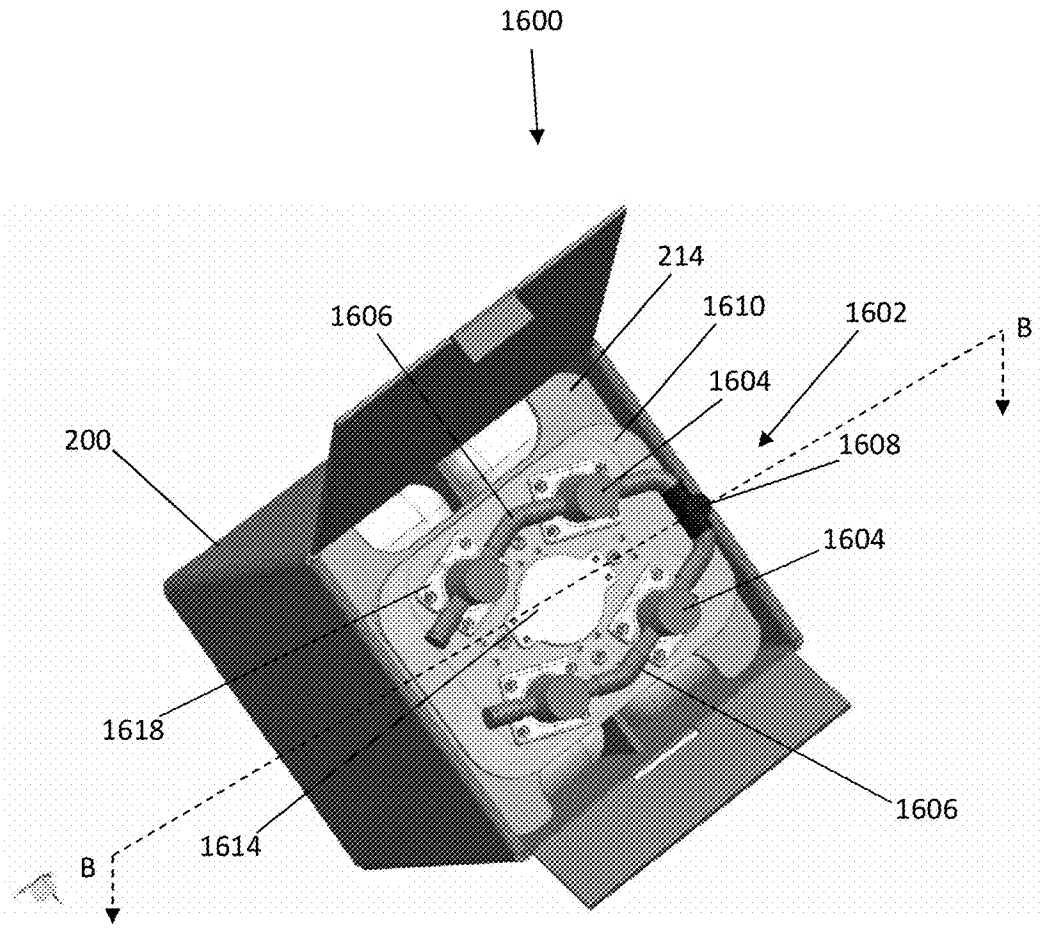
FIG. 16 is a perspective view of another beverage dispensing system.

Referring to FIG. 16, a perspective view of a second embodiment of a beverage dispensing system 1600 is illustrated. Beverage dispensing system 1600 includes a beverage dispensing package 200 (e.g., a box) and a connector assembly 1602 that is removably coupled to box 200.

In an exemplary embodiment, box 200 includes four bags positioned within four compartments created by two dividers. Alternatively, any suitable number of compartments, bags, and dividers may be used with box 200. As described above, box 200 includes an alignment plate 214 and fitments 210.

Figure 17B:
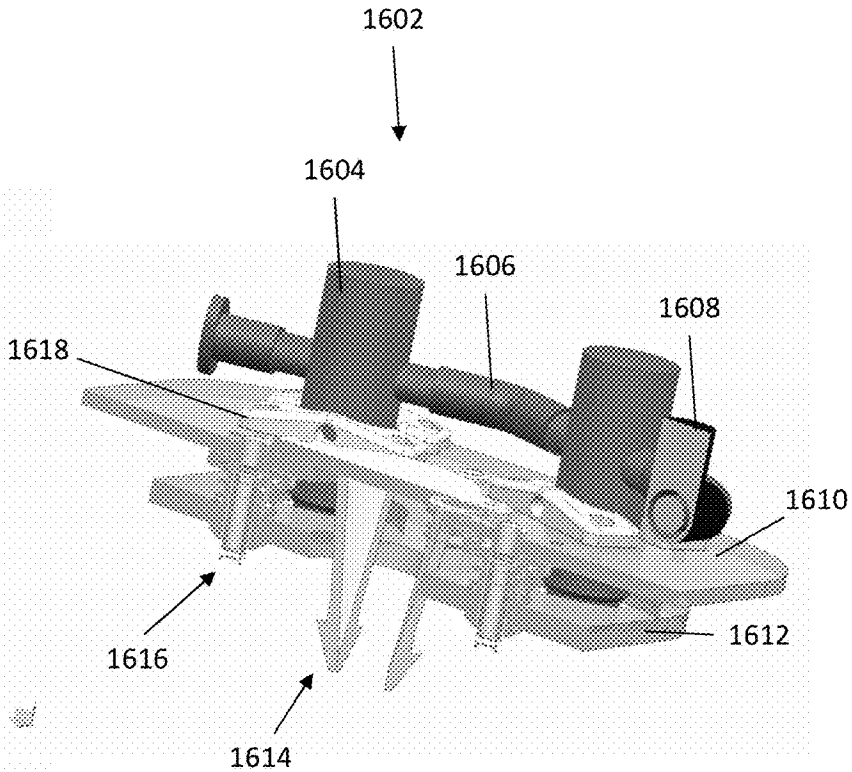
FIG. 17B is a perspective cut-away view of the connector assembly of FIG. 16 taken along line B-B.
Figure 17A:
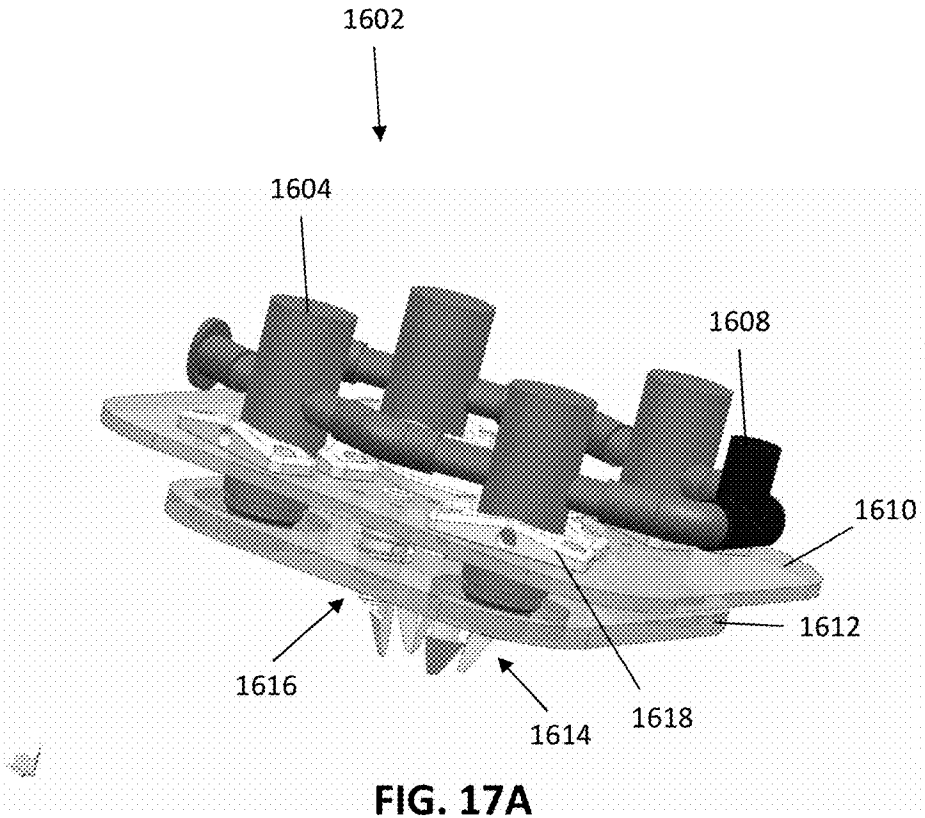
FIG. 17A is a perspective view of a connector assembly that may be used with the beverage dispensing system shown in FIG. 16.

FIG. 17A is a perspective view of connector assembly 1602 and FIG. 17B is a perspective cut-away view of connector assembly 1602 taken along line B-B.

As illustrated in FIGS. 16, 17A, and 17B, connector assembly 1602 includes a plurality of connectors 1604 that are coupled together by a single main dispensing line 1606 which terminates in a main dispensing outlet 1608. Connector assembly 1602 also includes a holding plate 1610, an actuator plate 1612, a locking member 1614, and a plurality of spring members 1616. A mounting bracket 1618 couples each connector 1604 to holding plate 1610 in an exemplary embodiment.

In the embodiment shown in FIGS. 16, 17A, and 17B, connectors 1604 are so-called "push connectors". More specifically, in one embodiment, connectors 1604 are QCD II connectors. Accordingly, connectors 1604 may be pushed into engagement with fitments 210 without first needing to be placed in a primed position (as compared to connectors 704 of FIG. 7, for example).

Figure 18:
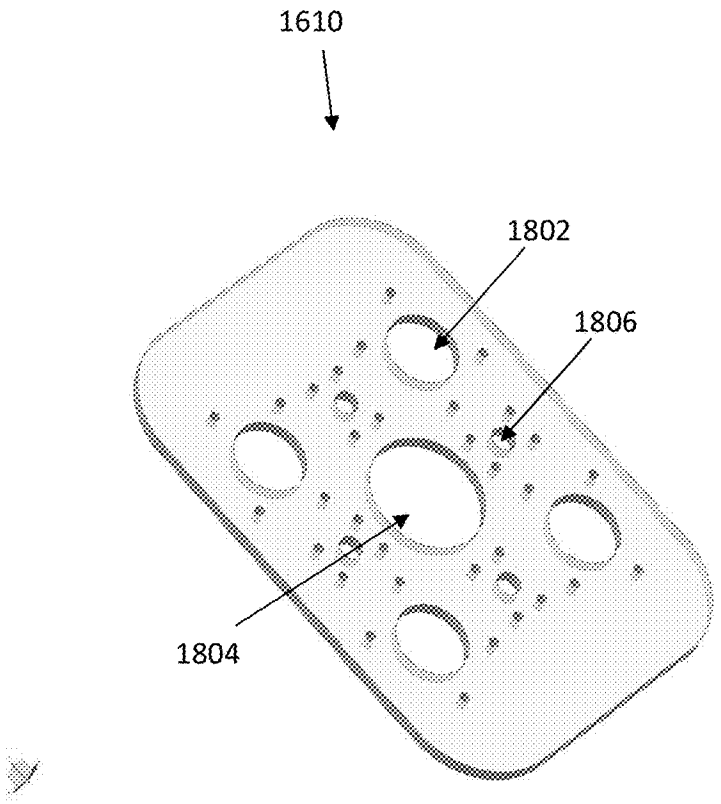
FIG. 18 is a perspective view of a holding plate that may be used with the beverage dispensing system shown in FIG. 16.

Referring to FIG. 18, a perspective view of holding plate 1610 is illustrated. Holding plate 1610 includes a plurality of connector openings 1802, a locking member opening 1804, and a plurality of spring member openings 1806. Holding plate 1610 is substantially similar to holding plate 802 (shown in FIG. 10) with the exception that connector openings 1802 are substantially circular, rather than keyhole shaped. Otherwise, holding plate 1610 operates substantially similarly to holding plate 1610 unless otherwise specified.

Figure 19:
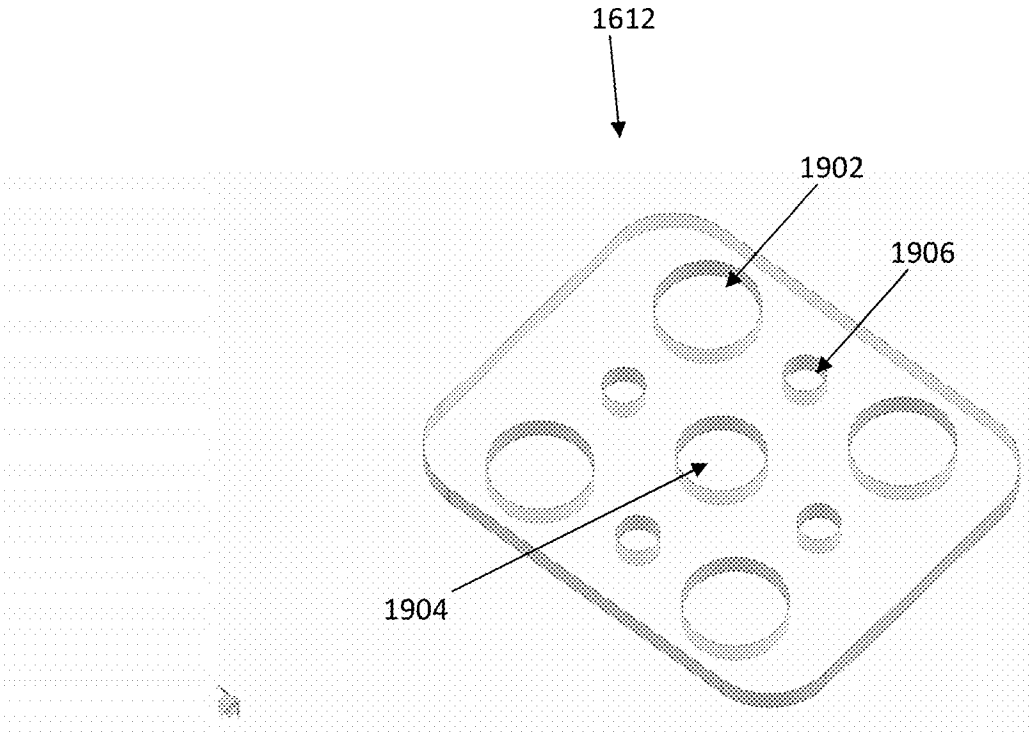
FIG. 19 is a perspective view of an actuator plate that may be used with the beverage dispensing system shown in FIG. 16.

Referring to FIG. 19, a perspective view of actuator plate 1612 is illustrated. Actuator plate 1612 includes a plurality of connector openings 1902, a locking member opening 1904, and a plurality of spring member openings 1906. Connector openings 1902 are sized and shaped to enable connectors 1604 to extend through actuator plate 1612 without engaging with actuator plate 1612. Accordingly, in this embodiment, connectors 1604 are not coupled to or otherwise engaged with actuator plate 1612 in contrast to connectors 704 (shown in FIG. 7) where movable sleeves 810 (shown in FIG. 8) are engaged with actuator plate 1612. Otherwise, actuator plate 1612 is substantially similar to actuator plate 804 (shown in FIG. 11) and operates substantially similarly unless otherwise noted.

Figure 20:
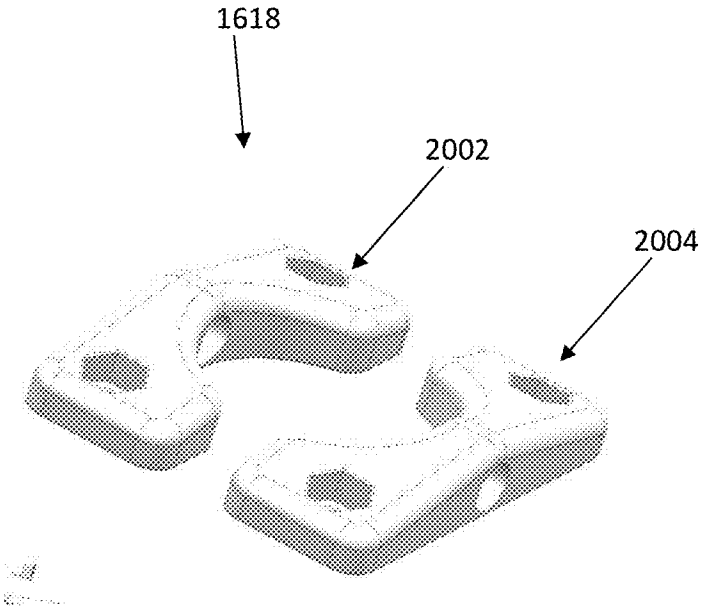
FIG. 20 is a perspective view of a mounting bracket that may be used with the beverage dispensing system shown in FIG. 16.

Referring to FIG. 20, a perspective view of mounting bracket 1618 is illustrated. In one embodiment, each mounting bracket 1618 includes a first portion 2002 and a second portion 2004 that cooperate together to secure each connector 1604 to holding plate 1610. For example, when assembling connector assembly 1602, connectors 1604 may be first positioned within respective connector openings 1802 of holding plate 1610. First portion 2002 and second portion 2004 of mounting bracket 1618 may then be placed on either side of each connector 1604 and may be bolted, screwed, or otherwise attached to holding plate 1610 to securely hold each connector 1604 in place with respect to holding plate 1610.

Figure 21:
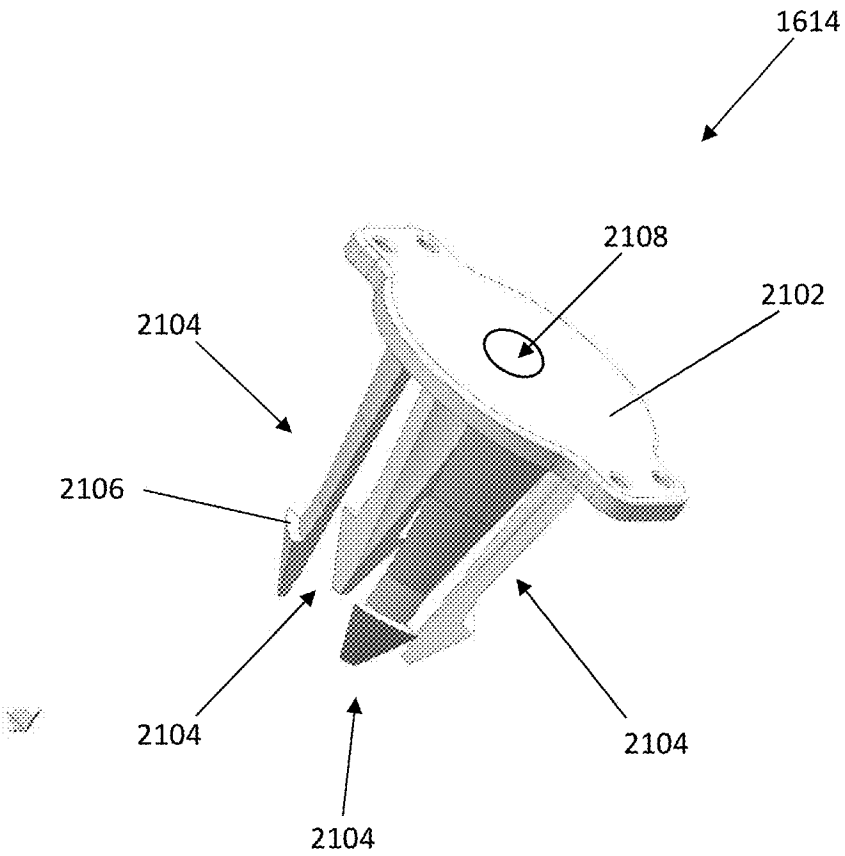
FIG. 21 is a perspective view of a locking member that may be used with the beverage dispensing system shown in FIG. 16.

Referring to FIG. 21, a perspective view of locking member 1614 is shown. Locking member 1614 includes a head portion 2102 and a plurality of legs 2104 that each include a first engagement ridge 2106. Accordingly, locking member 1614 is substantially similar to locking member 806 (shown in FIG. 12) except that locking member 1614 includes only a first engagement ridge 2106 (which is similar to second engagement ridge 1208 of locking member 806).

Similar to locking member 806, head portion 2102 of locking member 1614 includes a central opening 2108 extending through a center of head portion 2102. Alternatively, opening 2108 may be positioned in any suitable location of head portion 2102. Central opening 2108 enables a user to look through head portion 2102 (via opening 2108) to visibly identify locking member opening 220 of alignment plate 214. Accordingly, the user may align connector assembly 1602 with alignment plate 214 when the user attaches connector assembly 1602 to alignment plate 214. Central opening 2108 may also enable the user to visibly determine the level of liquid within one or more bags 206 when connector assembly 1602 is attached to alignment plate 214 and box 200.

Figure 22:
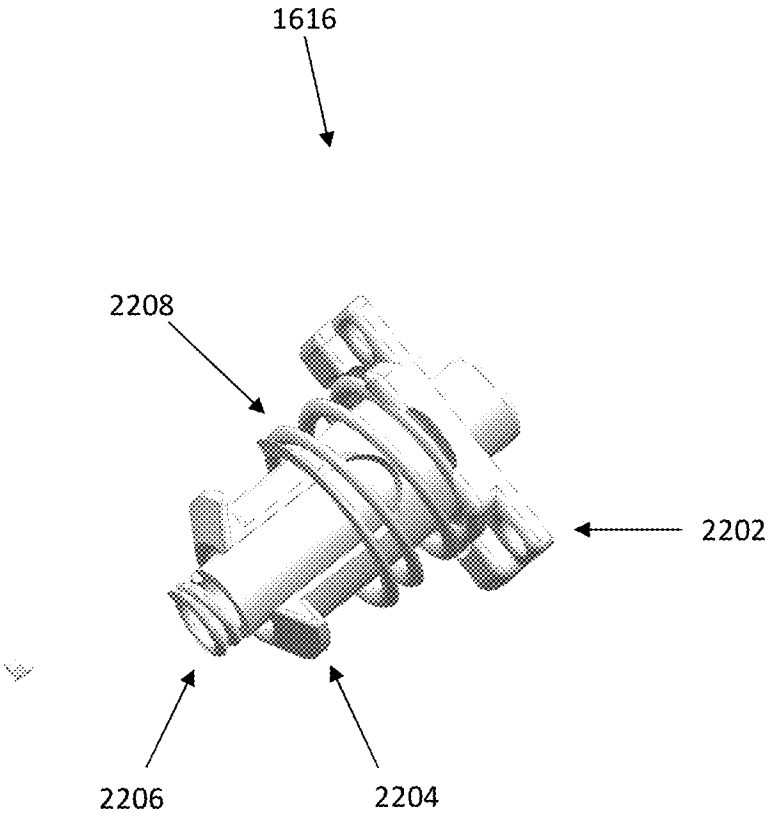
FIG. 22 is a perspective view of a spring member that may be used with the beverage dispensing system shown in FIG. 16.

Referring to FIG. 22, a perspective view of spring member 1616 is shown. In an exemplary embodiment, each spring member 1616 includes an upper flange 2202 and a lower flange 2204 that are substantially similar to upper flange 1302 and lower flange 1304 shown in FIG. 13. Spring members 1616 also include a first spring 2206 that is similar to spring 1306 shown in FIG. 13.

In an exemplary embodiment, spring members 1616 also include a second spring 2208 that is positioned between holding plate 1610 and actuator plate 1612 when connector assembly 1602 is assembled. Second spring 2208 contacts an upper surface of actuator plate 1612 (i.e., the surface facing holding plate 1610) and biases actuator plate 1612 away from holding plate 1610.

Figure 23:
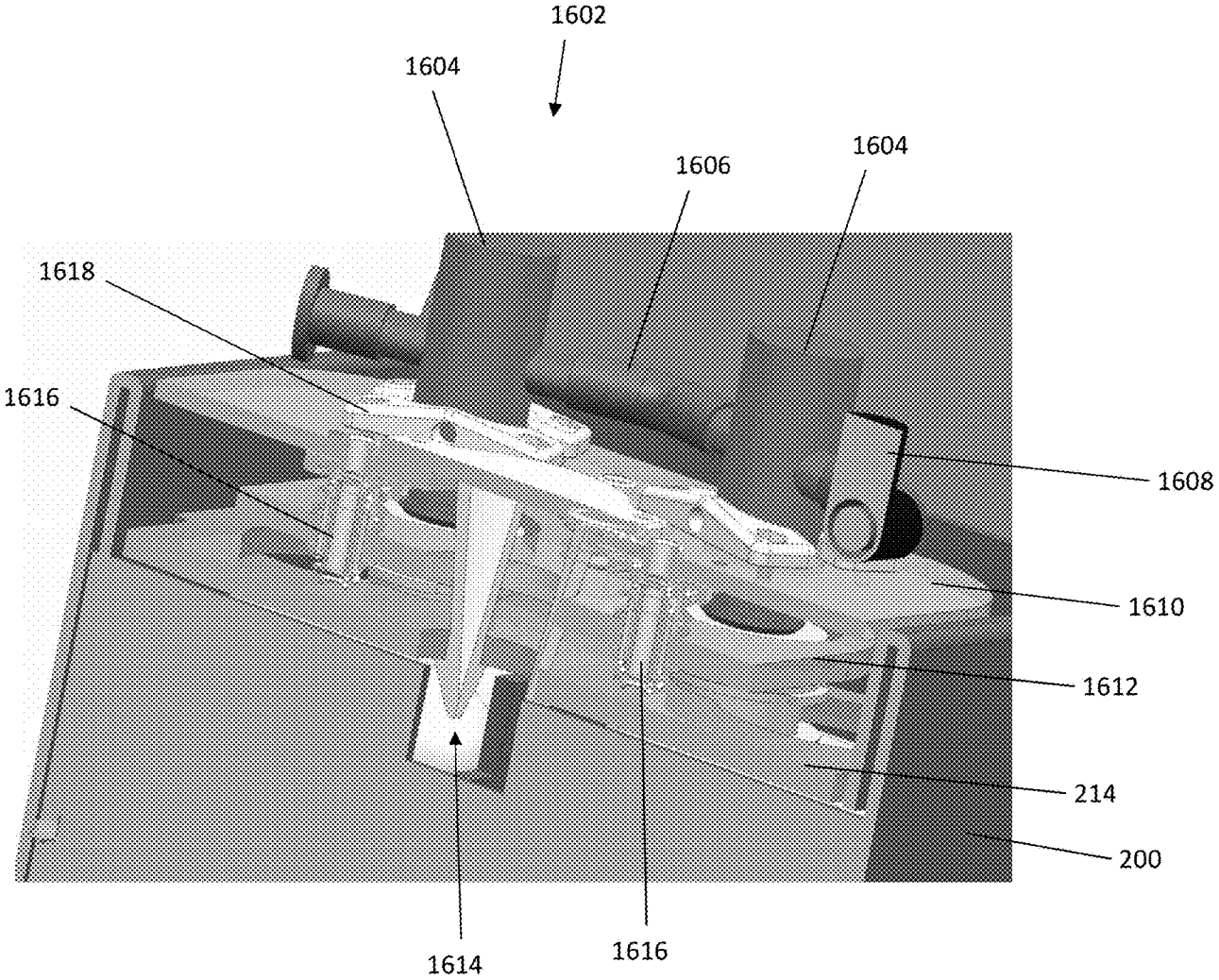
FIG. 23 is a perspective cut-away view of the connector assembly and box shown in FIG. 16 taken along line B-B.

Referring to FIG. 23, a perspective cut-away view of connector assembly 1602 and box 200 taken along line B-B is illustrated. FIG. 23 may be used to illustrate the operation of connector assembly 1602 when connecting to alignment plate 214 or when disconnecting from alignment plate 214.

As described above, box 200 is typically shipped or transported disconnected from connector assembly 1602 and a cap 212 covers each fitment 210 of each bag 206. Once the box 200 and connector assembly 1602 arrive at a destination for assembly, a user removes caps 212 from fitments 210.

In this embodiment, the user does not need to first pull actuator plate 1612 towards holding plate 1610 to prepare connector assembly 1602 for connection to box 200. Rather, the user just needs to align connectors 1604 with fitments 210, grasp holding plate 1610 and grip portions 302 of alignment plate 214, and then contract the user's hands together to push connector assembly 1602 into engagement with alignment plate 214.

As this happens, legs 2104 of locking member 1614 move through locking member opening 220 of alignment plate 214. First engagement ridge 2106 of locking member 1614 moves through locking member opening 220 of alignment plate 214 and latches to the underside of alignment plate 214 (i.e., the surface of alignment plate 214 facing away from connector assembly 1602).

At this point, connector assembly 1602 is securely attached to alignment plate 214 and fitments 210 by first engagement ridge 2106 of locking member 1614 and by the biasing force of spring members 1616. Furthermore, an uninterrupted fluid communication path is formed by the fact that bags 206, outlets 404, fitments 210, connectors 1604, intermediate dispensing line 706 (if provided), and main dispensing line 1606 are all positioned in flow communication with each other. The alcoholic beverage (or other contents) within each bag 206 may then be dispensed using a nozzle or other tool coupled to main dispensing line 1606.

If the user wants to disconnect box 200 from connector assembly 1602, the user grasps actuator plate 1612 and holding plate 1610, and squeezes the plates together to move actuator plate 1612 toward holding plate 1610. The diameter of locking member opening 1904 of actuator plate 1612 is smaller than the portion of each leg 2104 between first engagement ridge 2106 and head portion 2102. Thus, when actuator plate 1612 is moved toward holding plate 1610, legs 2104 are forced inward. As legs 2104 are forced inward, first engagement ridge 2106 disengages from alignment plate 214 such that alignment plate 214 is no longer held in place by locking member 1614. The biasing force of spring members 1616 against alignment plate 214 causes connector assembly 1602 to be pushed away from alignment plate 214, and connectors 1604 are automatically disengaged from outlets 404 and fitments 210.

Referring to FIG. 24, a perspective view of a third embodiment of a beverage dispensing system 2400 is illustrated. Beverage dispensing system 2400 includes a beverage dispensing package 200 (e.g., a box) and a connector assembly 2402 that is removably coupled to box 200.

In an exemplary embodiment, box 200 includes four bags positioned within four compartments created by two dividers. Alternatively, any suitable number of compartments, bags, and dividers may be used with box 200. As described above, box 200 includes an alignment plate 214 and fitments 210.

As illustrated in FIG. 24, connector assembly 2402 includes a handle assembly 2404 that covers a plurality of connectors (not shown). In one embodiment, connector assembly 2402 is substantially similar to connector assembly 702 (shown in FIG. 7) and is usable with the push-pull connectors described therein. Alternatively, connector assembly 2402 may be substantially similar to connector assembly 1602 (shown in FIG. 16) and may be used with the push connectors described therein.

Handle assembly 2404 includes a handle 2406 that enables a user to easily and securely grasp connector assembly 2402 to facilitate engaging or disengaging connector assembly 2402 and alignment plate 214. Handle assembly 2404 also includes a release lever 2408 that enables the user to release the locking member from alignment plate 214. In one embodiment, release lever 2408 causes the actuator plate to move towards the holding plate to release the locking member from alignment plate 214 when the user pulls release lever 2408 toward handle 2406. In other respects, connector assembly 2402 operates substantially similar to connector assembly 702 or connector assembly 1602.

Figure 25:
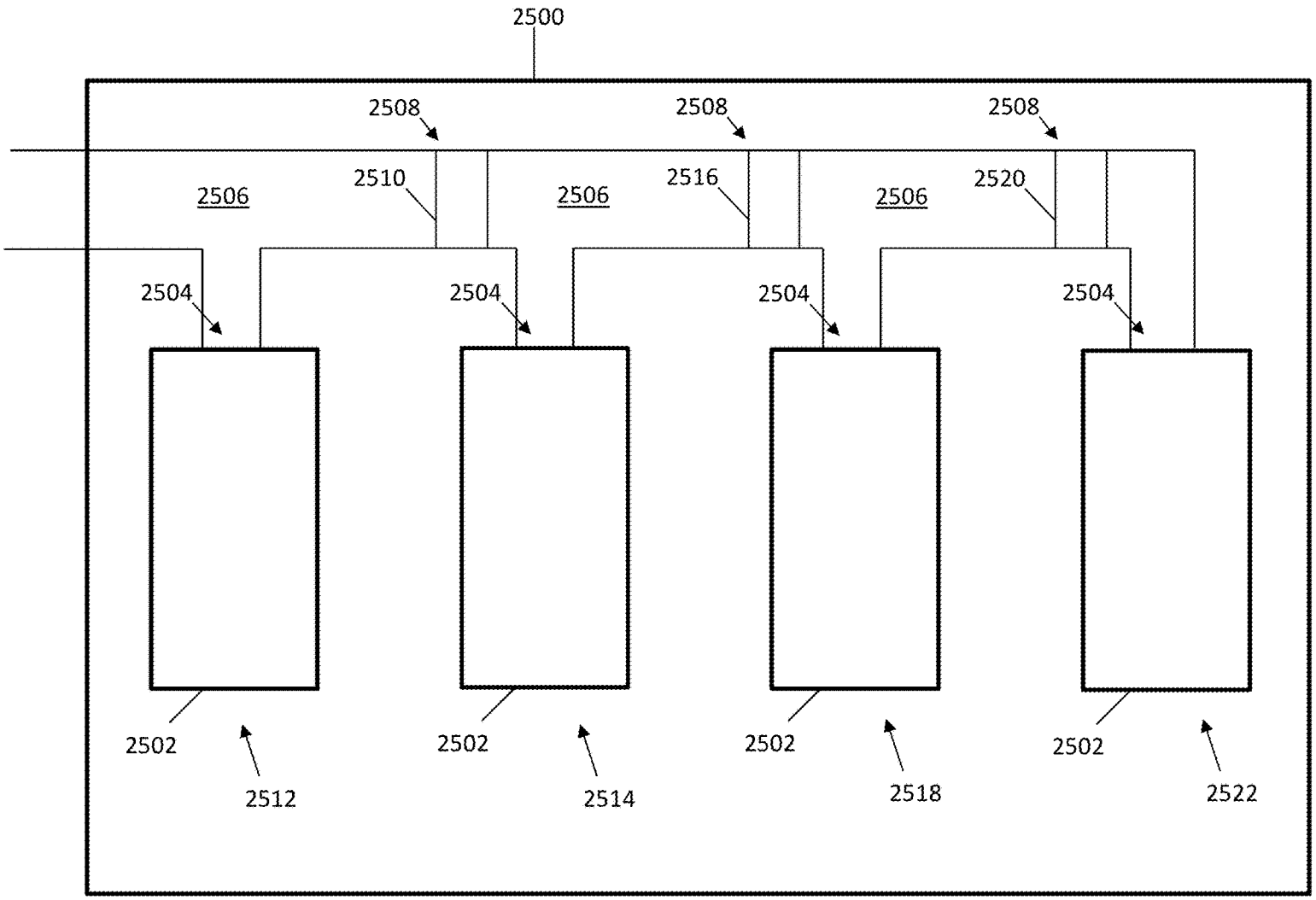
FIG. 25 is a block diagram of a beverage dispensing package having an alternative arrangement of containers.

FIG. 25 is a block diagram of a box 2500 having an alternative arrangement of bags 2502. In the example shown in FIG. 25, bags 2502 each include an outlet 2504 that is coupled to a common internal dispensing line 2506 within box 2500. Internal dispensing line 2506 extends to an exterior of box 2500 and is connectable to any suitable connector, connector assembly, or nozzle to dispense the contents of each bag 2502 through line 2506.

A plurality of membranes or pressure relief valves 2508 are positioned within internal dispensing line 2506. In an exemplary embodiment, each membrane 2508 is positioned between outlets 2504 of two adjacent bags 206 (i.e., an upstream bag and a downstream bag) to prevent the contents of the upstream bag from being dispensed until the downstream bag is fully dispensed. Accordingly, a first membrane 2510 is positioned within internal dispensing line 2506 between an outlet 2504 of a first bag 2512 and an outlet 2504 of a second bag 2514. A second membrane 2516 is positioned within internal dispensing line 2506 between outlet 2504 of second bag 2514 and an outlet 2504 of a third bag 2518. A third membrane 2520 is positioned within internal dispensing line 2506 between outlet 2504 of third bag 2518 and an outlet 2504 of a fourth bag 2522.

Each membrane 2508 is configured to break, open, or otherwise be released when a successively greater pressure is exerted as compared to a downstream membrane 2508. Accordingly, first membrane 2510 is configured to open when a first pressure is exerted on internal dispensing line 2506 (and thus on first membrane 2510), second membrane 2516 is configured to open when a second pressure is exerted on internal dispensing line 2506, and third membrane 2520 is configured to open when a third pressure is exerted on internal dispensing line 2506. In the exemplary embodiment, the first pressure is less than the second pressure, and the second pressure is less than the third pressure.

During operation, when a nozzle or other dispensing mechanism exerts pressure on internal dispensing line 2506, the contents of first bag 2512 are dispensed until first bag 2512 is empty. After first bag 2512 is empty, the pressure increases until it exceeds the first pressure, at which point first membrane 2510 opens. The contents of second bag 2514 now begin to be dispensed. When second bag 2514 is empty, the pressure increases until it exceeds the second pressure. Second membrane 2516 opens and the contents of third bag 2518 begin to be dispensed. When third bag 2518 is empty, the pressure increases until it exceeds the third pressure. Third membrane 2520 opens and the contents of fourth bag 2522 are dispensed. In such a manner, the contents of each bag may be dispensed successively.

Figure 26:
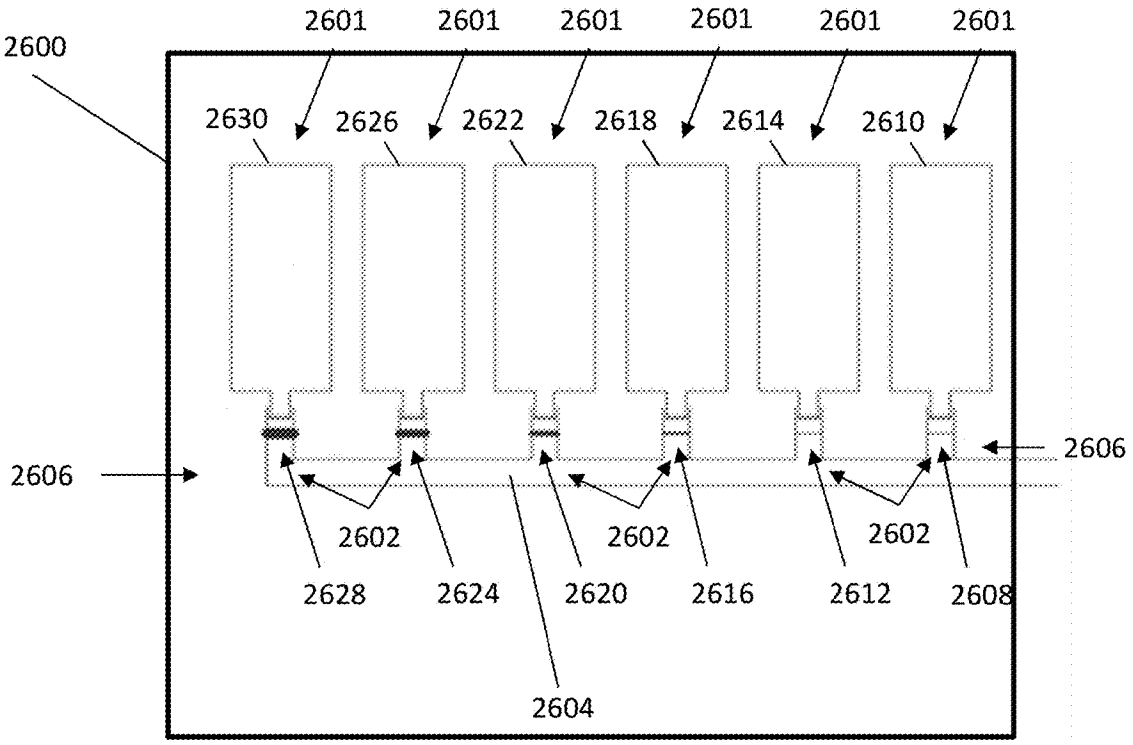
FIG. 26 is a block diagram of another beverage dispensing package having an alternative arrangement of containers.

FIG. 26 is a block diagram of a box 2600 having another alternative arrangement of bags 2601. In the example shown in FIG. 26, bags 2601 each include an outlet 2602 that is coupled to a common internal dispensing line 2604 within box 2600 in a similar manner as box 2500 (shown in FIG. 25). Internal dispensing line 2604 extends to an exterior of box 2600 and is connectable to any suitable connector, connector assembly, or nozzle to dispense the contents of each bag 2601 through line 2604.

A plurality of membranes or pressure relief valves 2606 are positioned within internal dispensing line 2604. In an exemplary embodiment, each membrane 2606 is positioned between an outlet 2602 of a respective bag 2601 and internal dispensing line 2604 to prevent the contents of bag 2601 from being dispensed until membrane 2606 is opened. Accordingly, a first membrane 2608 is positioned between outlet 2602 of a first bag 2610 and internal dispensing line 2604, and a second membrane 2612 is positioned between outlet 2602 of a second bag 2614 and internal dispensing line 2604. A third membrane 2616 is positioned between outlet 2602 of a third bag 2618 and internal dispensing line 2604, and a fourth membrane 2620 is positioned between outlet 2602 of a fourth bag 2622 and internal dispensing line 2604. In addition, in the example shown in FIG. 26, a fifth membrane 2624 is positioned between outlet 2602 of a fifth bag 2626 and internal dispensing line 2604, and a sixth membrane 2628 is positioned between outlet 2602 of a sixth bag 2630 and internal dispensing line 2604.

Each membrane 2606 is configured to break, open, or otherwise be released when a successively greater pressure is exerted as compared to a downstream membrane 2606. Accordingly, in the example shown in FIG. 26, each membrane 2606 has a different thickness or strength as compared to each other membrane. For example, first membrane 2608 has a first thickness, second membrane 2612 has a second thickness that is larger than the first thickness, third membrane 2616 has a third thickness that is larger than the second thickness, and fourth membrane 2620 has a fourth thickness that is larger than the third thickness. In addition, fifth membrane 2624 has a fifth thickness that is larger than the fourth thickness, and sixth membrane 2628 has a sixth thickness that is larger than the fifth thickness. Accordingly, a successively higher pressure is required to open each successive upstream membrane to empty the contents of the associated bag 2601 in a similar manner as described above with reference to FIG. 25.

In an alternative embodiment, the different pressures needed to open each membrane 2606 may be accomplished by using portions of internal dispensing line 2604 having a different diameter. For example, a membrane 2606 associated with each bag outlet 2602 may be positioned in a portion of internal dispensing line 2604 that has a different diameter (and thus a different pressure) than the portions of internal dispensing line 2604 associated with the other membranes 2606.

The arrangement of bags described in FIGS. 25 and 26 enables each bag to be connected to an internal dispensing line, but the contents of each bag are maintained in a separated state until the bags are dispensed. As a result, the box may be shipped with the outlets of the bags in a "divorced" state and the outlets may be efficiently and conveniently connected at a dispensing site.

Figure 27:
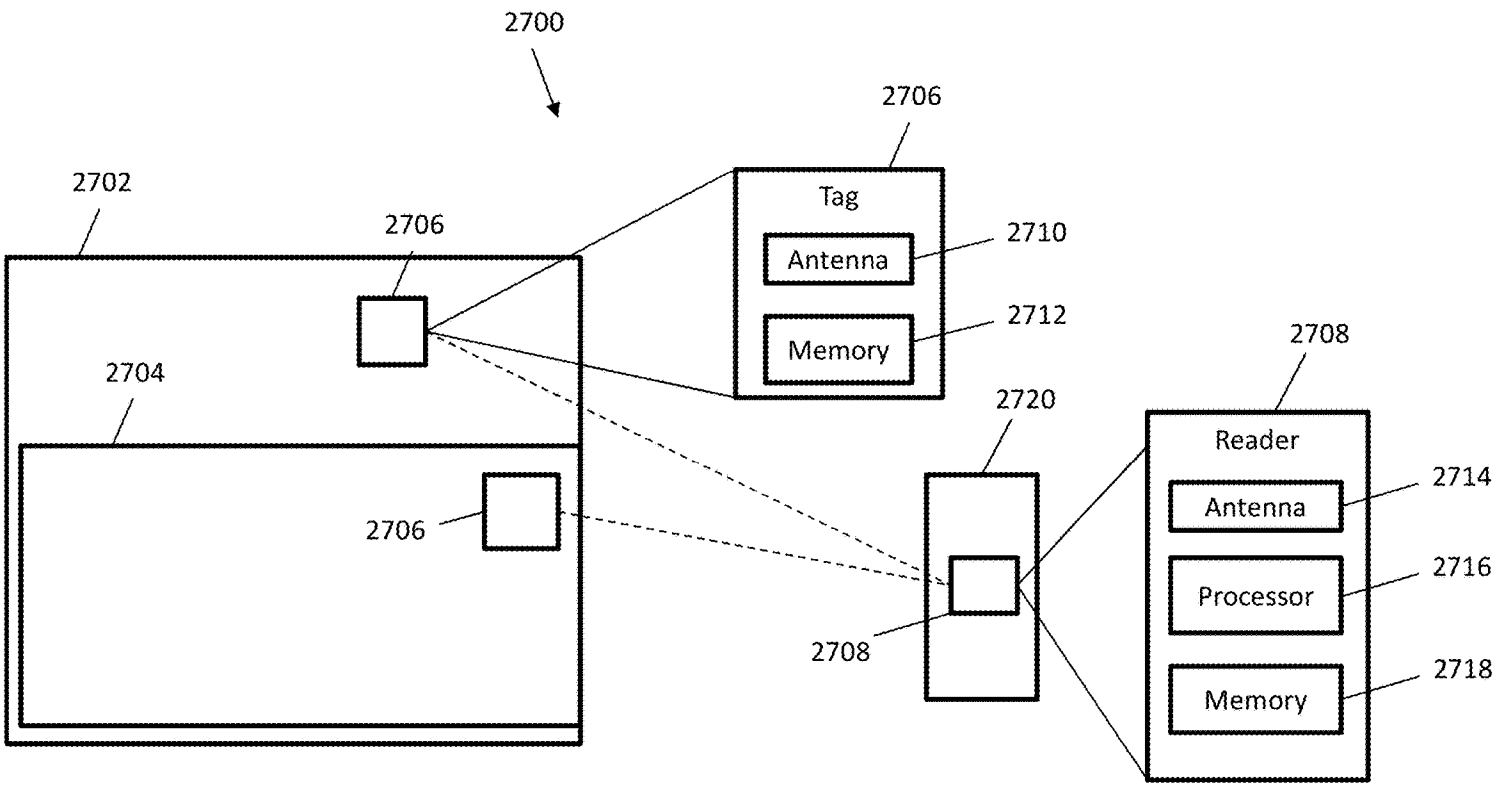
FIG. 27 is a block diagram of an exemplary system that may be used to monitor a beverage dispensing system.

FIG. 27 is a block diagram of an exemplary system 2700 that may be used to monitor a beverage dispensing system. System 2700 may be used with any of the beverage dispensing systems described herein.

In the example shown in FIG. 27, system 2700 includes a box 2702 that includes a plurality of bags 2704 similar to the boxes and bags described in the foregoing embodiments. A programmable tag 2706 is coupled to box 2702 and/or to bags 2704 in the exemplary embodiment. Tag 2706 may be used to determine the contents of box 2702 and/or bags 2704 as described more fully herein. In addition, a tag reader 2708 is provided that is able to read the contents of each tag 2706.

Tag 2706 may include an antenna 2710 and a memory 2712, such as a computer-readable memory. While tag 2706 is described herein as a radio frequency identification (RFID) tag 2706, it should be recognized that tag 2706 may be any suitable tag that is readable by an associated reader. For example, tag 2706 may be embodied as a quick response (QR) code, a bar code, a near field communication (NFC) tag, or any other suitable tag.

Antenna 2710 is configured to receive signals from tag reader 2708 and to provide data stored in memory 2712 in response to the signals received from tag reader 2708.

Memory 2712 stores data related to box 2702 or bag 2704 to which tag 2706 is attached. In an exemplary embodiment, memory 2712 is programmed to include profile data for box 2702 or bag 2704, such as the type of alcoholic beverage (or other liquid) stored in each bag 2704, the alcohol content, a brand name, an age, a production date, and/or a batch number of the alcoholic beverage stored in each bag 2704. Additionally or alternatively, the profile data may include a volume of bag 2704 and/or a volume of the alcoholic beverage stored in bag 2704, a unique identification number of the container (i.e., of bag 2704 or box 2702), a distributor of the alcoholic beverage, and/or any other suitable data. The profile data may be programmed or stored in memory 2712 during a filling process of bag 2704. Alternatively, the profile data may be included in pre-printed labels that may be attached to bags 2704 or boxes 2702 corresponding to the labels.

Still alternatively, a tag 2706 may be affixed to, or included within, bags 2704 and/or boxes 2702 before shipping or transport. Upon receipt of boxes 2702 and/or bags 2704 by the end user, tag reader 2708 scans each tag 2706 and assigns the profile of the contents corresponding to each bag 2704 or box 2702 to the unique identification number of the respective bag 2704 or box 2702.

While tag reader 2708 is described herein as an RFID reader, it should be recognized that tag reader 2708 may be any suitable reader that is designed and capable of reading tags 2706. In the exemplary embodiment, tag reader 2708 includes an antenna 2714, a processor 2716, and a memory 2718.

Antenna 2714 is configured to transmit signals to tags 2706 to request data from tags 2706. In addition, antenna 2714 is configured to receive the signals from tags 2706 in response to the data request.

Processor 2716 is configured to generate the signals to antenna 2714 and to receive the signals from antenna 2714. In addition, processor 2716 may be configured to read data from memory 2718 and to store data in memory 2718.

Memory 2718 is configured to store the data received from tags 2706 when tags 2706 are "read" (i.e., when signals requesting data from tags 2706 are transmitted to tags 2706 and when the data responsive to the requests are received).

In one embodiment, tag reader 2708 is integrated into a connector assembly 2720 to enable connector assembly 2720 to read the profile data from tags 2706 associated with bags 2704 attached to connector assembly 2720. For example, tag reader 2708 may be integrated into each connector, into the holding plate, into the actuator plate, and/or into any suitable portion of connector assembly 2720. Alternatively, tag reader 2708 may be integrated into a stand-alone device, such as a handheld computing device or any other suitable device.

When bags 2704 and boxes 2702 have tags 2706 included therein or affixed thereto, significant operational efficiencies can be gained. A tag reader mounted in close proximity to a container (e.g., a bag 2704 or box 2702) may read the unique identification number of the container.

In one embodiment, tag reader 2708 may store data representative of the profiles (or profile data) associated with bags 2704 that are intended to be used with the beverage dispensing system. If processor 2716 determines that the profile data of a bag 2704 connected to connector assembly 2720, for example, does not match the expected profile data for the beverage dispensing system, processor 2716 may notify a user that bag 2704 does not include the expected profile data.

In another embodiment, tag reader 2708, or another suitable device or system, may calculate the amount of liquids dispensed from each bag 2704 or box 2702. The amount of liquid dispensed can be compared to the amount of liquid expected to be inside bag 2704 or box 2702 based on the profile data of bag 2704 or box 2702. As a result, tag reader 2708 or another suitable device may determine when bag 2704 or box 2702 is empty, or has dispensed a predetermined amount or percentage of its contents. A user may then be notified which bag 2704 or box 2702 needs to be replaced.

When bag 2704 or box 2702 is replaced, tag reader 2708 may read the profile data of the replacement bag 2704 or box 2702 and determine that the unique identification number is different than the replaced bag 2704 or box 2702, for example. Accordingly, tag reader 2708 or another device or system may determine that a replacement bag or box has been provided, and may reset or begin to recalculate the amount of liquid dispensed by the new bag or box.

Tag reader 2708 or another device may also verify that the same type of alcoholic beverage is included in the replacement bag or box as compared to the replaced bag or box. If the type of beverage is different, the beverage dispensing system may be prevented from dispensing the contents of the replacement bag or box unless a user explicitly approves the dispensing, for example.

Tag reader 2708 or another device or component of the beverage dispensing system can store the profile data of each tag 2706 of each bag 2704 or box 2702 and may, for example, store the amount of liquid dispensed by each container. In case a previously used container is put back in the beverage dispensing system, tag reader 2708 is able to determine whether that container is empty or not. If the container is not empty, the system will continue to keep track of the amount of liquid dispensed by that specific container until the system determines that the container is empty. If the container is determined to be empty, tag reader 2708 or another device or component of beverage dispensing system may notify a user and the container will need to be replaced before normal operations can continue. In one embodiment, an acceptable empty tolerance level (or waste level) can be pre-set by the user of tag reader 2708 or the beverage dispensing system, thereby allowing containers to be exchanged before they are completely empty.

Tag reader 2708 or another device or component of the beverage dispensing system can alert the user about the status of the tagged containers through a light or audible signal, for example, or in any other suitable manner. The status that the user may be notified of may include, for example, that a container needs to be replaced, a container is close to being replaced (falls within the waste tolerance zone), or that a container is still able to dispense its contents. The status can also indicate that the contents of the container have not been assigned to a particular box 2702 or to a particular location within the beverage dispensing system, for example. This may help prevent cross-contamination of materials by the beverage dispensing system.

In the embodiments described herein, the connectors of each connector assembly are separate connectors that are connected together by one or more dispensing lines. In an alternative embodiment, the connectors of a connector assembly may be unitarily formed within a single common package. For example, a single connector package may include a plurality of holes, receptacles, or other connectors for receiving or connecting to the fitments of the bags. Alternatively, the fitments of the bags within a box may be connected to individual dispensing lines that are then connected to individual holes, receptacles, or other connectors within the unitarily formed connector package. The unitarily formed package may then dispense the alcoholic beverage received from the bags through a common or main outlet. Still alternatively, the unitarily formed connector package may be included within a nozzle such that the dispensing lines or the fitments of the bags may be connected directly to connectors formed within a single nozzle or the like.

With reference FIGS. 29-59, a connector assembly 3000 for use with a system for dispensing liquids or beverages according to an alternative embodiment is shown. In general, the connector assembly 3000 is used with a plurality of beverage dispensing containers 206, e.g., bags, which are housed within a beverage dispensing package or box 104, 200. In the illustrated embodiment below, the box 104, 200 contains 5 bags 206 aligned linearly in a row. However, it should be noted that the box 104, 200 could contain any number of bags 206. The bags could be arranged in any suitable manner, including, a plurality of rows and columns.

Figure 42:
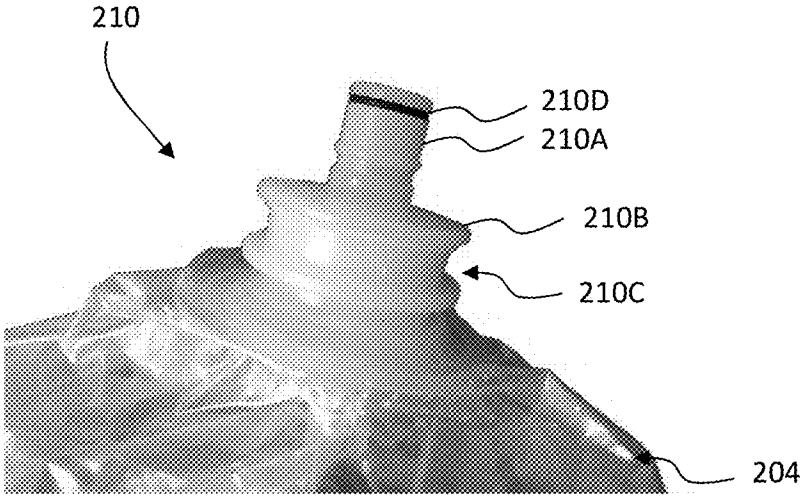
FIG. 42 is a picture of an exemplary fitment.
Figure 43:
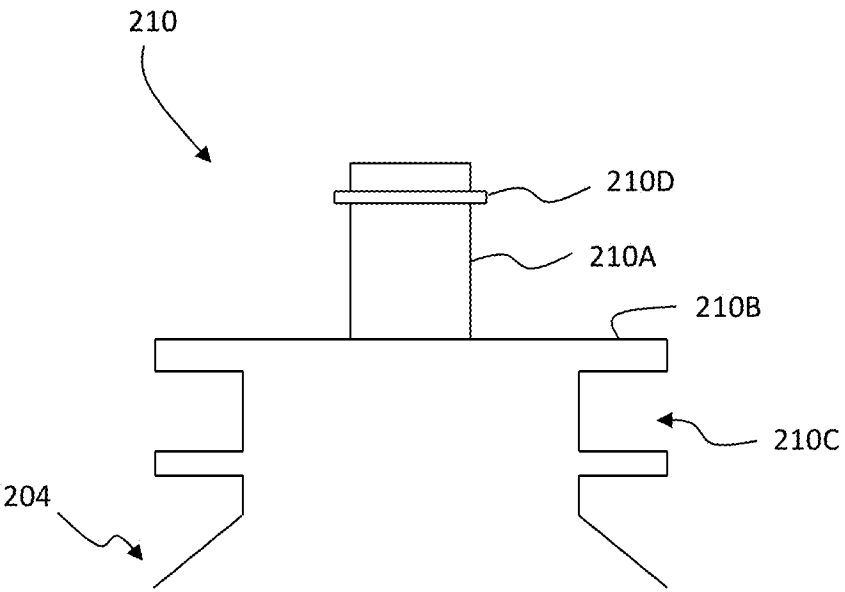
FIG. 43 is an illustration of an exemplary fitment.

As discussed above, each container or bag 206 may contain a liquid, e.g., a beverage or alcoholic beverage. Each container 206 has fitment 210. As shown in FIGS. 42 and 43, each fitment 210 includes a fitment nozzle 210A and a fitment base 210B. The fitment nozzle 210A includes a groove (not shown) configured to receive an o-ring 210D. The fitment base 210B includes a retaining groove or channel 210C. In one embodiment, the fitment 210 is composed from plastic, e.g., a thermoplastic and is sealed to the bag 206 via a heat-sealing process. As discussed below, the fitment 210 may include a valve (not shown) located in an inner bore (not shown) that is movable between open and closed positions. In the open position, the valve allows liquid to flow from the bag 206 through the fitment 210. In the closed position, the valve does not allow liquid to flow through the fitment 210. The containers or bags 206 are housed in the box 104, 200 with the fitments 210 arranged in predetermined relative locations, i.e., a predetermined pattern. In general, the retaining groove or channel 210C of the fitments 210 are configured to releasably connect the containers 206 to the connector assembly 3000 (see below).

Figure 28:
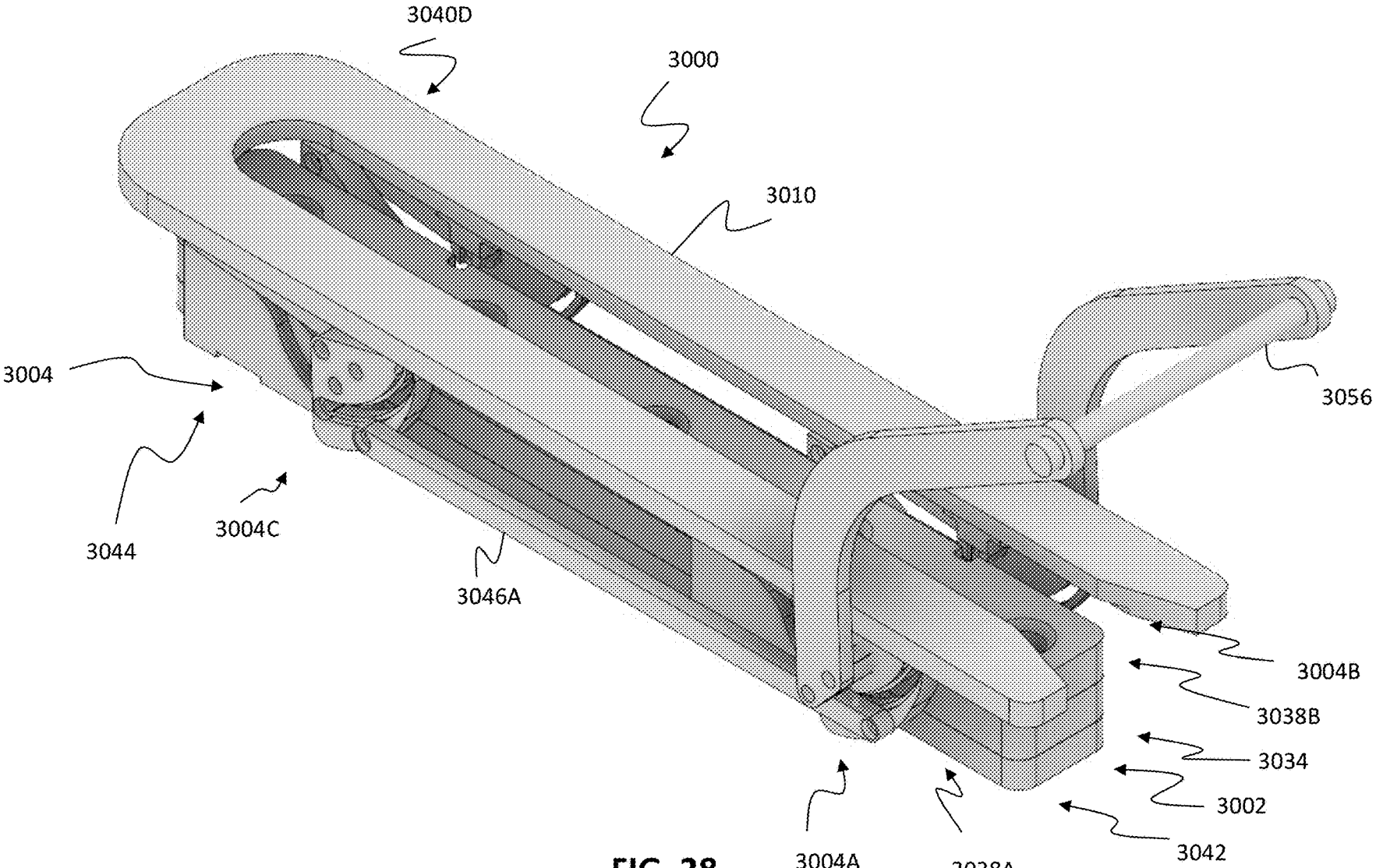
FIG. 28 is a perspective view of a connector assembly, for use in a beverage deliver system, according to another embodiment of the present invention.

With specific reference to FIG. 28, in one embodiment, the connector assembly 3000 includes a valve assembly 3002 and an actuator 3004. As discussed in more detail below, in use, the connector assembly 3000 is positioned in a predetermined location relative to the box 104, 200 such that the valve assembly 3002 is aligned with the fitments 210. Once the valve assembly 3002 and the fitments 210 are aligned, the actuator 3004 may be activated to cause the fitments 210 to be simultaneously engaged with the valve assembly 3002.

Figure 31:
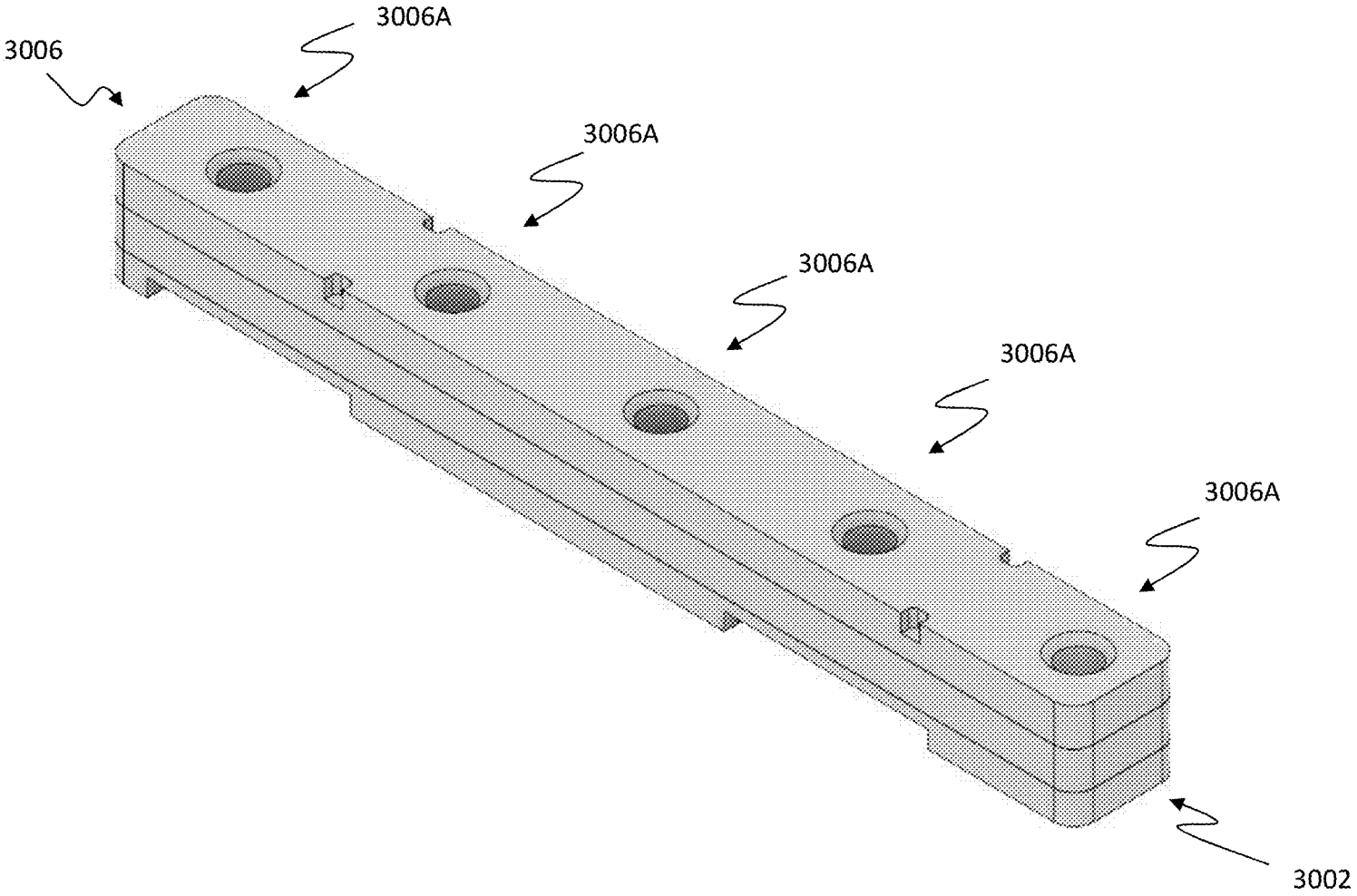
FIG. 31 is a perspective view of a valve assembly of the connector assembly of FIG. 28, according to an embodiment of the present invention.

With specific reference to FIGS. 28, 31-35, and 52-59 the valve assembly 3002 is movable between an unengaged position and an engaged position. As shown in FIG. 31, the valve assembly 3002 includes a plurality of fitment receptacles 3006. Each fitment receptacle 3006 is associated with a respective fitment 210. In the illustrated embodiment the box 104, 200 contains five bags 206, each with a respective fitment 210. Thus, the valve assembly 3002 includes five fitment receptacles 3006A, 3006B, 3006C, 3006D, 3006E. The plurality of fitment receptacles 3006 are arranged in a pattern coinciding with the predetermined relative locations of the fitments 210. As discussed more fully below, the valve assembly 3002 has an internal liquid flow channel 3008 (see FIG. 34) and an outlet 512. The liquid flow channel 3008 couples the fitment receptacles 3006 to the outlet 512.

With specific reference to FIGS. 28 and 36-40, the actuator 3004 is coupled to the valve assembly 3002 and is movable between an unlocked position and a locked position. As discussed in more detail below, the valve assembly 3002 is configured to move from the unengaged position to the engaged movement in response to movement of the actuator 3004 from the unlocked to locked positions. In response to movement of the valve assembly 3002 from the unengaged position to the engaged position, the fitments 210 are inserted into the respective fitment receptacles 3008.

Figure 29:
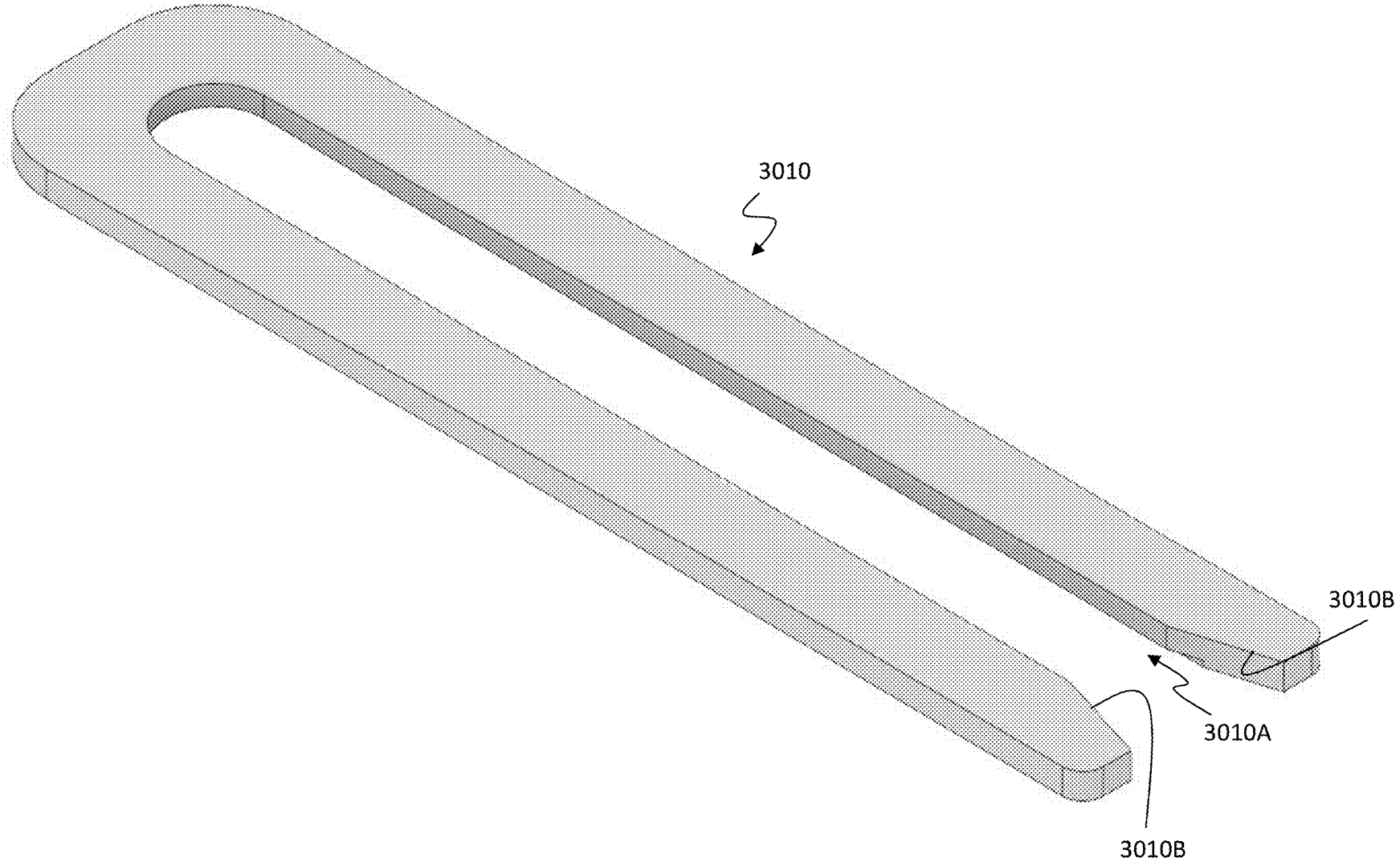
FIG. 29 is a perspective view of a guiderail of the connector assembly of FIG. 28, according to an embodiment of the present invention.
Figure 30:
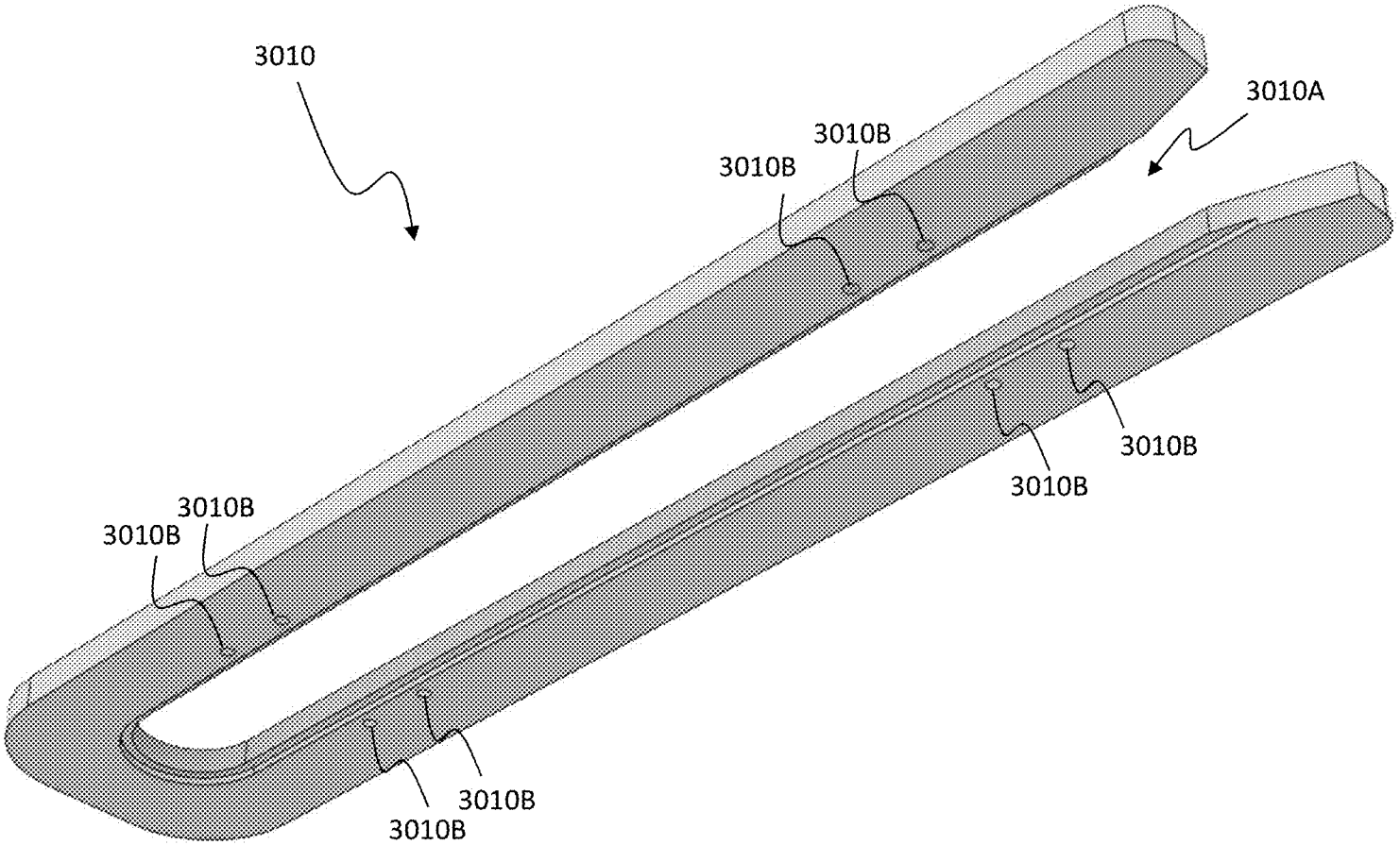
FIG. 30 is a second perspective view of the guiderail of FIG. 29, according to an embodiment of the present invention.

With reference to FIGS. 28-30, the connector assembly 3000 may include an (optional) guiderail 3010. In the illustrated embodiment, the guiderail 3010 is fixedly coupled to the actuator 3004 and the valve assembly 3002 is rotatably coupled to the guiderail 3010 via the actuator 3004. In the illustrated embodiment, actuation of the actuator 3004 moves the valve assembly 3002 relative to the guiderail 3010. In use, the guiderail 3010 may be used to move, and support, the connector assembly 3000 relative to the box 104, 200. Once the connector assembly 3000 is engaged with the fitments 210, the guiderail 3010 supports the fitments 210.

In an alternative embodiment, the guiderail 3010 may be removed and support for the connector assembly 3000 may be provided by the valve assembly 2002 and the package or box 104, 200. In general, the package or box 104, 200 may be made from cardboard, sturdy plastic or other such material or a combination of cardboard and a separate part that provides the needed sturdiness. If the package or box 104, 200 is sturdy or partially the sturdy, it may be referred to as a "sturdy box". The rigidity will be applicable to align the fitments 210 and allow the connector assembly 3000 (with or without a guiderail 3010) to be pushed onto the package or box 104, 200 without collapsing and ensuring that the fitments 210 retainer proper position or alignment.

In still other embodiments, an actuator is not necessary. Either the valve assembly 3002 or the beverage dispensing package or box 104 may be static. For example, in one embodiment the valve assembly 3002 is static. As discussed above, the fitments 210 and the fitment receptacles 3006 are positioned in predetermined relative positions such that each fitment 210 is aligned with a respective fitment receptacle 3006. In order to connect the connector assembly 3000 to the fitments 210, the box 104 (or the valve assembly 3002 and connector assembly 3000) may be positioned such that the fitments 210 and the fitment receptacles 3006 are aligned and the box 104 (or the valve assembly 3002 and connector assembly 3000) may be pushed or moved towards the valve assembly 3002 (or the box 104) such that the fitments 210 are received into the fitment receptacles. For example, the valve assembly 3002 may be fixed in a static location within, e.g., the housing 104 of a beverage dispensing system 100 (see above). A set of mechanical guides or rails (not shown) may be mounted within the housing 104 to mechanically align the fitments 210 of the box 104 as the box 104 is inserted into the housing. In use, the box 104 and the fitments 210 may be pushed manually or mechanically into the respective fitment receptacles 3006 of the valve assembly 3002. Once the containers or bags 206 are empty, the box 104 may be removed from the valve assembly by manually or mechanically assisted moving the container away from the valve assembly.

As shown in FIGS. 29-30, the guiderail 3010 has an inner track 3010A. In one embodiment, the inner track 3010A is generally u-shaped. In use, the guiderail 3010 is configured to be positioned relative to the containers 104, 200 such that the inner track 3010A engages the channel 210C of each fitment 210. The guiderail 3010 is coupled to the valve assembly 3002. As shown in FIGS. 29 and 30, the inner track 3010 may be angled at entry points 3010B to allow for easy entry of the fitments 210 into the inner track 3010. In general, the inner track 3010 has a small height than the other portion of the guiderail 3010 and is sized to fit within the groove 210C of the fitment 210. As shown, in the illustrated embodiment the inner track 3010A ends in a semi-circle that matches the shape of the groove 210C of the fitments 210. The box 104, 200 is fully inserted when the first bag or container 206 in the box 104, 200 reaches the end of the inner track 3010A.

In one embodiment, the guiderail 3010 may be removably coupled to the valve assembly 3002. In this embodiment, the guiderail may be fixed, e.g., integral with, the box 104, 200. The valve assembly 3002 may be releasably fastened to the guiderail 3010.

Figure 35:
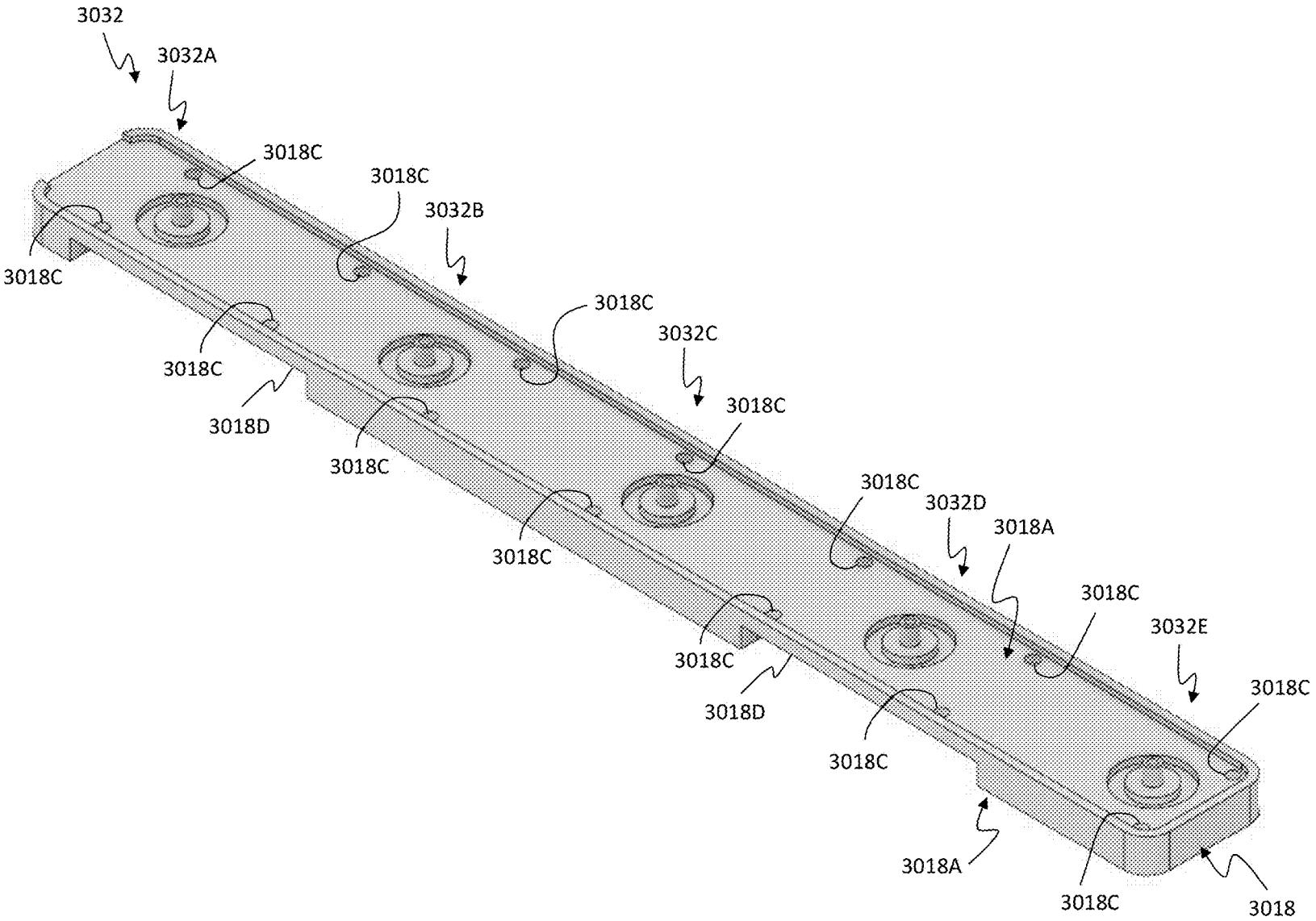
FIG. 35 is a perspective view of a valve cover of the valve assembly of FIG. 31, according to an embodiment of the present invention.

With reference to FIG. 35, the valve assembly 3002 includes a valve pusher 3034 located at a bottom of each fitment receptacle 3006. As discussed above, each fitment 210 includes a fitment valve (not shown). The respective valve pusher 3012 is configured to be received within a respective fitment 210 as the fitments 210 are inserted into the fitment receptacles 3006 thereby opening the respect fitment valve and allowing liquid to flow from the containers 206. In the illustrated embodiment, since there are five containers 206 and five fitment receptacles, there are five valve pushers 3032A, 3032B, 3032C, 3032D, 3032E.

Figure 32:
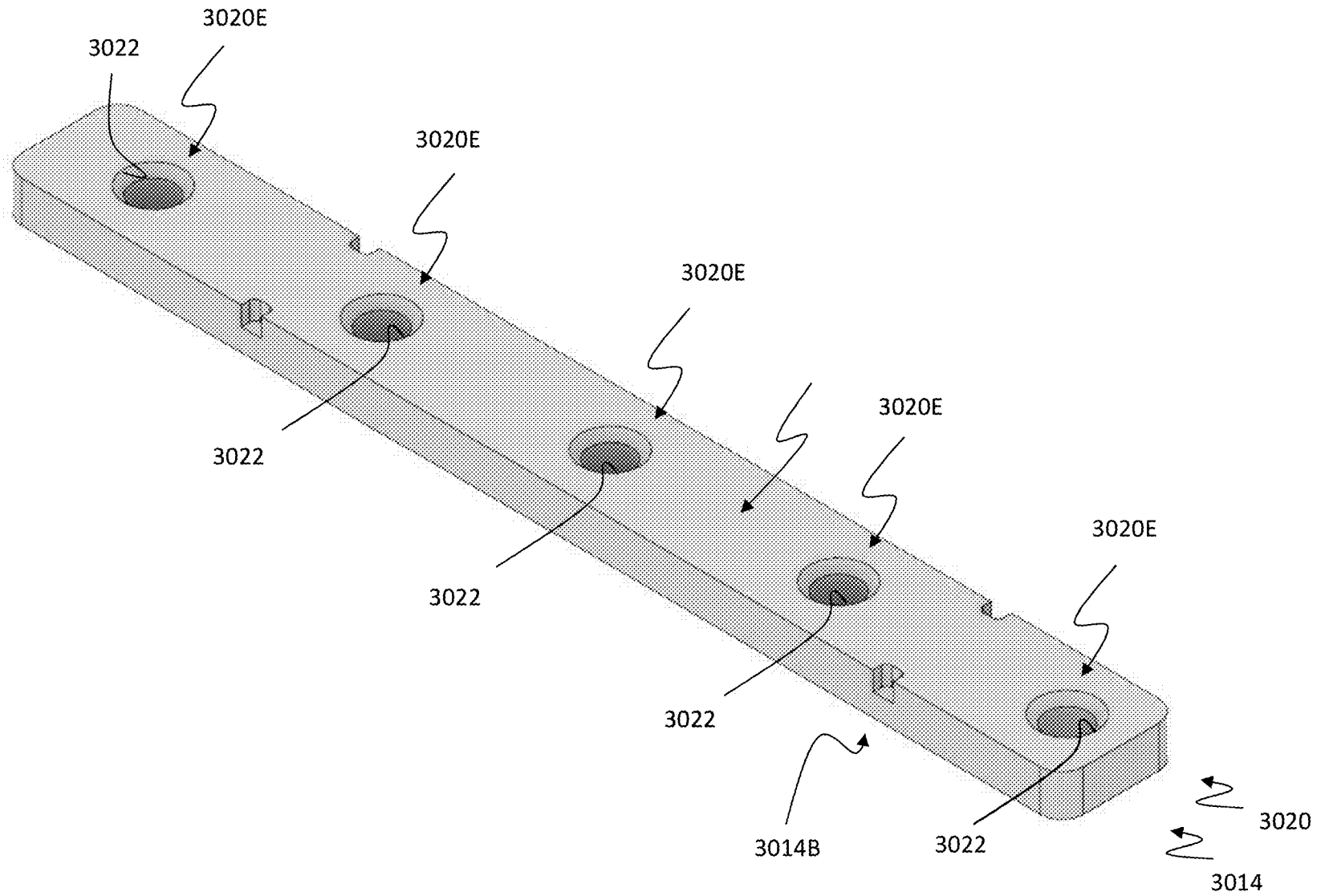
FIG. 32 is a perspective view of a valve intake of the valve assembly of FIG. 31, according to an embodiment of the present invention/

As shown in FIGS. 31-32, each fitment receptacle 3006 has a chamfered outer edge 3022 to assist with the insertion of the respective fitment 210 therein. In use the fitments 210 are received in a respective fitment receptacle 3006. The o-ring 210D of the respective fitment 210 fits against the chamfered outer edge 3022 forming a seal. As discussed in more detail, the valve assembly 3002 includes an interior passage that connects each fitment receptacle 3006 and the outlet 512.

With reference to FIGS. 31-35, in the illustrated embodiment the valve assembly 3002 includes a valve intake 3014, a valve body 3016, and a valve cover 3018. The valve intake 3014, valve body 3016 and valve cover 308 may be fitted together and held together by fasteners, such as screws, to form the valve assembly 3002. In an alternative embodiment, the valve assembly 3002 may be integrally formed or molded.

Figure 33:
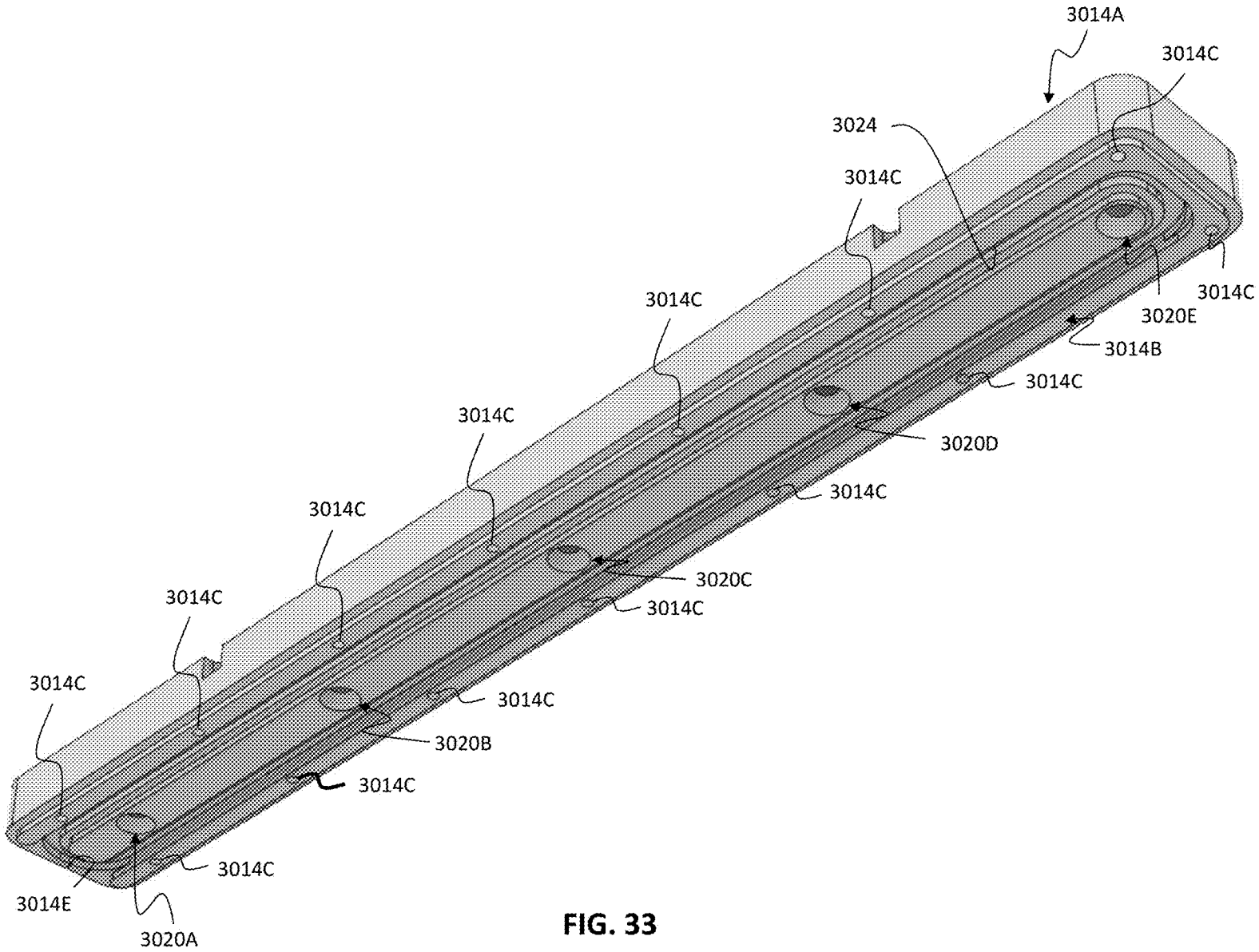
FIG. 33 is a second perspective view of the valve intake of FIG. 32, according to an embodiment of the present invention.

With reference FIGS. 32-33, the valve intake 3012 has a first surface 3012A and a second surface 3012B. The valve intake including a plurality of outer fitment receiving apertures 3020. Each outer fitment receiving aperture 3020 has a chamfered outer edge 3022 located on the first surface 3014A of the valve intake 3014 and extending through the valve intake 3014 to the second surface 3014B of the valve intake 3014. The second surface 3014B of the valve intake 3014 has a gasket channel 3022 for receiving a gasket (not shown).

Figure 34:
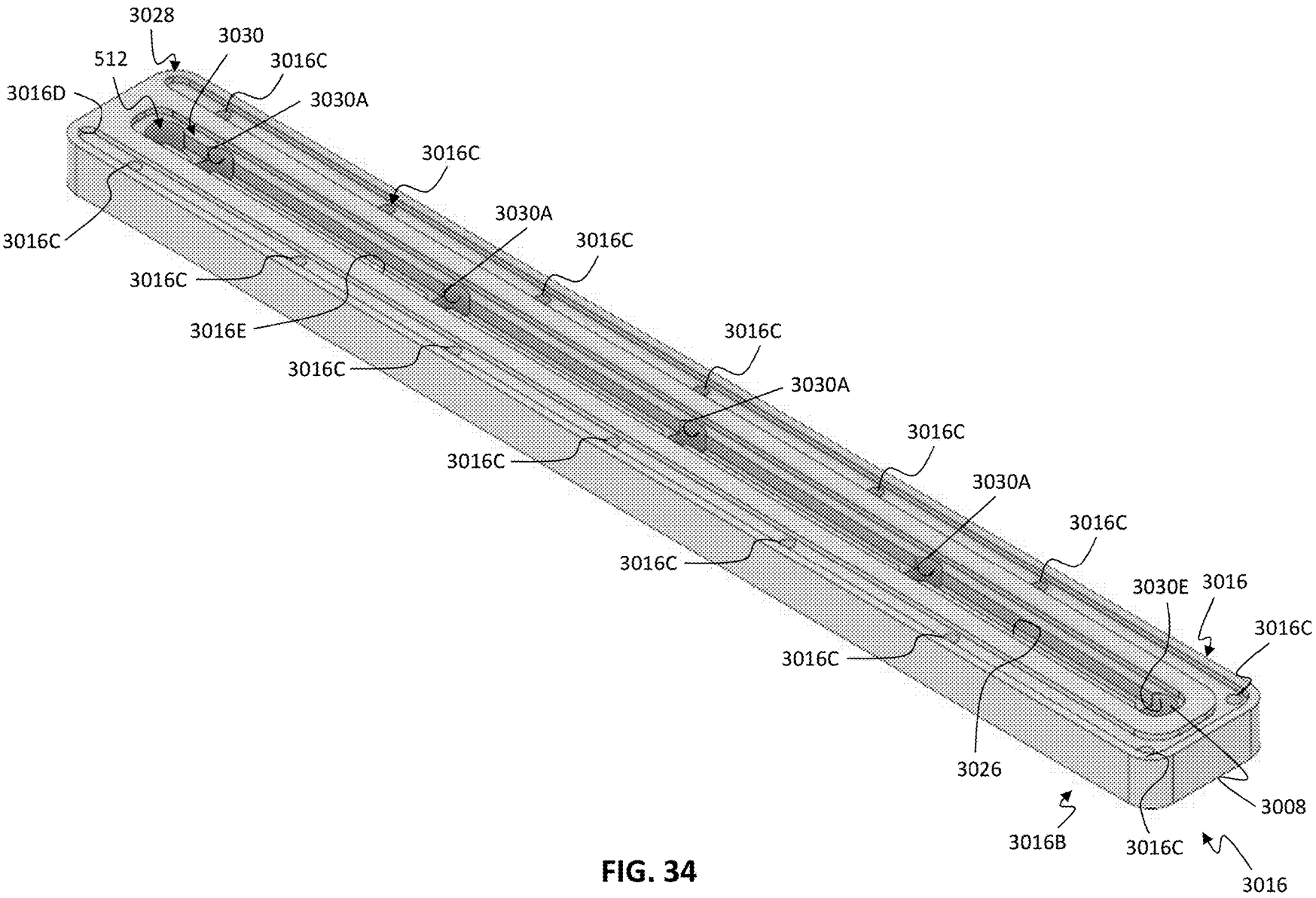
FIG. 34 is a perspective view of a valve body of the valve assembly of FIG. 31, according to an embodiment of the present invention.

With reference to FIG. 34, the valve body 3016 has a first surface 3016A and a second surface 3016. The first surface 3016A of the valve body 3016 is adjacent the second surface 3016B of the valve intake 3016 (when assembled) and includes a liquid chamber 3026 and an outlet aperture 3028. The valve body 3016 also includes a plurality of inner fitment receiving apertures 3030. The inner fitment receiving apertures 3030A, 3030B, 3030C, 3030D, 3030E are aligned with respective outer fitment receiving apertures 3020A, 3020B, 3020C, 3020D, 3020E. The liquid chamber 3026 connects the inner fitment receiving apertures 3030 and the outlet aperture 3028. The liquid chamber 3026, the second surface 3016B of the valve intake 3014, and the outlet aperture 3028 form the internal liquid flow channel 3008. In general, the valve body 3016 collects liquid from the containers or bags 206 in the internal liquid flow channel 3008 and allows the liquid (from all of the containers or bags 206) to flow out the outlet aperture 3028.

With reference to FIG. 35, the valve cover 3012 includes a first surface 3018A adjacent the second surface 3016B of the valve body 3016. The valve cover 3018 includes the plurality of valve pushers 3032 which extend from the first surface 3018A of the valve cover 3018. The valve pushers 3032A, 3032B, 3032C, 3032D, 3032E are aligned with respective outer receiving apertures 3020A, 3020B, 3020C, 3020D, 3020E and inner fitment receiving apertures 3030A, 3030B, 3030C, 3030D, 3030E forming the fitment receptacles 3006A, 3006B, 3006C, 3006D, 3006E. As discussed above, each fitment includes a valve (see below) moveable from a closed position to an open position. The valve pushers 3032 are inserted into a respective fitment 210 thereby opening the respective valve to the open position in response to movement of the valve assembly 3002 from the unengaged position to the engaged position. A plurality of cutouts 3018D provide a mounting location for the actuator 3004.

Figure 44:
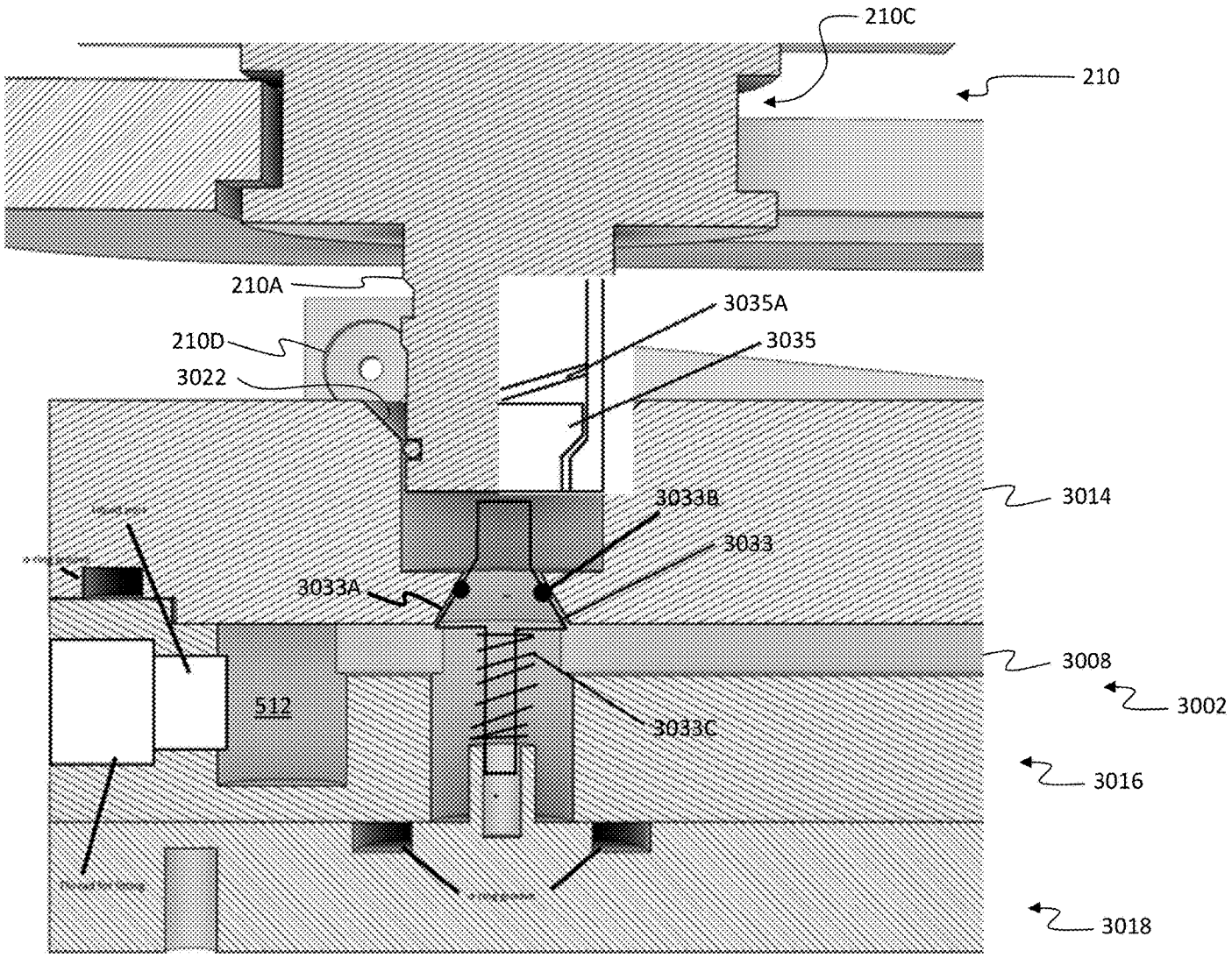
FIG. 44 is a cutaway view of the connector assembly of FIG. 28.
Figure 45:
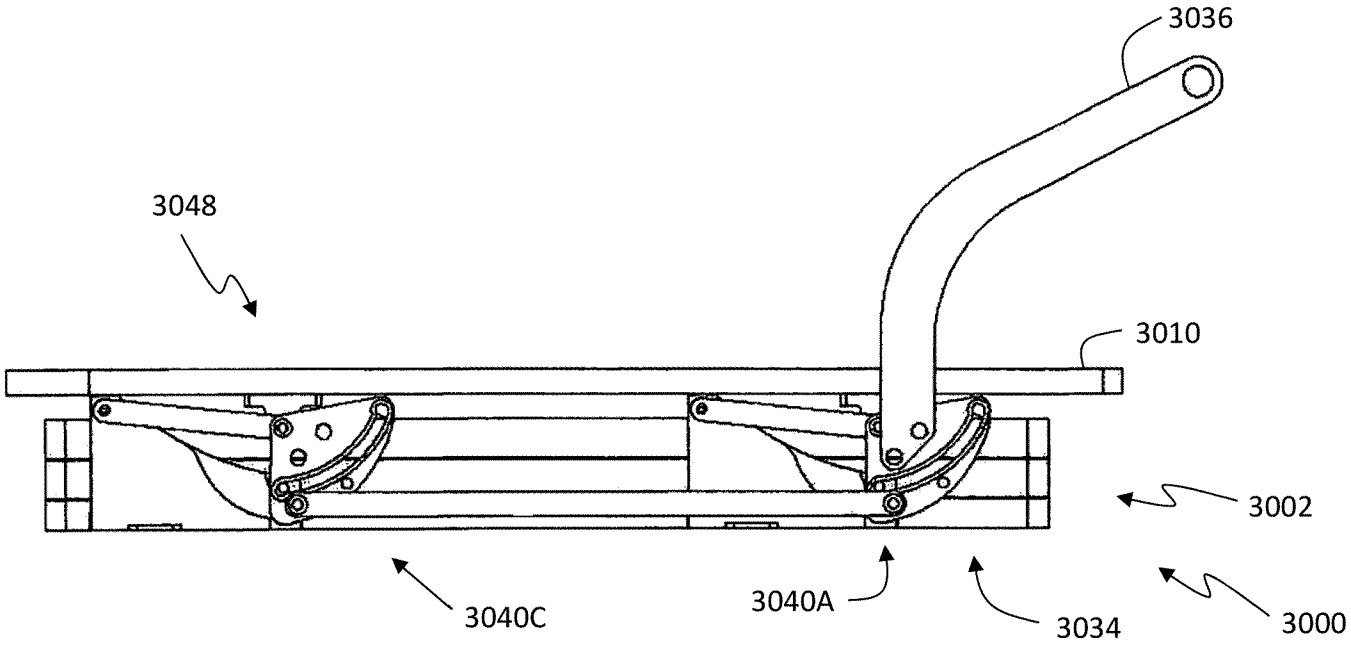
FIG. 45 is a side view of the connector assembly of FIG. 28.
Figure 46:
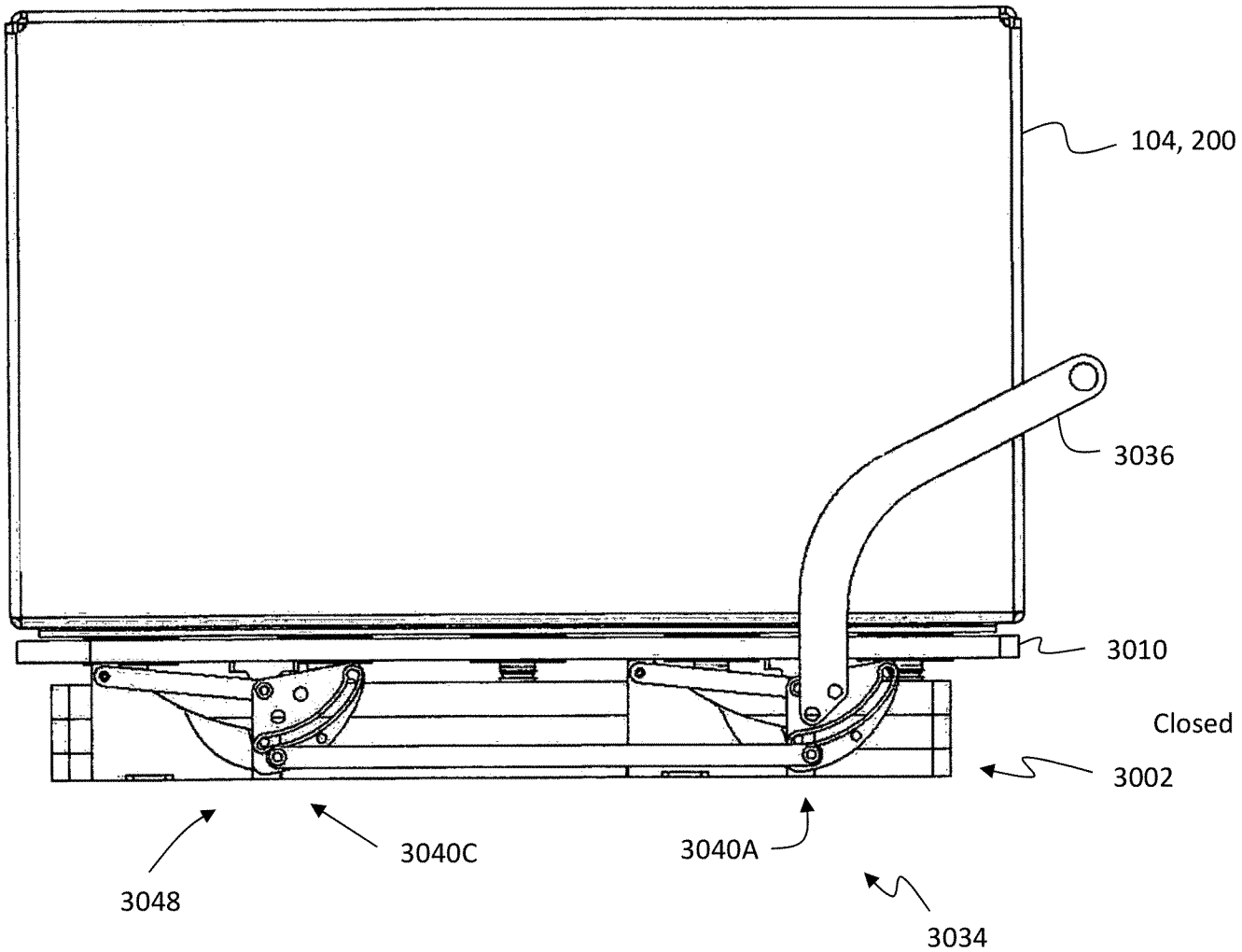
FIG. 46 is a side view of the connector assembly of FIG. 28 with a box installed.
Figure 48:
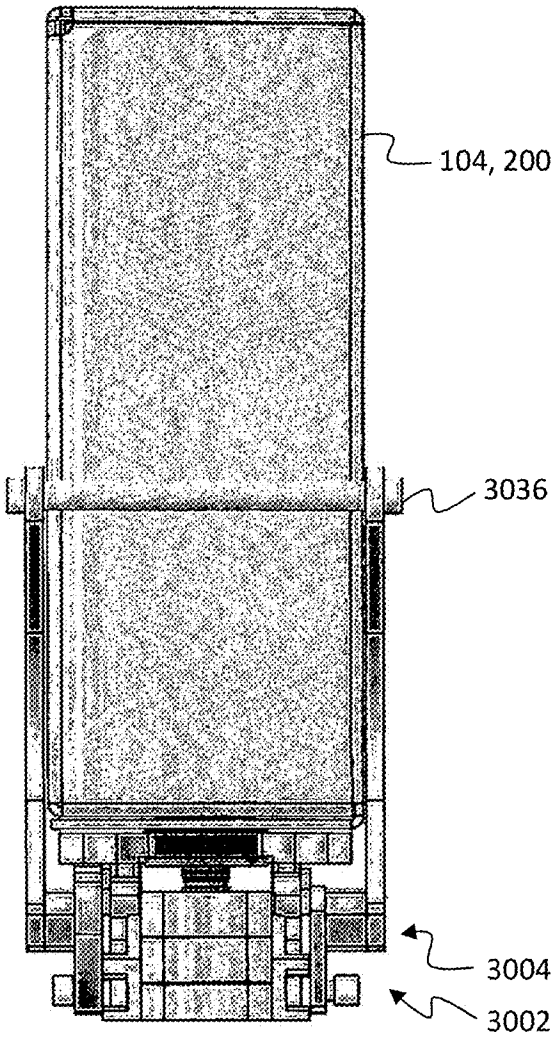
FIG. 48 is a front view of the connector assembly of FIG. 29 with a box installed.
Figure 47:
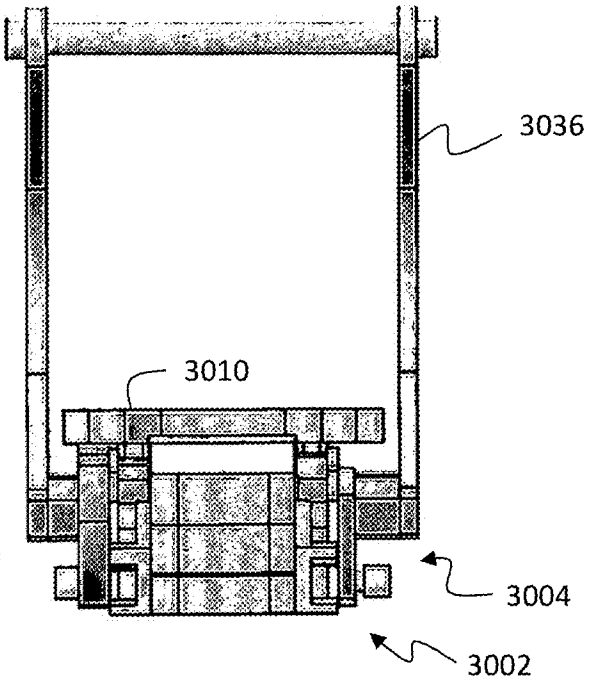
FIG. 47 is a front view of the connector assembly of FIG. 29.
Figure 49:
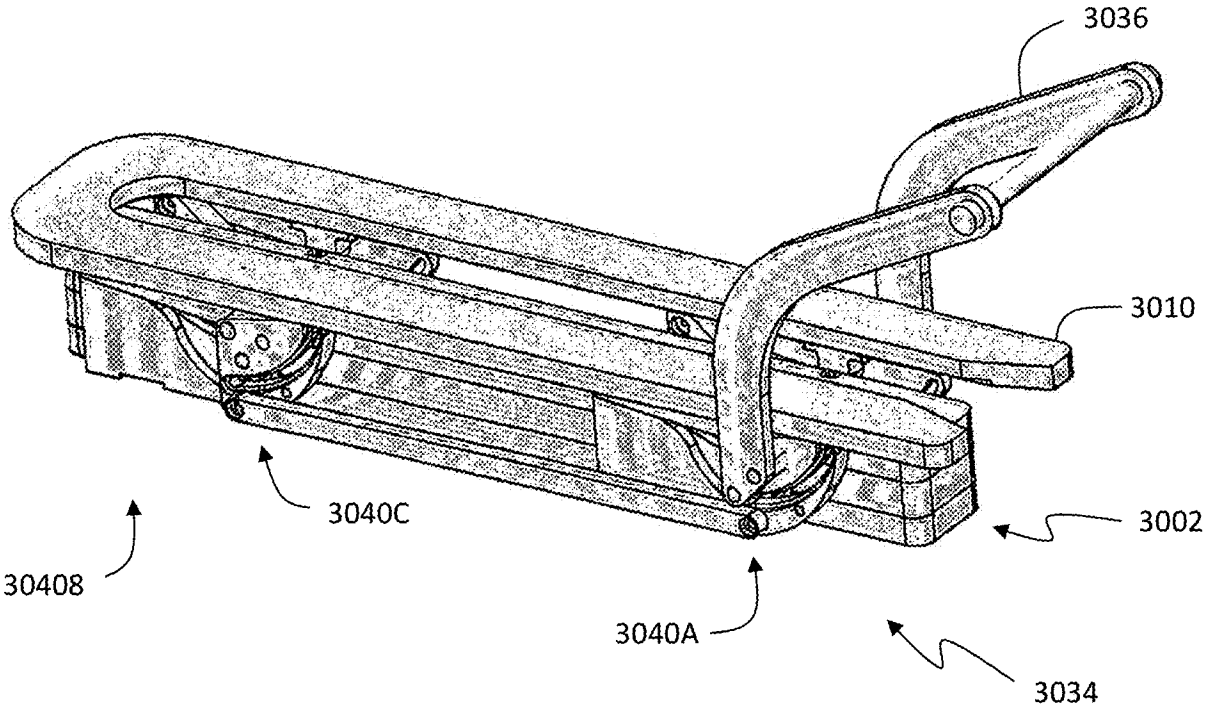
FIG. 49 is a perspective view of the connector assembly of FIG. 28.
Figure 50:
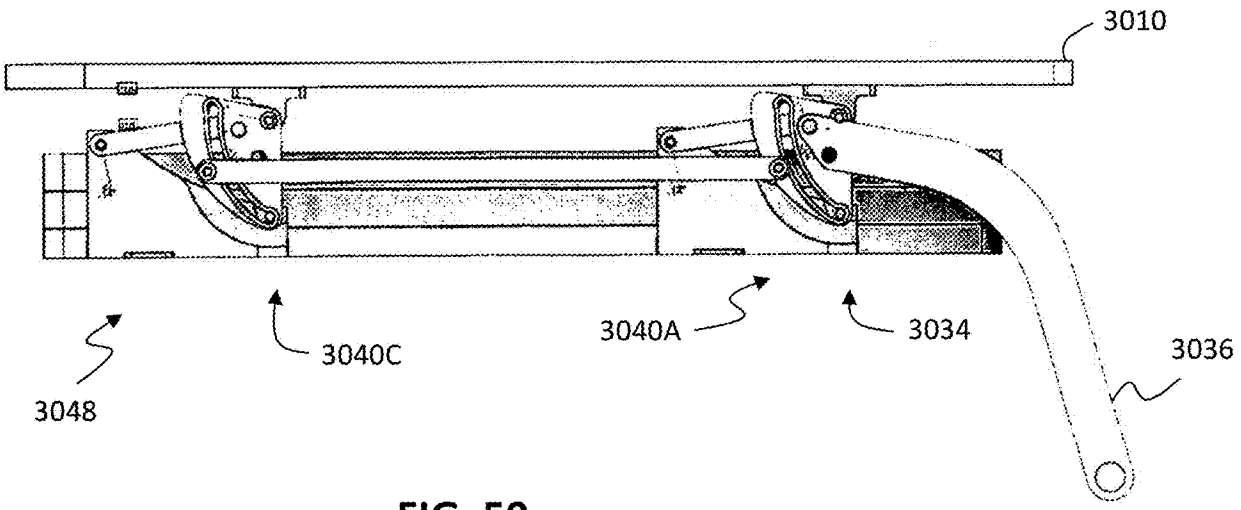
FIG. 50 is a side view of the connector assembly of FIG. 28 with the valve assembly in an unengaged position.
Figure 51:
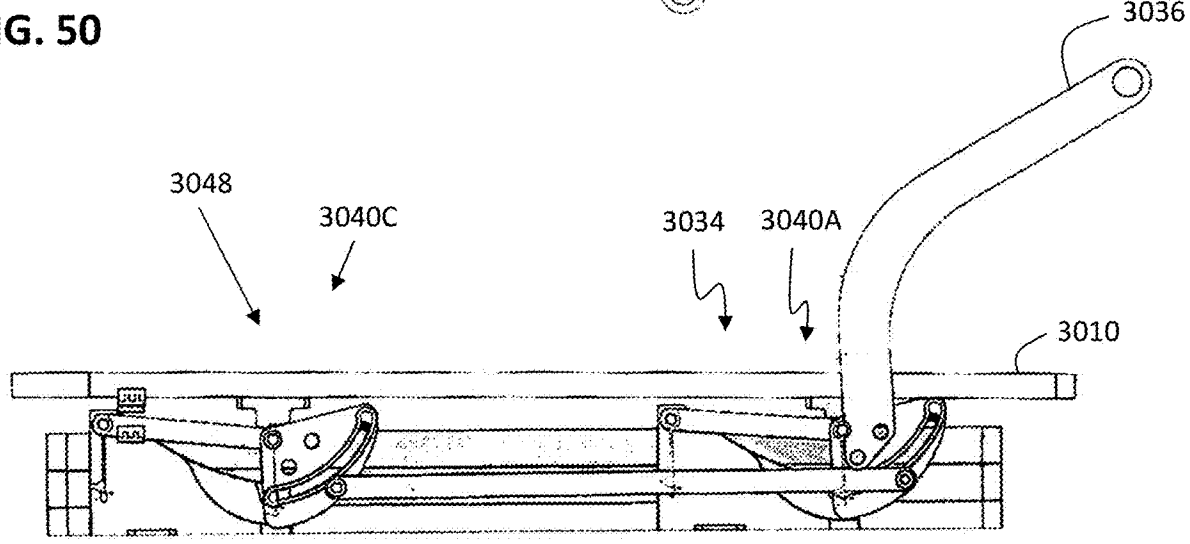
FIG. 51 is a side view of the connector assembly of FIG. 28 with the valve assembly in an engaged position.
Figure 52:
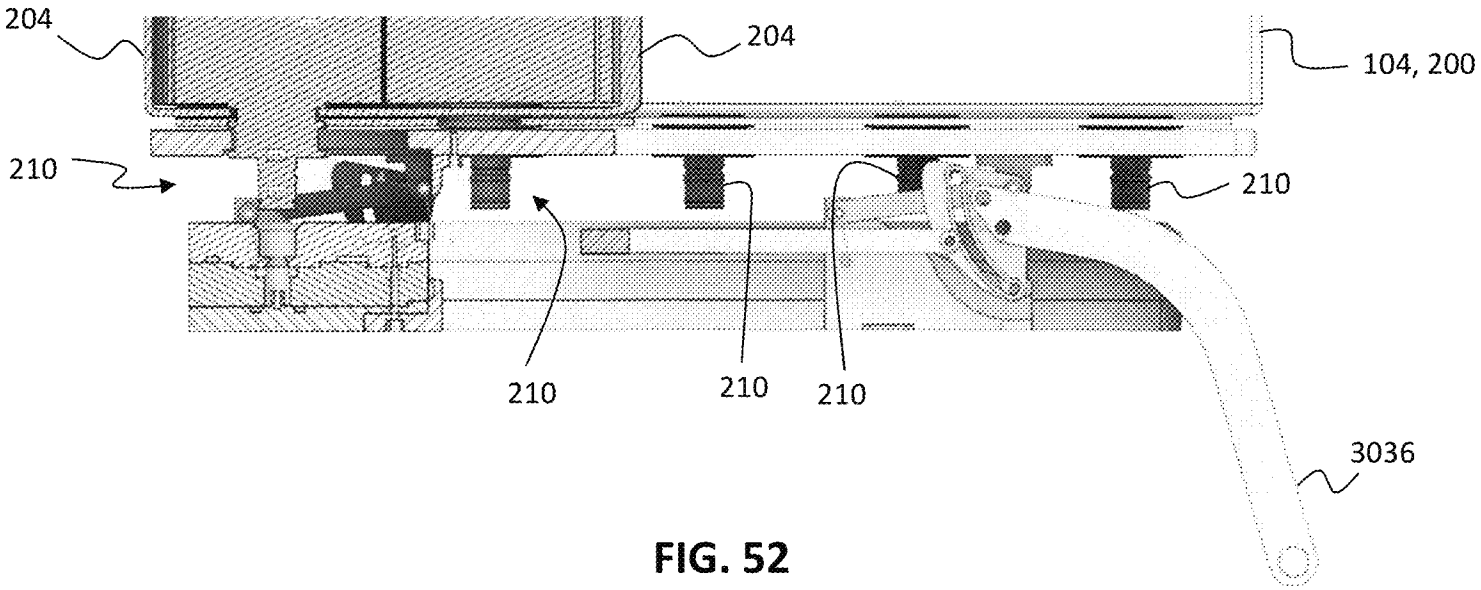
FIG. 52 is a side view of the connector assembly of FIG. 28 with a box and the valve assembly in an unengaged position.
Figure 53:
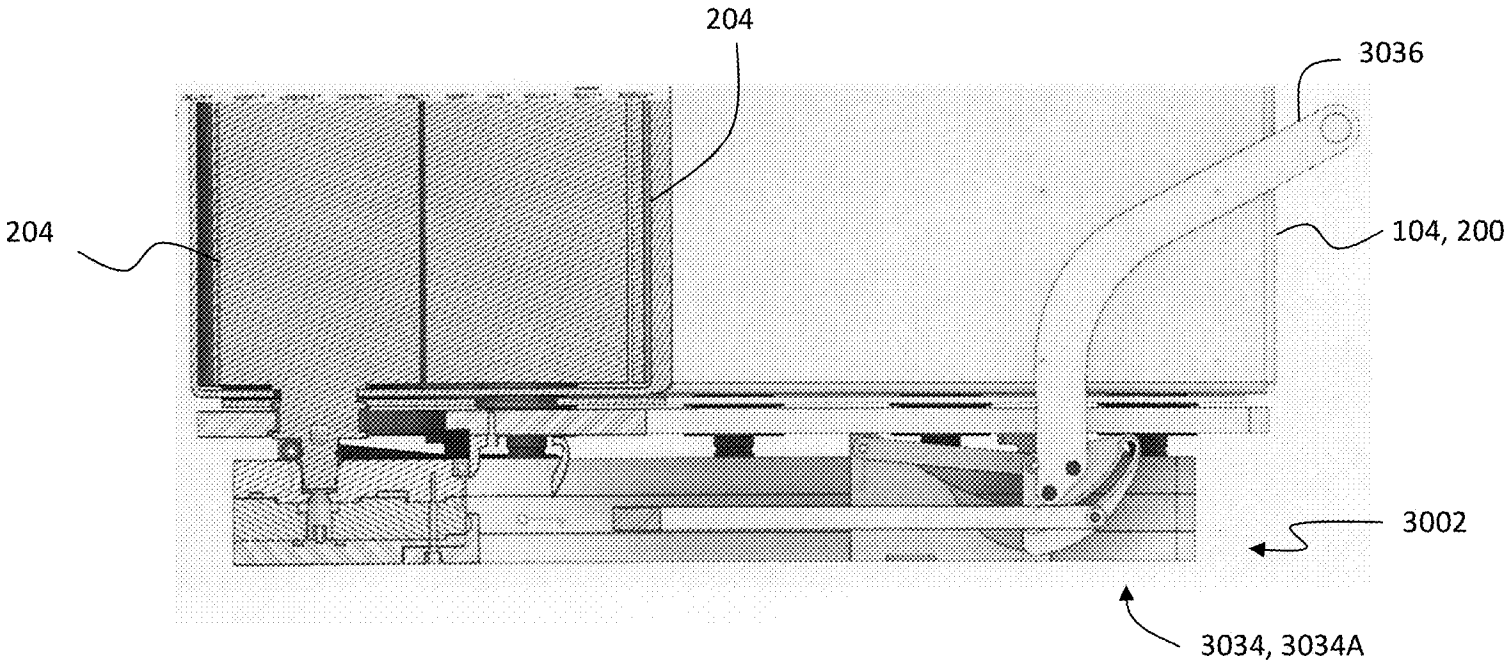
FIG. 53 is a side view of the connector assembly of FIG. 28 with a box and the valve assembly in an engaged position.
Figure 54:
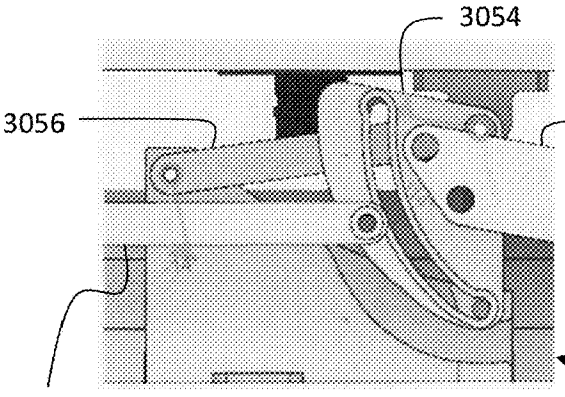
FIG. 54 is a side view of a hinge assembly of the connector assembly of FIG. 28 with the valve assembly in an unengaged position.
Figure 55:
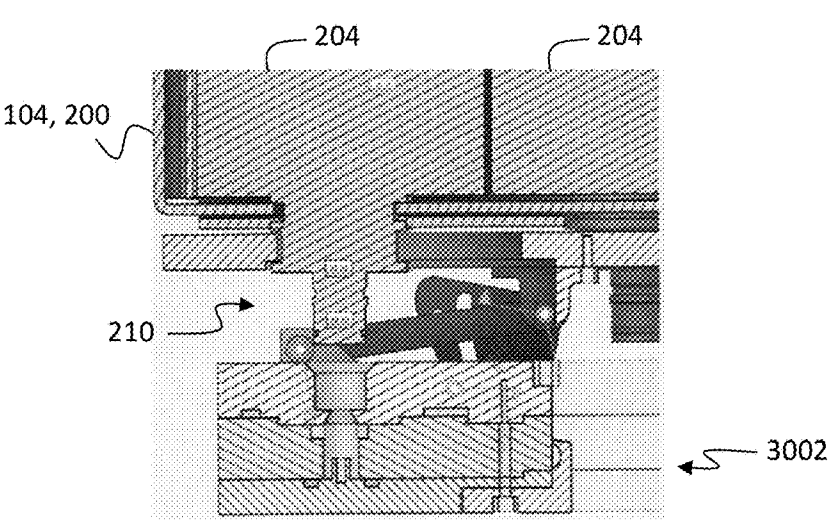
FIG. 55 is a cutaway view of a portion of the valve assembly of the connector assembly of FIG. 28 with the valve assembly in an unengaged position.
Figure 56:
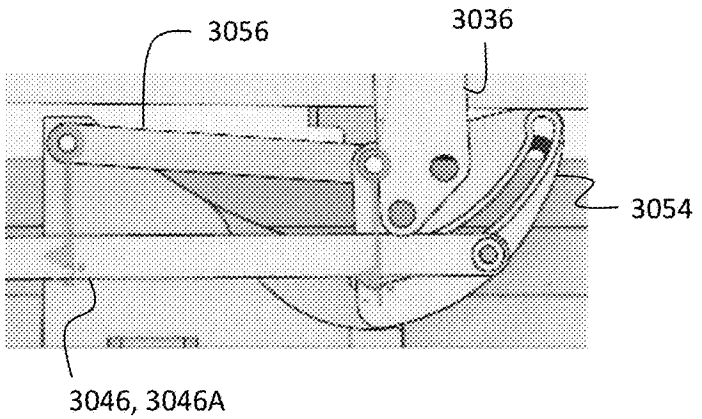
FIG. 56 is a side view of a hinge assembly of the connector assembly of FIG. 28 with the valve assembly in an engaged position.
Figure 57:
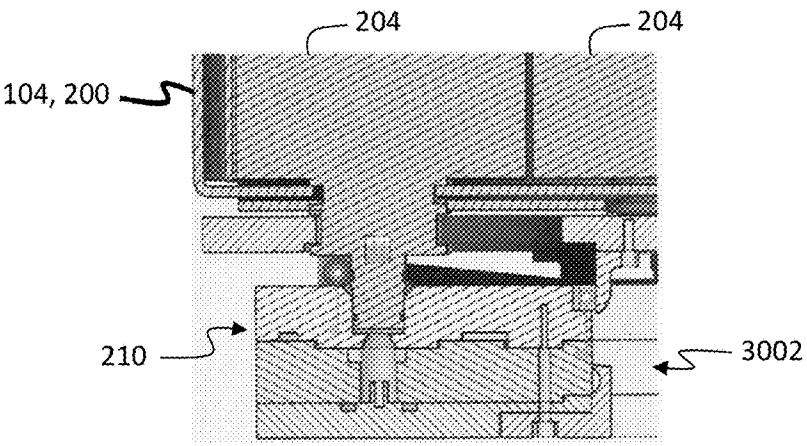
FIG. 57 is a cutaway view of a portion of the valve assembly of the connector assembly of FIG. 28 with the valve assembly in an engaged position.
Figure 58:
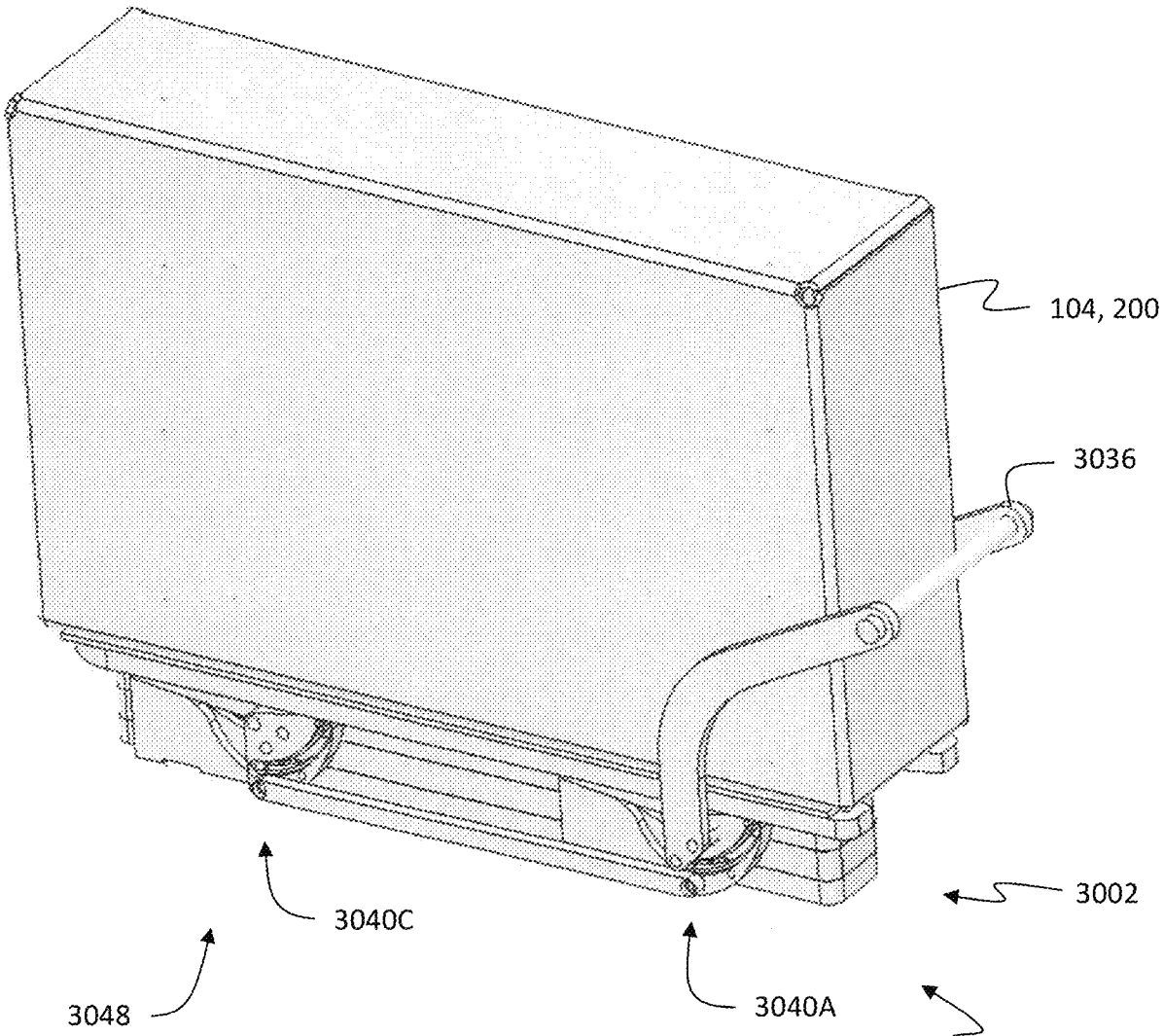
FIG. 58 is a diagrammatic illustration of the connector assembly of FIG. 28 with a box installed and the valve assembly in an engaged position
Figure 59:
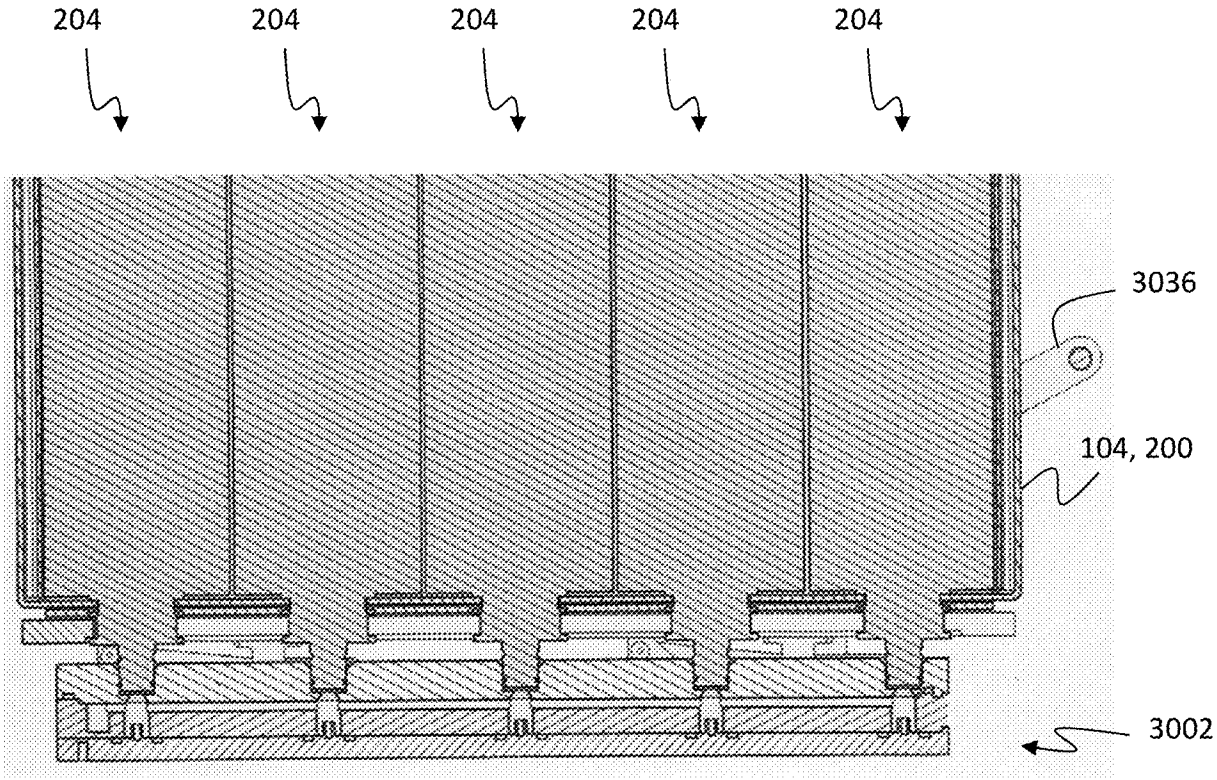
FIG. 59 is a cutaway view of the connector assembly of FIG. 28 with the box and the valve assembly in an engage position.

With reference to FIG. 44, a cutaway view of the valve assembly 3002 and a fitment 2010 is shown. As shown, in one embodiment, each valve pusher 3032 may include a valve 3033. The valve 3033 includes a cap 3033A with an o-ring 3033B. The cap 3033A is biased towards the valve intake 3014 via a spring 3033C. When the fitment 210 is inserted into the fitment receptacle 3006, the fitment 210 presses down on the cap 3003 which allows liquid to flow from the container 206 into the internal liquid flow channel 3008. The fitment 210 include a fitment valve 3035 which is biased towards the valve assembly 3002 by a fitment spring 3035A.

As shown in FIG. 33, the second surface 3014B of the valve intake 3014 includes a plurality of threaded apertures 3014C to receive respective assembly screws (not shown). The assembly screws are inserted through respective assembly apertures 3018C at the second surface 3018B of the valve cover 3018. The assembly screws pass through respective assembly apertures 3016C in the valve body 3016 to be received in the threaded apertures 3014C of the valve intake. The second surface 3014B of the valve intake 3014 includes an alignment flange or lip (not shown) that fits into a complementary alignment groove 3016D in the first surface 3016A of the valve body 3016. In the illustrated embodiment, the alignment flange and the alignment groove 3016D are generally u-shaped. However, it should be noted that other shapes or a plurality of flanges or tabs and respective alignment grooves may be used.

Returning to FIG. 33, the second surface 3014B of the valve intake 3014 includes an inset portion 3014E that surrounds the outer fitment receiving apertures 3020 and is configured to receive a gasket (not shown). Returning to FIG. 34, the first surface 3016A of the valve body 3016 includes an inset portion 3016E that surrounds the inner fitment receiving apertures 3030 and the outlet aperture 3028 and is configured to receive a gasket (not shown). The gaskets provide sealing to the valve assembly 3002.

With references to FIGS. 28 and 36-59, the actuator 3004 includes a first hinge assembly 3034 and a handle or lever 3036 coupled to the first hinge assembly 3034. The lever 3036 is moveable between an unsecured position (shown in FIGS. 50-52) to a secured position (shown in FIGS. 45-49, 51 and 53). The valve assembly 3002 is moved from the unengaged position to the engaged position in response to actuation of the lever 3034 from the unsecured to the secured position.

Returning to FIG. 28, in the illustrated embodiment, the valve assembly 3002 includes a first edge 3038A and a second edge 3038B. In the illustrated embodiment, the first hinge assembly 3034 includes first and second hinges 3040A, 3040B located adjacent the first and second edges 3038A, 3038B, respectively. As shown, the lever 3036 is coupled to the first and second hinges 3040A 3040B.

The valve assembly 3002 in the illustrated embodiment has a front 3042 and a back 3044. As shown, the first hinge assembly 3034, including the first and second hinges 3040A, 3040B are located along the front 3042 of the valve assembly 3002. In the illustrated embodiment, the actuator 3004 includes third and fourth hinges 3040C, 3040D located along the back 3044 of the valve assembly 3004 adjacent the first and second edges 3038A, 3038B, respectively. The third hinge 3004C is connected to the first hinge 3004A by a first connector bar 3046A and the fourth hinge 3004D is connected to the second hinge 3004B by a second connector bar 3046B. The connector bars 3046A, 3046B are configured to move the third and fourth hinges 3004C, 3004D in concert with the first and second hinges 3004A, 3004B, respectively.

The first hinge assembly 3034 is located along the front 3042 of the valve assembly 3002. In one embodiment, the connector assembly 3000 includes a second hinge assembly 3048 located at the back 3044 of the valve assembly 3002. In the illustrated embodiment, the second hinge assembly 3048 is formed by the third and fourth hinges 3040C, 3040D. The second hinge assembly 3048 may be fixedly coupled to the one of the guiderail 3010 and the valve assembly 3002 and rotatably coupled to the other one of the guiderail 3010 and the valve assembly 3002. In the illustrated embodiment, the second hinge assembly 3048 is fixedly coupled to the guiderail 3010. The second hinge assembly 3048 is fixedly coupled to the first hinge assembly 3034 such that the second hinge assembly 3048 moves in concert with the first hinge assembly 3034.

As discussed above in the illustrated embodiment, the actuator 3004 includes first and second hinge assembly 3034, 3048. The first hinge assembly 3004 includes first and second hinges 3040A, 3040B and the second hinge assembly 3004 includes third and fourth hinges 3004C, 3004D. With reference to FIGS. 36-41, each hinge 3040A, 3040B, 3040C, 3040D includes a lower base 3050, an upper base 3052, a rocker 3054 and a lever 3056. In FIGS. 36-41, the first and third hinges 3040A, 304C are shown. The second and fourth hinges 3040B, 3040D are mirrors of the first and third hinges 3040A, 3040D. As shown in FIG. 41, the first and second hinges 3040A, 3040B include a spacer 3058. The handle(s) 3036 are mounted to the rocker(s) 3054 via the spacer 3056 using fasteners (not shown) inserted through assembly apertures 3036A, 3054A. In general, in the illustrated embodiment, the actuator 3004 is to translate rotation of the handle 3036 into a generally linear motion of the valve assembly 3002 relative to the guiderail 3010 and/or the box 104, 200. It should be noted that the relative motion of the valve assembly 3002 is not strictly linear in the illustrated embodiment, i.e., the motion has a slight curve as the valve assembly 3002 travels towards and/or away from the guiderail 3010 and/or the box 104, 200. As discussed above, motion of the first and third hinges 3040A, 3040C and motion of the second and fourth hinges 3040B, 3040D are synchronized via levers 3046A, 3046B, respectively.

Figure 36:
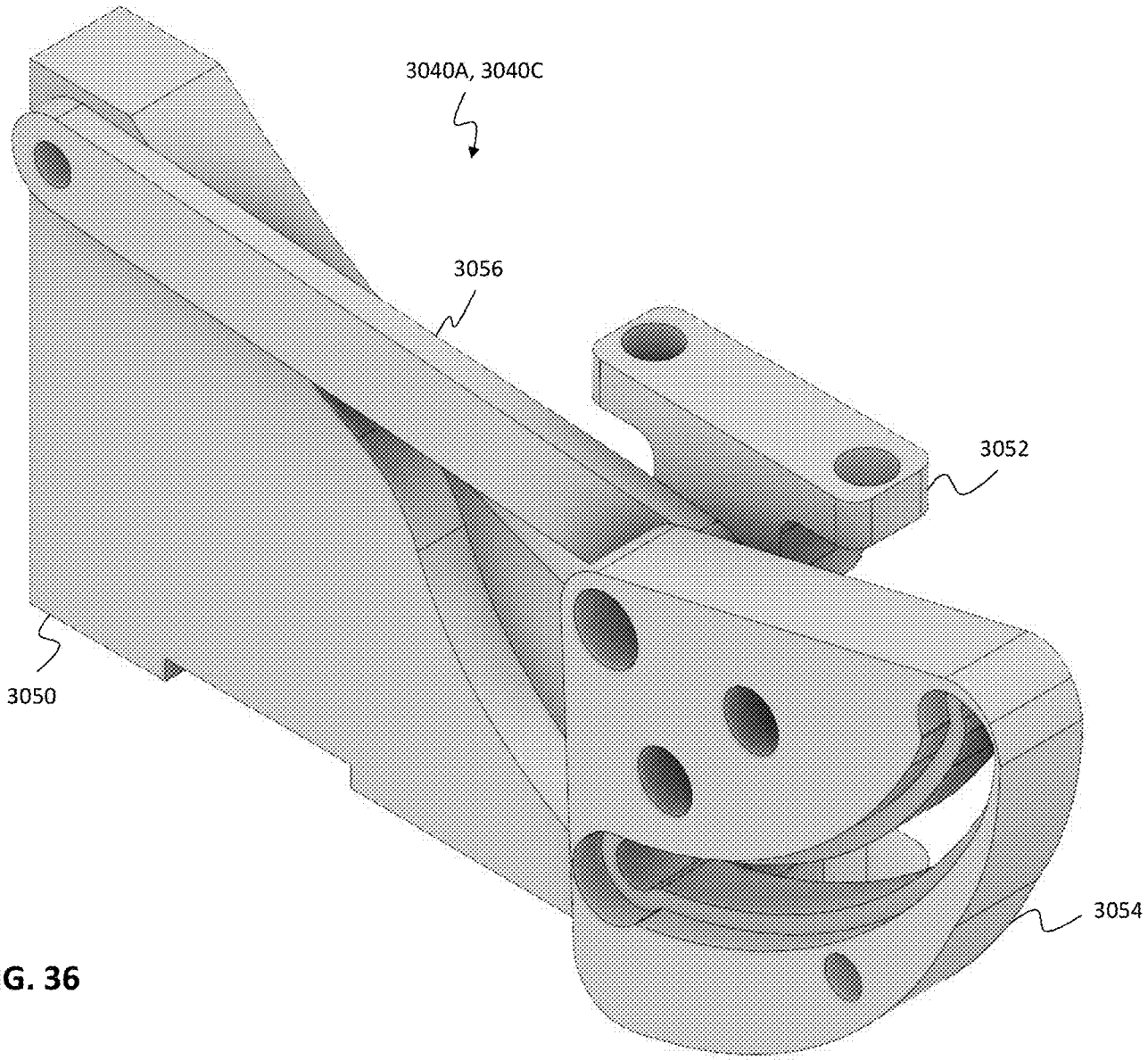
FIG. 36 is a perspective view of a portion of a hinge assembly of an actuator of the valve assembly of FIG. 31, according to an embodiment of the present invention.
Figure 38:
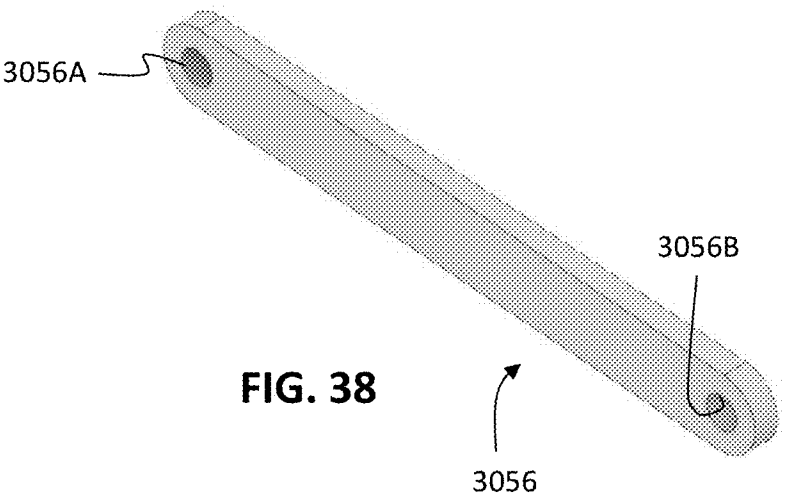
FIG. 38 is a perspective view of a second component of the hinge assembly of FIG. 36.
Figure 37:
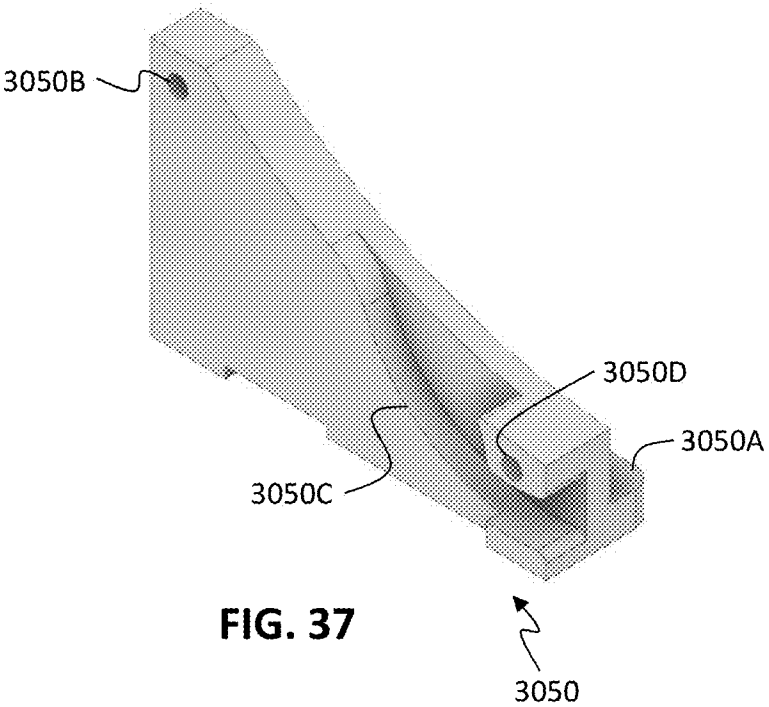
FIG. 37 is a perspective view of a component of the hinge assembly of FIG. 36.

With reference to FIGS. 36 and 37, the lower base 3050 includes a flange 3050A. The flange 3050A fits into the a respective cutout 3018D on the second surface 3018B of the valve cover 3018 and secured with, e.g., assembly fasteners or screws (not shown). The lower base 3050 also includes a threaded aperture 3050B for receiving an assembly screw. As shown in FIG. 38, the lever 3056 includes a first and second apertures 3056A, 3056B. The first aperture 3056A receives the assembly screw to rotatably couple the lever 3056 to the lower base 3050. Returning to FIGS. 36 and 37, the lower base 3050 includes a curved ramp portion 3050B.

Figure 40:
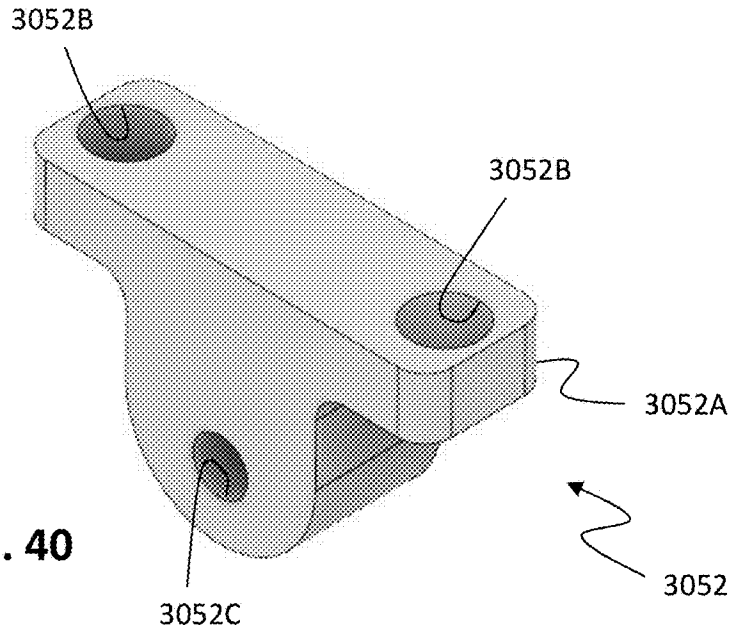
FIG. 40 is a perspective view of a fourth component of the hinge assembly of FIG. 36.
Figure 41:
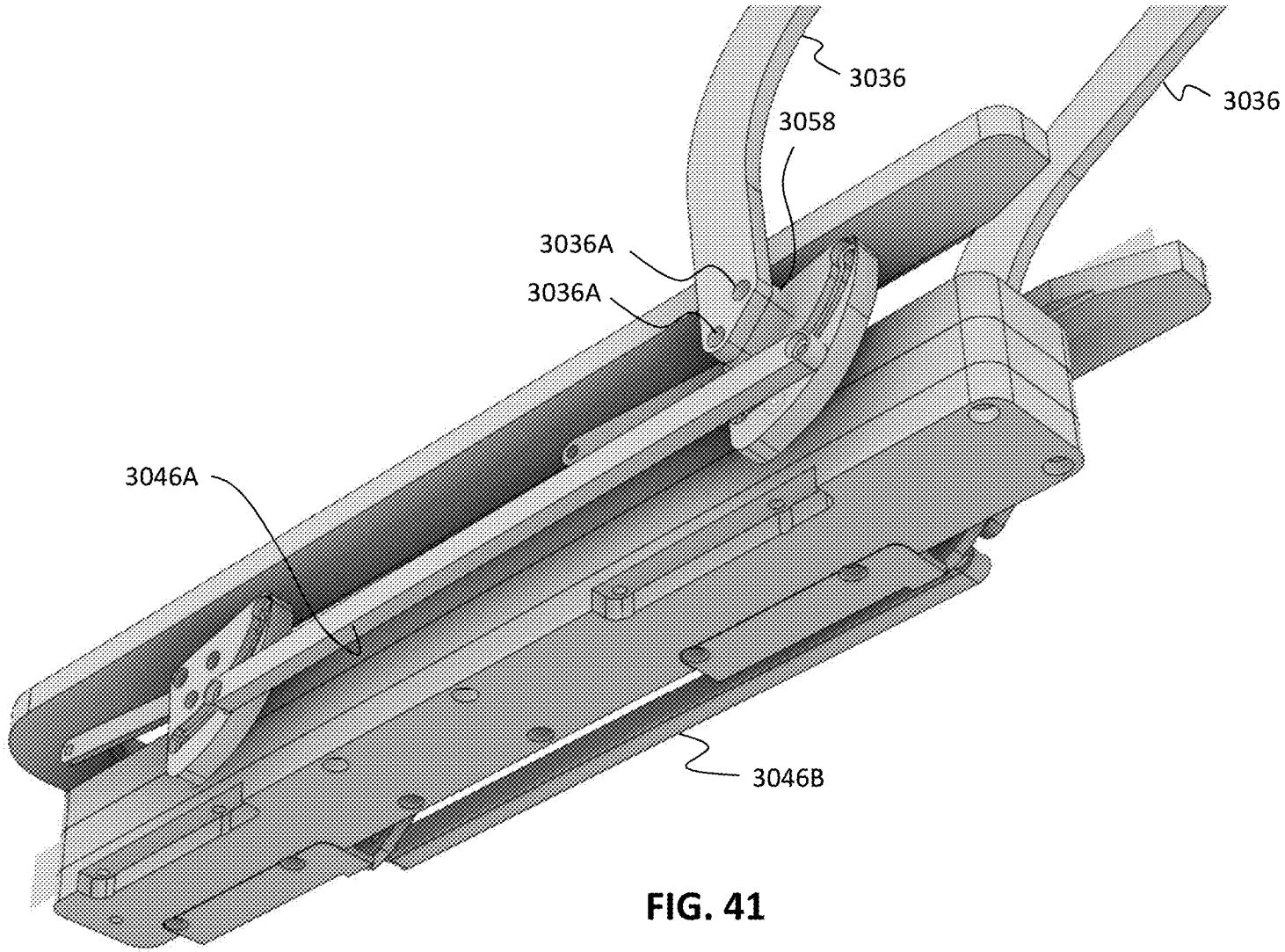
FIG. 41 is another perspective view of the connector assembly of FIG. 28.

With reference to FIGS. 36 and 40, the upper base 3052 includes an upper base portion 3052A with two apertures 3052B. The two apertures 3052B are configured to receive assembly screws (not shown) to mount the upper base 3052 to the guiderail 3010. The assembly screws are received in respective threaded apertures 3010B in the guiderail 3010 (see FIG. 30).

As shown in FIG. 36, the rocker 3054, the lever 3056 and upper base 3052 are coupled together via a fastener (not shown). The fastener serves as the pivot of the hinge 3040A, 3040B, 3040C, 3040D. The fastener may be an assembly screw that is inserted through a pivot aperture 3054B in the rocker 3054, through the second aperture 3056B of the lever 3056 and received into a threaded aperture 3052C in the upper base 3052.

Figure 39:
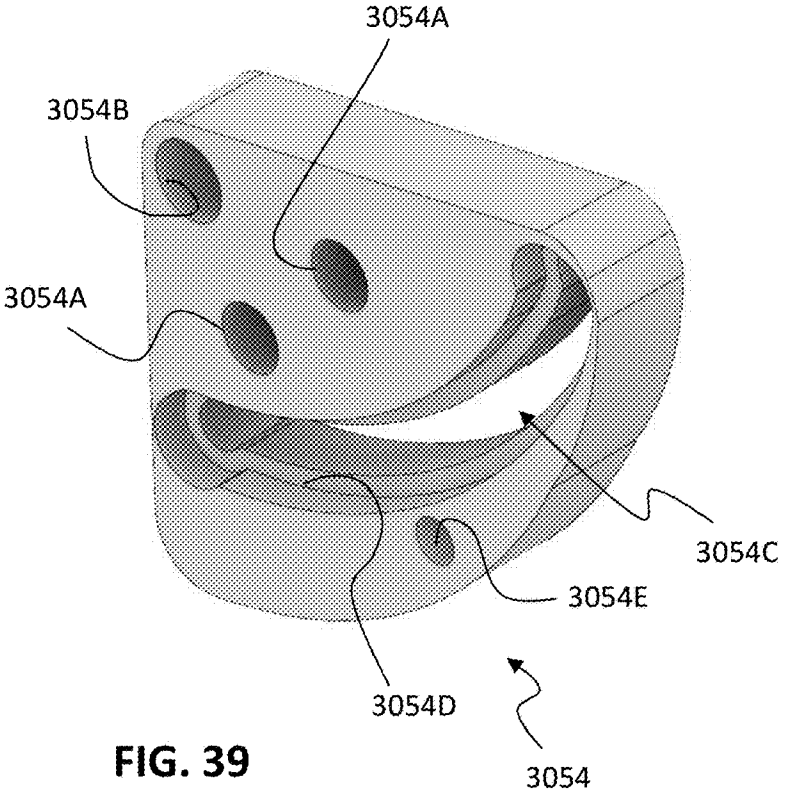
FIG. 39 is a perspective view of a third component of the hinge assembly of FIG. 36.

As shown in FIG. 39, the rocker 3054 includes a curved slot 3054C with a lip 3054D. The curved slot 3054C is configured to receive a pin (not shown). The other end of the pin is received a threaded aperture 3050D of the lower base 3050.

The rocker 3054 further includes a threaded aperture 3054E which receives a fastener (not shown) to rotatably couple one of the lever or bar 3056 that couples the first and third hinges 3040A, 3040C (and the second and fourth hinges 3040B, 3040D).

In use, the rocker 3054 couples the other parts of the hinge 3040A, 3040B, 3040C, 3040D together. The rocker 3054 is connected to the lower base 3050 slot 3054C and screwed into aperture 3054D of the lower base 3050, aperture 3056B of the lever 3056, and aperture 3052C of the upper base 3052. The other side of the lever 3056 connects to the lower base 3050 at aperture 3050B. Actuation of the handle(s) rotates the rocker 3054 about the pin in slot 3054C causing the actuator 3004 to move up or down thereby translating a rotary movement of the rocker 3054 into a linear up/down movement of the valve assembly 3002. As state above, in the illustrated embodiment the motion of the valve assembly 3002 is relatively, but not strictly linear.

With reference to FIGS. 45-49, 51, 53 and 56-57, the connector assembly 3000 is shown in an open position, i.e., with the valve assembly 3002 and the actuator 3004 in the unengaged and unlocked positions, respectively. With reference to FIGS. 50, 52 and 54-55, the connector assembly 3000 is shown in a closed position, i.e., with the valve assembly 3002 and the actuator 3004 in the engaged and locked positions, respectively.

In another aspect of the present invention, a BOTTLE HOLDER and a RACK SOLUTION FOR DISTILLED SPIRITS are provided.

A. Problem

Regulations vary from country to country on how alcohol can be distributed not only the volume but also packaging, labeling, filling etc.

In the US, the TTB regulates the bottle sizes for alcoholic beverages. Further, the Internal Revenue Code of 1986 authorizes regulations on the kind and size of containers for distilled spirits. According to the TTB, the purpose of the regulations establishing uniform standards of fill for alcoholic beverages is "to prevent a proliferation of bottle sizes and shapes which would inevitably result in consumer confusion and deception with regard to the quantity and net contents of the alcohol beverage package." Of utmost importance (keep in mind that TTB is a part of the Treasury Department), the "uniformity in bottle sizes required by these standards also facilitates the proper calculation of Federal excise tax." A key issue related to these concepts is the potential loss of water and the resulting increase in alcohol concentration or "proof", the water loss and increase in proof may be affected by the packaging.

In the US the max volume that spirits can be shipped/distributed in is 1.75 liters. This is defined by the regulation from the department of Treasury Alcohol & Tobacco Tax & Trade Bureau (TTB). This limit has a significant impact for places where spirits is distributed in large quantities such as nightclubs, large events, bars, conferences etc.

Solution

Figure 60:
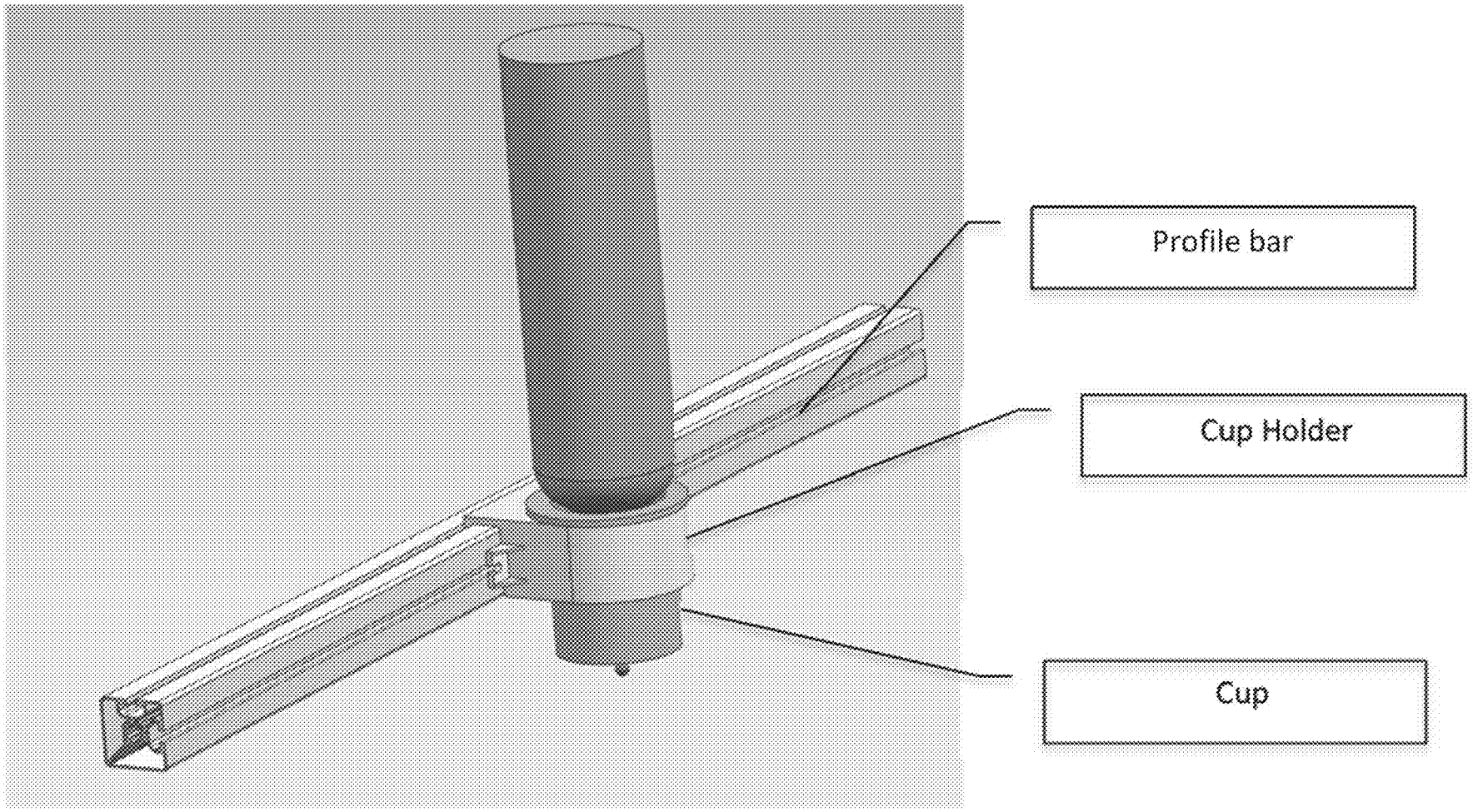
FIGS. 60-61 are diagrammatic illustrations of a connector system according to an alternate embodiment of the present invention.
Figure 61:
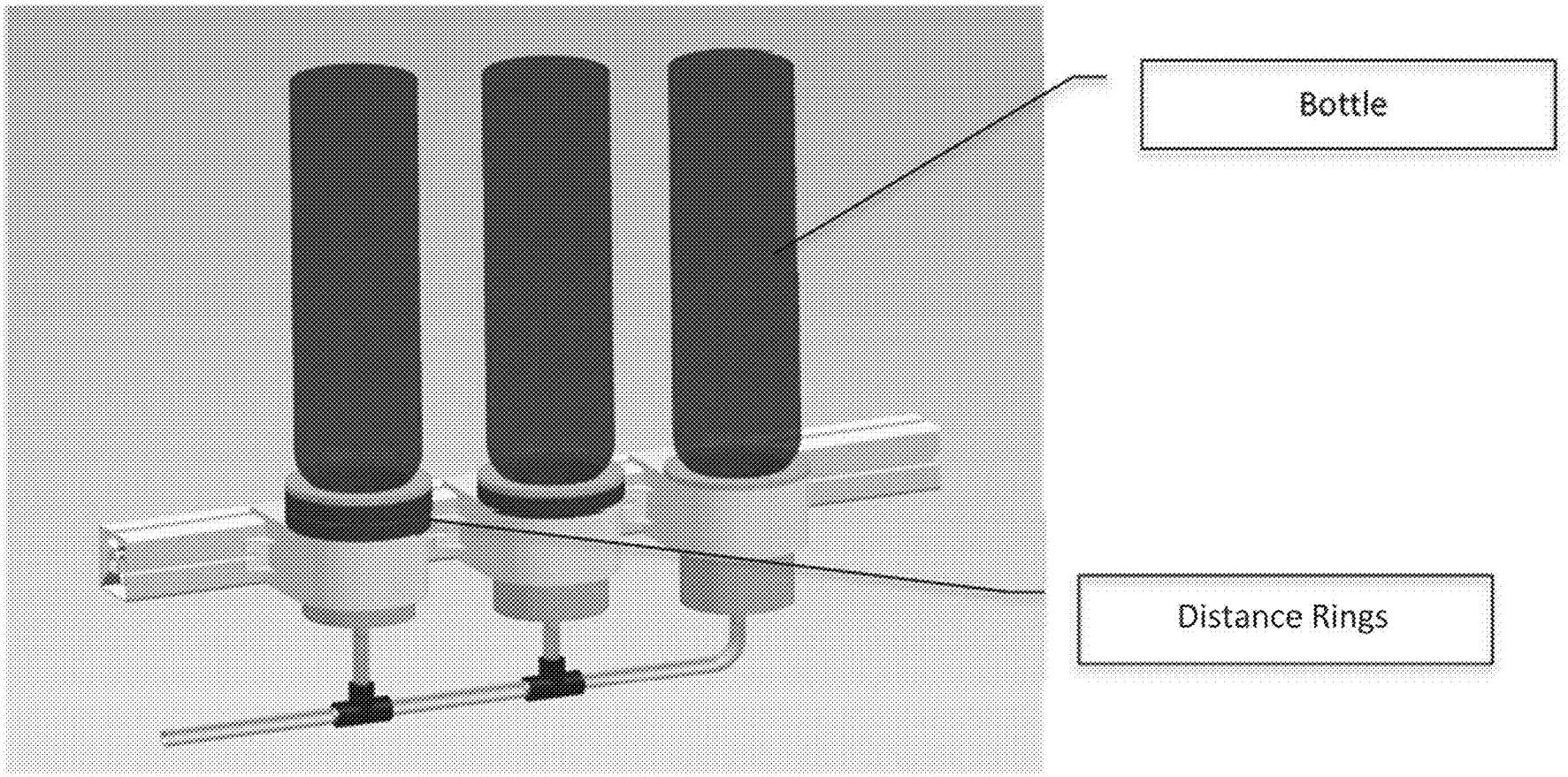

One of the solutions to address this restriction is by creating a solution that can connect multiple bottles together in a rack to feed a specific line. One solution is shown in FIGS. 60-61. To increase the capacity of liquid, one simply connects a series of individual bottle holders together.

An aluminum profile bar is used where the bottle holders can hook into. The bottle holder has 3 parts: a. the Cup Holder, b. the Cup and c. the Distance Ring. Together they form the bottle holder assembly. The assemblies are positioned at the required distance and secured with a screw or peg.

a. The Cup Holder hooks onto the profile and has 2 holes to secure it to the profile and is made from PET material.

b. The Cup may be made from PET material and has one or two drains/connectors at the bottom and a small filter to remove particles. The drains get daisy chained together with tubing and T pieces to form the feed into the dispensing system.

c. The Distance Ring slides over the cup before being inserted into the Holder. The distance rings will align the Cups in different heights thereby allowing the bottles to empty one at the time. One or more rings can be used to manage the flow of the liquid.

Packaging

A packaging solution for distilled spirits that overcomes the regulatory restrictions by connecting multiple single 1.75 l bags together in a flexible manner in a single outer packaging. All bags are filled with the same distilled spirit.

There are a variety of ways to achieve this expansion. Bags are placed in individual inner containers that are housed in a single outer container. The inner bags can be stacked on top of each other (horizontally), next to each other (vertically). Bags can be packaged in multiple configurations—single in-line compartments to create configurations like (1×2, 1×4 . . . ) or multiple compartments to create configurations like 2×3, 3×3, etc. After filling the individual bags, they are put into every one of the available inner containers of the single outer container.

There are a variety of ways to achieve this expansion. Bags are placed in individual inner containers that are housed in a single outer container. The inner bags can be stacked on top of each other (horizontally), next to each other (vertically). Bags can be packaged in multiple configurations—single in-line compartments to create configurations like (1×2, 1×4 . . . ) or multiple compartments to create configurations like 2×3, 3×3, etc. After filling the individual bags, they are put into every one of the available inner containers of the single outer container.

The outer container is closed and ready for shipment. The new packaging has now increased the distribution capacity of distilled spirits and is in alignment with the TTB's regulatory requirements.

The single outer container can only be opened via a for example a perforated rip away section or via removing a single seal. This will then reveal the fitments of each individual bag.

To connect the new multi-bag container, there are a variety of ways:

1. Each bag fitment has a simple one-time connector. A throwaway spider tube (multiple tubes that are all connected to a single outlet) is then connected to each bag's outlet. This is time consuming but cheap.
2. All fitments of the bags are pre-aligned inside the outer container with the purpose to connect. Once the seal has been removed, all the pre-aligned fitments become accessible.
3. In order to dispense the distilled spirit from the container, various connector solutions have been developed/are being proposed:
   a. A single connector to support the appropriate bag configuration of the outer container. If the bags are packaged in a 1*X single in-line configuration (x any number larger then 1), then the connector will be a single in-line connector to connect to the containers fitments. The container is positioned and the connector is connected to the container by hand. The connector would be manually connected to the alignment plate that has hooks/catches to connect/disconnect.
   b. A connector solution (receptacle) that is mounted in a fixed position. Instead of putting the connector on the container, the container is pushed into the connector. Guides ensure the container is properly aligned with the connector receptacle. Since all fitments are pre-aligned, the single container can now be easily connected to the stationary connector. Pushing a lever will release the container from the stationary connector and the springs, that are part of the connector, will assist in releasing the empty container from the connector.
   c. A connector solution (receptacle) that is mounted in a fixed position. Instead of putting the connector on the container, the container is aligned with the connector position. To ensure the container is properly aligned with the connector guides are used. Since all fitments are pre-aligned, the single container can now be connected to the connector by pushing a lever that will grab all the individual container fitments and lock them to the connector. The connector moves whilst the container stays in its position. Removal is simply pushing the same lever that will release the fitments and the container can now be removed.
4. A fluid flow sensor build into the connector has the ability to indicate the level of distilled spirits consumed and a multi-color LED will inform the user of the status so that containers can be quickly removed/replaced. Also a build-in way to ID the packaging and its content will be used to indicate if the right material is connected to the right connector.
5. A switch build into the connector provides signal whenever a bag is connected/disconnected. That information allows the back-end system to do a reset on the specific material and hence allow a calculation of the fill-status of the bag.

The outer container can have 1 or multiple compartments each having an inner container with a capacity of 1.75 L of the same distilled spirit.

A housing or rack will have receptacle connectors mounted in fixed positions. The output of these connectors can be configured in any configuration. In addition outputs of each fitment can be connected together or be separated to accommodate for smaller packaging's (1×1, 1×2, 1×3, 1×4, . . . ). Every output can be patched into a mixing patch panel that has pre-set ratios including dilution ratios—with e.g. water. You can have a 1 to 3-ratio panel where 1 portion of syrup gets mixed with 3 portions of water when the specific syrup is requested. Any single material output can be routed to multiple ratio patch panels. This now creates a post-pre-mix solution or pre-mixing on demand.

A Cocktail Management Application and Server Support Solution for Beverage Dispensing Systems that Support and Manage the Creation and Promotion of Cocktails Recipes and Analytical Data Collection.

The iCocktails is a client server or cloud based cocktail management application used to upload/download application software, recipes lists, various metrics of the dispensing device (sales per day/time, location, geo-location, stock levels, . . . ), organize, collect (upload) and download cocktail recipes on demand. Thereby creating a cocktail recipes licensing store promoting and rewarding the creativity of all mixologists.

It can be a subscription-based model that upload/downloads cocktail recipes to an appropriate beverage dispensing system and collects royalties for the recipes. It has the ability to create competitions and has a leader board for the most popular recipes. iCocktails will contain a full analytic marketing engine collecting data and providing metrics such as season drinks, recipes, brand popularity, ratios (which provide valuable data for brands) . . . and much more.

An appropriate beverage dispensing system can connect to the server and download a list of cocktails that include the ingredients (even particular brands) and ratios. Collecting brand data creates significant value for the app and the iCocktail solution.

The owner of the beverage dispensing device(s) can select what cocktails from that list he likes to offer, enable them so they can be used, adjust them at will and re-safe/upload them. He can also print out a list of cocktails materials needed and be informed about stock levels. iCocktail can also inform the user of new and popular drinks, brand promotions etc.

To offer consumers (clients) flexibility, a mobile app can be used in conjunction with the server that allows the consumer to download the pre-set cocktail recipes list available on that local device (including the pre-set ratios for each recipe) of any one of the connected beverage dispensing devices (single property/company-wide ingredient and recipes list has been created/used).

The consumer could be given certain freedoms to adjust and/or create his own recipes from the available ingredients but within the regulatory framework (restrictions of amount of alcohol/drink as they vary per state). The consumer could either 1. Adjust any ingredient of the pre-defined cocktail list, 2. Add/remove any ingredient, 3 create its own custom cocktail based on the available ingredients and 4. Upload the cocktail to share with friends and or share the cocktail recipes in a standard EVO format for use with other EVO devices. TO assist in the creation of cocktails, the app will have access to suggestive database of combinations and will highlight in color those ingredient combination that are possible (in green), not preferred (in yellow) or simply not advisable at all (in red) like lemon juice and cream.

EVO will track the use of all cocktails created and can award a creator with free drinks, points or credits. These can be used to compete on cocktails across the network.

The mobile app can also function as an interface to order drinks in a self-service capacity from the dispensing device. Age verification will be linked to the biometric to ensure that no drinks have been ordered by illegitimate consumers.

The consumer can via the app also request for ingredients and/or brands that are not available thereby providing local consumer needs to the operator. By offering the consumers the ability to create their own recipes or selecting a recipe for a cocktail, the operator will not be able to adjust the cocktails offered based on the local market.

Via the app, the consumer has the ability to vote on anyone of the recipes or newly consumer created recipes.

iCocktail Club Membership

The app support the concept of a "membership bonus system"

The app allows applying for an "iCocktail Club Membership" that entitles the consumer to gain points in other locations that are participating to this concept. Based on the status you are entitled to:

Request new ingredients

Self dispense your drinks

Apply for free drinks

Invite another member to a drink

Communication between the mobile app and the dispensing devices is via NFC, Bluetooth, QCode or other communication medium. The app can get the data from the local dispensing device or the server.

INDUSTRIAL APPLICABILITY

A packaging and connection solution for distilled spirits that connect multiple single 1.75 l bags together in a single outer packaging. The outer container can have one or multiple compartments each having an inner container with a capacity of 1.75 L of the same distilled spirit.

There are a variety of ways to achieve this expansion. Bags are placed in individual inner compartments that are housed in a single outer container. The bags can be stacked on top of each other (horizontally), next to each other (vertically). Bags can be packaged in multiple configurations—single in-line compartments to create configurations like (1×2, 1×3 . . . ) or multiple compartments to create configurations, e.g., 2×3, 3×3, etc. . . . After filling the individual bags, they are being placed inside the available inner compartments of the single outer container. All fitments of the bags are pre-aligned before the outer container is closed. Pre-alignment is achieved through an alignment form that can be part of the container and/or a separate part or alignment plate.

The container can be made from carton, sturdy plastic or other such material or a combination of Carton and a sturdy part. If the container is sturdy or partially the sturdy it may be referred to as a sturdy container. The rigidity will be applicable to align the fitments and allow a valve assembly or any other connector to be pushed onto the container without it being collapsing and making sure that the fitments don't move.

When the container is opened via for example a perforated strip that will rip away a section of the container or via removing a cover that covers the sturdy designed fitment section of the container, all pre-aligned fitments are exposed.

In order to dispense the distilled spirit from the container, various connector solutions methods have been developed.

In one aspect of the invention, a single connector solution is designed to support the appropriate configuration of the outer container. If the bags are packaged in a 1×X (single in-line configuration), where X is any number larger then 1), then the connector will be a single in-line connector to connect to the fitments. All fitments are aligned inside the container. When the container is opened and the fitments are exposed, the connector assembly is connected to the container by hand. The connector assembly connects to the alignment plate via hooks/catches to connect/disconnect.

In another aspect of the present invention, a connector assembly is mounted in a fixed position. Instead of putting the connector on the container manually, the container is aligned with the connector or the connector's guiderail that is stationary. Since all fitments are pre-aligned, the container can be pushed inside as the guiderail grabs each fitment. Once the container is fully pushed inside, the connector handle can be pushed downwards moving the valve intake body over the fitments so liquid can flow freely. To remove the container, simply push the same handle upwards thereby releasing the fitments from the valves. Only when the lever has been put in the open position, the container can be safely removed. It should be noted, that in an alternative embodiment, the container is in a fixed location and the connector assembly is movable relative to the container.

The sturdy container can also be aligned inside a container designated compartment. That compartment ensures the alignment of the container in a fixed position. Once the container is positioned with its fitments pointing upwards, or sideways, the valve assembly is mounted in such a position that when it is moved—by handle—it moves from its passive position (not connected) to its active position (connected). The valve assembly is pushed over the fitments and liquid can now flow.

Alternatively the sturdy container can simply be pushed into a fixed valve assembly. A lever will close when the container is in position. To remove the container, the lever needs to move to the open position which will separate the container from the valve assembly.

A connector solution has been created that has a guiderail in which the fitments slide.

The connector solution may be mounted inside a cabinet. There are various ways this connector solution can be deployed. One such way is that the guiderail part of the connector is mounted flush, stationary, as part of the shelf whilst the body of the connector solution, that contains the valves, is moveable.

After the container has been opened, it is positioned on the shelf with its fitments aligned with the stationary guiderail part of the connector solution. The container can now be pushed all the way into the guiderail until the first fitment hits the end of the guiderail. Only when the container is fully inserted will the fitments be properly aligned with the valve intakes (see drawing—cut view with box open). By moving the connector's handle (lever), the valve intake part of the connector solution will be pushed onto the fitments. The container is now secured allowing liquid to flow freely.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A connector assembly for controllably coupling a plurality of containers containing a liquid, each container having a fitment, each fitment having a channel and configured to releasably connect a respective container to the connector assembly, the containers being housed in a box with the fitments being arranged in predetermined relative locations, comprising:

a valve assembly including a valve intake, a valve body and a valve cover and being movable between an unengaged position and an engaged position, the valve assembly including a plurality of fitment receptacles, each fitment receptacle being associated with a respective fitment, the plurality of fitment receptacles being arranged in a pattern coinciding with the predetermined relative locations of the fitments, the valve assembly having a liquid flow channel and an outlet, wherein the liquid flow channel couples the fitment receptacles to the outlet; and, an actuator coupled to the valve assembly, the actuator being movable between an unlocked position and a locked position, wherein the valve assembly is configured to move from the unengaged position to the engaged movement in response to movement of the actuator from the unlocked to locked positions, wherein the fitments are inserted into the respective fitment receptacles in response to movement of the valve assembly from the unengaged position to the engaged position, wherein the valve intake has a first surface and a second surface, the valve intake including a plurality of outer fitment receiving apertures, each outer fitment receiving aperture having a chamfered outer edge located on the first surface of the valve intake and extending through the valve intake to the second surface of the valve intake, the second surface of the valve intake having a gasket channel for receiving a gasket.

2. A connector assembly, as set forth in claim 1, further comprising a guiderail having an inner track, the guiderail being configured to be positioned relative to the containers such that the inner track engages the channel of each fitment, the valve assembly being coupled to the guiderail.

3. A connector assembly, as set forth in claim 2, wherein the guide rail is fixed to the box and the valve assembly is releasably coupled to the guiderail.

4. A connector assembly, as set forth in claim 1, wherein the valve assembly includes a valve pusher located at a bottom of each fitment receptacle, each fitment includes a fitment valve, the valve pusher being configured to be received within a respective fitment as the fitments are inserted into the fitment receptacles thereby opening the respect fitment valve and allowing liquid to flow from the containers.

5. A connector assembly, as set forth in claim 1, wherein each fitment receptacle has a chamfered outer edge.

6. A connector assembly, as set forth in claim 1, wherein the valve assembly includes an interior passage that connects each fitment receptacle and the outlet.

7. A connector assembly, as set forth in claim 1, wherein the valve body has a first surface and a second surface, the first surface of the valve body being adjacent the second surface of the valve intake and having a liquid chamber, an outlet aperture and a plurality of inner fitment receiving apertures, the inner fitment receiving apertures being aligned with respective outer fitment receiving apertures, the liquid chamber connecting the inner fitment receiving apertures and the outlet aperture, the liquid chamber and the second surface of the valve intake forming the liquid flow channel.

8. A connector assembly, as set forth in claim 7, wherein the valve cover includes a first surface adjacent the second surface of the valve body, the valve cover including a plurality of valve pushers extending from the first surface of the valve cover and being aligned with respective inner and outer fitment receiving apertures forming the fitment receptacles, each fitment including a valve moveable from a closed position to an open position, wherein the valve pushers are inserted into a respective fitment thereby opening the respective valve to the open position in response to movement of the valve assembly from the unengaged position to the engaged position.

9. A connector assembly for controllably coupling a plurality of containers containing a liquid, each container having a fitment, each fitment having a channel and configured to releasably connect a respective container to the connector assembly, the containers being housed in a box with the fitments being arranged in predetermined relative locations, comprising:

a valve assembly movable between an unengaged position and an engaged position, the valve assembly including a plurality of fitment receptacles, each fitment receptacle being associated with a respective fitment, the plurality of fitment receptacles being arranged in a pattern coinciding with the predetermined relative locations of the fitments, the valve assembly having a liquid flow channel and an outlet, wherein the liquid flow channel couples the fitment receptacles to the outlet; and, an actuator coupled to the valve assembly, the actuator being movable between an unlocked position and a locked position, wherein the valve assembly is configured to move from the unengaged position to the engaged movement in response to movement of the actuator from the unlocked to locked positions, wherein the fitments are inserted into the respective fitment receptacles in response to movement of the valve assembly from the unengaged position to the engaged position, wherein the actuator includes a first hinge assembly and a lever coupled to the first hinge assembly, wherein the lever is moveable between an unsecured position to a secured position, wherein the valve assembly is moved from the unengaged position to the engaged position in response to actuation of the lever from the unsecured to the secured position.

10. A connector assembly, as set forth in claim 9, wherein the valve assembly includes a first edge and a second edge and the first hinge assembly includes first and second hinges located adjacent the first and second edges, respectively, the lever being coupled to the first and second hinges.

11. A connector assembly, as set forth in claim 10, wherein the valve assembly has a front and a back, wherein the first and second hinges are located along the front of the valve assembly, wherein the actuator includes third and fourth hinges located along the back of the valve assembly adjacent the first and second edges, respectively, wherein the third hinge is connected to the first hinge by a first connector bar and the fourth hinge is connected to the second hinge by second connector bar, wherein the connector bars are configured to move the third and fourth hinges in concert with the first and second hinges, respectively.

12. A connector assembly, as set forth in claim 9, wherein the valve assembly has a front and a back, wherein the first hinge assembly is located along the front of the valve assembly, wherein the actuator includes a second hinge assembly fixedly coupled to the one of the guiderail and the valve assembly and rotatably coupled to the other one of the guiderail and the valve assembly, wherein the second hinge assembly is fixedly coupled to the first hinge assembly such that the second hinge assembly moves in concert with the first hinge assembly.

13. A connector assembly for controllably coupling a plurality of containers containing a liquid, each container having a fitment, each fitment having a channel and configured to releasably connect a respective container to the connector assembly, the containers being housed in a box with the fitments being arranged in predetermined relative locations, comprising:

a valve assembly movable between an unengaged position and an engaged position, the valve assembly including a plurality of fitment receptacles, each fitment receptacle being associated with a respective fitment, the plurality of fitment receptacles being arranged in a pattern coinciding with the predetermined relative locations of the fitments, the valve assembly having a liquid flow channel and an outlet, wherein the liquid flow channel couples the fitment receptacles to the outlet, wherein the valve assembly includes a valve pusher and an interior passage, the valve pusher being located at a bottom of each fitment receptacle, each fitment includes a fitment valve, the valve pusher being configured to be received within a respective fitment as the fitments are inserted into the fitment receptacles thereby opening the respect fitment valve and allowing liquid to flow from the containers, the interior passage connecting each fitment receptacle and the outlet; and, an actuator coupled to the valve assembly, the actuator being movable between an unlocked position and a locked position, wherein the valve assembly is configured to move from the unengaged position to the engaged movement in response to movement of the actuator from the unlocked to locked positions, wherein the fitments are inserted into the respective fitment receptacles in response to movement of the valve assembly from the unengaged position to the engaged position, wherein the valve assembly has a front and a back, wherein the actuator includes a first hinge assembly located near the front of the valve assembly, a second hinge assembly located near the back of the valve assembly, and a lever coupled to the first hinge assembly, the second hinge assembly being fixedly coupled to the first hinge assembly such that the second hinge assembly moves in concert with the first hinge assembly, wherein the lever is moveable between an unsecured position to a secured position, wherein the actuator is moved from the unlocked position to the locked position in response to actuation of the lever from the unsecured to the secured position.

14. A connector assembly, as set forth in claim 13, further comprising a guiderail having an inner track, the guiderail being configured to be positioned relative to the containers such that the inner track engages the channel of each fitment, the valve assembly being coupled to the guiderail.

15. A connector assembly, as set forth in claim 13, wherein the valve assembly includes a valve intake, a valve body, and a valve cover, wherein the valve intake has a first surface and a second surface, the valve intake including a plurality of outer fitment receiving apertures, each outer fitment receiving aperture having a chamfered outer edge located on the first surface of the valve intake and extending through the valve intake to the second surface of the valve intake, the second surface of the valve intake having a gasket channel for receiving a gasket, wherein the valve body has a first side surface and a second surface, the first surface of the valve body being adjacent the second surface of the valve intake and having a liquid chamber, an outlet aperture and a plurality of inner fitment receiving apertures, the inner fitment receiving apertures being aligned with respective outer fitment receiving apertures, the liquid chamber connecting the inner fitment receiving apertures and the outlet aperture, the liquid chamber and the second surface of the valve intake forming the liquid flow channel, wherein the valve cover includes a first surface adjacent the second surface of the valve body, the valve cover including a plurality of valve pushers extending from the first surface of the valve cover and being aligned with respective inner and outer fitment receiving apertures forming the fitment receptacles, each fitment including a valve moveable from a closed position to an open position, wherein the valve pushers are inserted into a respective fitment thereby opening the respective valve to the open position in response to movement of the valve assembly from the unengaged position to the engaged position.

16. A connector assembly, as set forth in claim 13, wherein the valve assembly includes a first edge and a second edge and the first hinge assembly includes first and second hinges located adjacent the first and second edges, respectively, the lever being coupled to the first and second hinges, wherein the second hinge assembly includes third and fourth hinges located along the back of the valve assembly adjacent the first and second edges, respectively, wherein the third hinge is connected to the first hinge by a first connector bar and the fourth hinge is connected to the second hinge by second connector bar, wherein the connector bars are configured to move the third and fourth hinges in concert with the first and second hinges, respectively.

17. A connector assembly for controllably coupling a plurality of containers containing a liquid, each container having a fitment, each fitment having a channel and configured to releasably connect a respective container to the connector assembly, the containers being housed in a box with the fitments being arranged in predetermined relative locations, comprising:

a guiderail having an inner track, the guiderail being configured to be positioned relative to the containers such that the inner track engages the channel of each fitment;

a valve assembly coupled to the guiderail and being movable between an unengaged position relative to the guiderail and an engaged position relative to the guiderail, the valve assembly including a plurality of fitment receptacles, each fitment receptacle being associated with a respective fitment, the plurality of fitment receptacles being arranged in a pattern coinciding with the predetermined relative locations of the fitments, the valve assembly having a liquid flow channel and an outlet, wherein the liquid flow channel couples the fitment receptacles to the outlet, wherein the valve assembly includes a valve pusher located at a bottom of each fitment receptacle, each fitment includes a fitment valve, the valve pusher being configured to be received within a respective fitment as the fitments are inserted into the fitment receptacles thereby opening the respect fitment valve and allowing liquid to flow from the containers; and, an actuator coupled between the guiderail and the valve assembly, the actuator being movable between an unlocked position and a locked position, wherein the valve assembly is configured to move from the unengaged position to the engaged movement in response to movement of the actuator from the unlocked to locked positions, wherein the fitments are inserted into the respective fitment receptacles in response to movement of the valve assembly from the unengaged position to the engaged position, wherein the actuator includes a first hinge assembly fixedly coupled to one of the guiderail and the valve assembly and rotatably coupled to an other one of the guiderail and the valve assembly and a lever coupled to the first hinge assembly, wherein the lever is moveable between an unsecured position to a secured position, wherein the valve assembly is moved from the unengaged position to the engaged position in response to actuation of the lever from the unsecured to the secured position, wherein the valve assembly has a front and a back, wherein the first hinge assembly is located along the front of the valve assembly, wherein the actuator includes a second hinge assembly fixedly coupled to the one of the guiderail and the valve assembly and rotatably coupled to the other one of the guiderail and the valve assembly, wherein the second hinge assembly is fixedly coupled to the first hinge assembly such that the second hinge assembly moves in concert with the first hinge assembly.

18. A connector assembly, as set forth in claim 1, wherein the guide rail is fixed to the box and the valve assembly is releasably coupled to the guiderail.

* * * * *